US006780305B2

(12) United States Patent
Nishino et al.

(10) Patent No.: US 6,780,305 B2
(45) Date of Patent: Aug. 24, 2004

(54) METHOD FOR PRODUCING SUPPORT FOR PLANOGRAPHIC PRINTING PLATE, SUPPORT FOR PLANOGRAPHIC PRINTING PLATE, AND PLANOGRAPHIC PRINTING PLATE PRECURSOR

(75) Inventors: Atsuo Nishino, Shizuoka-ken (JP); Yoshitaka Masuda, Shizuoka-ken (JP); Hirokazu Sawada, Shizuoka-ken (JP); Akio Uesugi, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 172 days.

(21) Appl. No.: 10/072,951

(22) Filed: Feb. 12, 2002

(65) Prior Publication Data

US 2002/0160308 A1 Oct. 31, 2002

(30) Foreign Application Priority Data

Feb. 20, 2001 (JP) ..... 2001-043267
Mar. 26, 2001 (JP) ..... 2001-086920

(51) Int. Cl.[7] ..... C25F 7/00

(52) U.S. Cl. ..... 205/658; 205/660; 205/674; 205/685

(58) Field of Search ..... 205/658, 660, 205/674, 685

(56) References Cited

U.S. PATENT DOCUMENTS 5,045,157 A * 9/1991 Nishino et al. ..... 205/214
5,104,484 A * 4/1992 Nakanishi et al. ..... 205/153
5,141,605 A * 8/1992 Nishino et al. ..... 205/658
5,152,877 A * 10/1992 Nishino et al. ..... 205/659
5,221,442 A * 6/1993 Kawasumi et al. ..... 205/658

* cited by examiner

*Primary Examiner*—Donald R. Valentine
(74) *Attorney, Agent, or Firm*—Sughrue Mion, PLLC

(57) ABSTRACT

The invention provides a method for producing a support for planographic printing plates which comprises a step of roughening the surface of an aluminum plate and in which the surface-roughening step includes (1) a pre-electrolytic surface-roughening step of electrolytically roughening the surface of an aluminum plate in an aqueous hydrochloric acid solution, (2) an alkali-etching step of etching the roughened surface of the aluminum plate with an alkali solution, (3) a desmutting step of contacting the etched aluminum plate with an aqueous sulfuric solution having predetermined sulfuric acid and aluminum ion concentrations at a predetermined temperature for 1 to 180 seconds, and (4) an electrolytic surface-roughening step of processing the desmutted aluminum plate in an aqueous nitric acid solution with an alternating current being applied thereto. The invention enables stable and inexpensive production of planographic printing plate supports even from regenerated aluminum.

29 Claims, 13 Drawing Sheets

METHOD FOR PRODUCING SUPPORT FOR PLANOGRAPHIC PRINTING PLATE, SUPPORT FOR PLANOGRAPHIC PRINTING PLATE, AND PLANOGRAPHIC PRINTING PLATE PRECURSOR

BACKGROUND OF THE INVENTION

1. Field of the Invention

The present invention relates to a method for producing a support for planographic printing plates, to a support for planographic printing plates, and to a planographic printing plate precursor. In particular, the invention relates to a method for producing a support for planographic printing plates, in which aluminum plates produced from regenerated aluminum ingots such as those from scrapped and recycled aluminum can be used for the material; to a support for planographic printing plates, which is produced according to the method; and to a planographic printing plate precursor, which is fabricated by forming a thermosensitive or photosensitive plate layer on the surface of the support for planographic printing plates.

The invention also relates to an aluminum plate for planographic printing plate supports, which is used as the material in the above-mentioned production method; to a planographic printing plate support formed from the aluminum plate; and to a method for inspecting aluminum plates for planographic printing plate supports. In particular, the invention relates to an aluminum plate for planographic printing plate supports, which is inexpensive and which, when processed into planographic printing plate precursors in a sequential process of roughening its surface followed by forming a plate layer thereon, is almost free from the trouble of feed disorder such as meandering, and which is therefore favorable to the production of planographic printing plate precursors; to a planographic printing plate support formed from the aluminum plate; and to a method for inspecting aluminum plates for planographic printing plate supports, in which a roll of a rolled aluminum plate fed into a device to be processed into planographic printing plate supports is inspected as to whether or not it is likely to encounter the feed disorder as described above by the use of a simple tool in a simplified manner.

2. Description of the Related Art

In general, a planographic printing plate precursor is fabricated in a process that comprises roughening the surface of a pure aluminum or aluminum alloy plate (this is hereinafter referred to as "aluminum plate"), then subjecting the surface thereof to anodic oxidation to thereby form an oxide film thereon to give a planographic printing plate support, and applying a photosensitive or thermosensitive resin onto the surface of the oxide film formed on the planographic printing plate support to thereby form a photosensitive or thermosensitive plate layer thereon. The photosensitive resin layer and the thermosensitive resin layer that are optionally combined with an undercoat layer and a protective layer are known, for example, in JP-A 62333/2000, 101651/1984 and 149491/1985.

Images including letters and pictures are printed on the plate layer of the planographic printing plate precursor, and they are developed thereon to complete a planographic printing plate.

For roughening the surface of an aluminum plate, for example, the plate surface is mechanically processed with a brush roller having nylon hair or the like or with a roughening roller of which the surface is made of an abrasive cloth (mechanical surface roughening); or chemically processed in an alkaline solution (etching); or electrolytically processed in an acidic electrolyte (electrolytic solution) by applying an alternating current to the aluminum plate serving as one electrode therein (AC electrolysis).

For ensuring good water balance in printing, in general, the plate surface is first mechanically roughened, then etched and electrolytically roughened.

After the step of electrolytic surface roughening and the step of chemical surface roughening thereof, the aluminum plate may be optionally desmutted by dipping it in an acid solution to thereby remove oxides, hydroxides and intermetallic compounds of the elements that may be deposited in the aluminum plate as a result of the process of electrolytic surface roughening and chemical surface roughening.

Regenerated aluminum ingots such as those from scrapped and recycled aluminum are more inexpensive than virgin ones, and the energy consumption at the time of production thereof is relatively small. Therefore, producing planographic printing plate precursors from aluminum plates that are prepared from such regenerated aluminum ingots is favorable in point of cost and energy saving and even in point of natural resource saving.

Different from virgin ones, however, adequate control on the alloy components is hardly done for regenerated aluminum ingots (that is, their aluminum purity is no higher than 97% by weight) and the aluminum ingots contain various impurities.

Therefore, various intermetallic compounds and deposits that result from the impurities are exposed out on the surface of the aluminum plates produced from such regenerated aluminum ingots, and the planographic printing plate precursors formed from these aluminum plates often involve defects in the oxide film thereof formed through anodic oxidation. The defects often cause serious ink stains in which ink is attached spotwise on the entire surface of printed matters.

Another problem with aluminum plates that contain many impurities, such as those produced from regenerated aluminum ingots, is that their surfaces are difficult to evenly roughen in an electrochemical process, and, when electrochemically processed, their surfaces are unevenly roughened. Therefore, when such aluminum plates are used in fabricating printing plates and when the thus-fabricated printing plates are used in printing units, ink tends to adhere to and stain the blanket of offset rollers (blanket staining), and then it is transferred onto printed papers to stain them.

In the electrolytic surface-roughening step in the process of producing planographic printing plate supports, used is an alternating current or a direct current. In particular, in case where an alternating current is used in the step, the profile of the roughened surface of the supports often varies greatly, depending on the waveform of the current employed, and when the composition of the aluminum material for the supports is varied, it is often difficult to keep the intended profile of the roughened surface of the supports in a predetermined range. This is one problem with the electrolytic surface-roughing process, and to solve it, the waveform of the current to be employed in the process must be strictly controlled.

In addition, when planographic printing plate precursors are produced from recycled aluminum, scrapped aluminum, and regenerated ingots such as those mentioned above, the mechanical properties thereof greatly vary. When such planographic printing plate precursors are exposed to light, developed and processed into printing plates by the use of an automatic photomechanical device, and when the resulting planographic printing plate is set around the blanket in a planographic offset printer, the planographic printing plate may be involved with various problems. Concretely, the printing plate set in a printer often causes paper feeding disorder such as paper entangling or meandering, and it is often lifted up from the blanket and cannot be well fitted thereto.

Aluminum webs are produced by hot-rolling a cast slab of aluminum and then cold-rolling it to have a predetermined thickness. In general, they are stored and delivered in the form of rolls, after coiled up around roll cores.

In general, aluminum ingots are so rolled into webs that the center part of the resulting webs is thicker than the edges thereof. This is in order that the edges of the aluminum web wound up in coils are prevented from being deformed when roughly contacted with each other.

However, when aluminum ingots are so rolled into webs that the center part of the resulting webs is thicker than the edges thereof, the edges are elongated larger than the center part, and, as a result, the edges are often waved or slacked in the wavy manner (which wavy deformation at the edge portions will be referred to as the "edge strain" hereinafter). If the edge strain is great, it causes feed disorder when the aluminum webs are processed into planographic printing plate precursors. In addition, the edge strain causes paper travel disorder when the resulting planographic printing plate precursors are further processed into printing plates, and fitting failure onto the blanket when the printing plate is set in an offset printer.

In case where virgin ingots, mother alloys and pure metal additives are used in preparing cast slabs, the substantially the same rolling characteristics can constantly be achieved in the obtained cast slabs. Accordingly, the edge strain can be relatively easily controlled within a predetermined range by adjusting the rolling condition.

However, recycled aluminum, scrapped aluminum and regenerated aluminum ingots generally have low aluminum purity and adequate control on the alloy components thereof has hardly been done, as described above. Therefore, the rolling characteristics of the cast slabs produced from these recycled aluminum, scrapped aluminum and regenerated ingots vary significantly. As a result, when such cast slabs are rolled into aluminum webs, it is often difficult to control their edge strain to fall within a predetermined range by simply adjusting the rolling condition.

For these reasons, it has heretofore been said that practicable planographic printing plates cannot be produced from regenerated aluminum ingots.

The invention is to solve the above-mentioned problems, and its objects are to provide an aluminum plate for planographic printing plate supports, which can be produced from recycled aluminum, scrapped aluminum and regenerated aluminum ingots as those mentioned above and which, when formed into printing plates, free from the troubles of feed disorder and fitting disorder to blankets; to provide a planographic printing plate precursor in which the aluminum plate is used for the support; and to provide a method for inspecting aluminum plates for planographic printing plate supports, in which a roll of a rolled aluminum plate fed into a device to be processed into planographic printing plate supports is inspected as to whether or not it is likely to encounter the aforementioned feed disorder and the fitting disorder to blankets, by using a simple tool in a simplified manner.

SUMMARY OF THE INVENTION

To solve the above-mentioned problems, the principal objects of the present invention are to provide a method for producing a support for planographic printing plates, in which a support (for planographic printing plates), which results in planographic printing plates of good printing durability that do not cause serious ink stains on printed matters and do not cause blanket staining, can be produced even when aluminum plates prepared from regenerated aluminum ingots which have been subjected to no alloy control are used; to provide a support for planographic printing plates obtained in the method; and to provide a planographic printing plate precursor comprising the support.

Other objects of the invention are to provide an aluminum plate for lithographic printing plate supports, which can be produced even from recycled aluminum, scrapped aluminum and regenerated ingots such as those mentioned above and which, when formed into printing plates, free from the troubles of feed disorder and fitting disorder to blankets; to provide a lithographic printing plate precursor for which the aluminum plate is used as the support; and to provide a method for inspecting aluminum plates for lithographic printing plate supports, in which a roll of a rolled aluminum plate fed into a device to be processed into planographic printing plate supports is inspected as to whether or not the aluminum plate is likely to encounter the feed disorder and the fitting disorder to blankets as above, by the use of a simple tool in a simplified manner.

The first aspect of the invention is a method for producing a support for planographic printing plates, which comprises a step of roughening at least one surface of an aluminum plate and in which the surface-roughening step includes (a) a pre-electrolytic surface-roughening step of electrolytically pre-roughening the surface of the aluminum plate in an aqueous hydrochloric acid solution that contains hydrochloric acid as the essential acid ingredient, (b) an alkali-etching step of contacting the aluminum plate of which surface has been electrolytically pre-roughened in the previous pre-electrolytic surface-roughening step, with an alkali solution to etch it, (c) a desmutting step of desmutting the aluminum plate having been etched in the previous alkali-etching step, with sulfuric acid by contacting the aluminum plate with an aqueous sulfuric acid solution having a sulfuric acid concentration of from 250 to 500 g/liter and an aluminum ion concentration of from 1 to 15 g/liter and having a liquid temperature falling between 60 and 90° C., for a contact period of time falling between 1 and 180 seconds, and (d) an electrolytic surface-roughening step of processing the aluminum plate having been desmutted in the previous desmutting step, in an aqueous nitric acid solution with an alternating current being applied thereto.

In the desmutting step in this aspect, the aluminum plate is processed with sulfuric acid having a predetermined aluminum concentration, to thereby remove the intermetallic compounds and a simple substance Si that exist on the surface of the aluminum plate and cause uneven electrolytic surface-roughening treatment to form uneven honeycomb pits in the roughened surface. The honeycomb pits referred to herein are meant to indicate that micropores formed in the roughened surface are closely adjacent to each other to thereby make the roughened surface have a honeycomb-like appearance.

Therefore, even when aluminum plates prepared from regenerated aluminum ingots that contain a relatively large amount of silicon and manganese which may form intermetallic compounds and a simple substance Si are used in the method, the surfaces of the aluminum plates are well uniformly processed in the electrolytic surface-roughening step that follows the desmutting step with sulfuric acid, and uniform honeycomb pits are formed in their surfaces. Accordingly, the support produced in the method is favorable to planographic printing plates.

Before processed in the electrolytic surface-roughening step, the surface of the aluminum plate is electrolytically pre-roughened in an aqueous hydrochloric acid solution in the pre-roughening step of processing it. Therefore, the support for planographic printing plates produced in the method is uniformly processed and is free from streaks in its surface.

In the second aspect of the invention, the surface-roughening step includes an etching step, prior to the pre-electrolytic surface-roughening step, of contacting the aluminum plate with an alkali solution to etch the aluminum plate (which etching step will be referred to as "the etching step prior to the pre-electrolysis" hereinafter).

In the present aspect, the pre-electrolytic surface-roughening step is effected after the etching step prior to the pre-electrolysis. In the etching step prior to the pre-electrolysis, the surface of the aluminum plate dissolves in an alkali solution, and, in particular, the area of hillocks that protrude greatly from the area around them at the surface of the aluminum plate dissolves first in the solution. Therefore, even when the surface of the aluminum plate has large hillocks, recesses and other defects, such projection/recesses are smoothed well in the etching step prior to the pre-electrolytic surface-roughening step.

In the present aspect, it is desirable that the aluminum plate is, after etched but before pre-electrolyzed, desmutted in an aqueous acid solution, so that the oxides, hydroxides and intermetallic compounds of the impurity elements having formed on the etched surface of the aluminum plate can be removed by the desmutting treatment.

In the third aspect of the invention, the surface-roughening step includes a mechanical surface-roughening step of mechanically roughening at least one surface of the aluminum plate, prior to the pre-electrolytic surface-roughening step.

In the present aspect, the mechanical surface-roughening treatment in the step produces uniform and non-directional grains in the roughened surface of the aluminum plate. In this, therefore, the surface of the aluminum plate roughened in the surface-roughening step has good water retentiveness. Accordingly, the support for planographic printing plates obtained according to the production method ensures good water-ink balance of planographic printing plates.

In the fourth aspect of the invention, the surface roughening step includes: an etching step of etching the aluminum plate, of which surface has been roughened in the electrolytic surface-roughening step, with an alkali solution (which etching step will be referred to as "the etching step after the electrolysis" hereinafter); and a final desmutting step of desmutting the aluminum plate which has been etched in the etching step after the electrolysis, by contacting the aluminum plate with an aqueous sulfuric acid solution.

In the electrolytic surface-roughening step, the aluminum plate is electrolyzed with an alternating current applied thereto. In this, therefore, a minus voltage and a plus voltage in periodic cycles are alternately applied to the aluminum plate. While having received a minus voltage, the aluminum plate undergoes anodic reaction, and its surface is thereby dissolved to have honeycomb pits formed therein. On the other hand, while having received a plus voltage, the aluminum plate undergoes cathodic reaction to thereby have an aluminum hydroxide film formed thereon.

The aluminum hydroxide film formed on the surface of the aluminum plate through such cathodic reaction is dissolved and removed in the etching step after the electrolysis in which the aluminum plate is processed with an alkali solution.

The smut formed on the surface of the aluminum plate in the etching step after the electrolysis is removed in the final desmutting step.

Accordingly, the aluminum plate of which surface has been roughened in the surface-roughening step of the present invention well receives an anodic oxide film thereon. In other words, in the aluminum plate of the present invention, an anodic oxide film can be evenly formed on the aluminum plate through anodic oxidation.

In the fifth aspect of the invention, the aluminum plate is etched, in the etching step after the electrolysis, so that 0.01 to 5 $g/m^2$ of the surface of the aluminum plate is dissolved.

In the present aspect, the etching step after the electrolysis is so controlled that the fine hillocks and recesses of the surface of the aluminum plate formed in the electrolytic surface-roughening step may remain after the step in an appropriate manner. A planographic printing plate precursor which is less likely to cause blanket staining or serious ink stains on printed papers can be produced from the support for planographic printing plates obtained in the present aspect.

In the sixth aspect of the invention, the aluminum plate is etched, in the etching step prior to the pre-electrolytic surface-roughening step, 1 to 15 $g/m^2$ of the aluminum plate is dissolved.

To fabricate a planographic printing plate precursor, a plate layer is formed on the roughened surface of the support obtained in the production method of the present aspect. The advantage of the thus-fabricated printing plate precursor is that it is free from the problem of serious ink staining on printed matters and from the problem of blanket staining.

In the seventh aspect of the present invention, in the electrolytically surface-roughening step, an AC electrolytic cell having therein a counter electrode to impart an alternating current to the aluminum plate is used, and the alternating current to be applied thereto is so controlled that the quiescent time for which no current flows between the aluminum plate and the counter electrode falls between 0.001 and 0.6 second and that the pulse rise time, Tp, within which the current waveform rises up falls between 0.01 and 0.3 millisecond.

According to this aspect, uniform honeycomb pits are formed at the surface of the aluminum plate processed in the electrolytic surface-roughening step. That is, the support for planographic printing plates obtained in this production method is excellently good, as its surface is uniformly roughened.

When two or more electrolytic cells of the type are used for the electrolytic treatment, no current flows between the aluminum plate and the counter electrode in one electrolytic cell and also between the aluminum plate and the counter electrode in any of the other electrolytic cells while the aluminum plate having been processed in that one electrolytic cell is taken out of it and then introduced into the next one electrolytic cell adjacent to the first one cell. In this case, therefore, it is desirable that the electrolytic cells are so disposed that the time for which the aluminum plate is between the first one cell and the next one cell, not being put in both of them, falls 0.001 and 0.6 seconds.

In the eighth aspect of the invention, the production method includes a step of anodic oxidation to form an oxide film on the surface of the aluminum plate of which the surface has been roughened in the surface-roughening step.

In this aspect, the roughened surface of the aluminum plate is coated with a hard and dense oxide film formed through anodic oxidation. Therefore, the support produced in the production method realizes planographic printing plates of good durability.

In the ninth aspect of the invention, the anodic oxidation step includes a step of hydrophilicating the oxide film formed on the surface of the aluminum plate.

The advantage of the support for planographic printing plates produced according to the production method of this aspect is that the adhesiveness between the oxide film and the plate layer to be formed thereon is good.

In the tenth aspect of the invention, the anodic oxidation step includes a step of sealing micropores that exist in the oxide film formed on the surface of the aluminum plate.

In the support for planographic printing plates produced according to the production method of this aspect, the surface defects in the oxide film are significantly reduced. To fabricate a planographic printing plate precursor, a plate layer is formed on the roughened surface of the support, and the advantage of the thus-fabricated printing plate precursor is that it is free from the problem of serious ink staining on printed matters and from the problem of blanket staining.

In the eleventh aspect of the invention, the aluminum plate has an aluminum content falling between 95 and 99.4% by weight and a silicon content falling between 0.15 and 1% by weight.

In general, regenerated aluminum ingots contain much Si or much Mn.

The production method for planographic printing plate supports of this aspect is one embodiment of applying the invention to aluminum plates prepared from Si-rich regenerated aluminum ingots.

In the twelfth aspect of the invention, the aluminum plate has an aluminum content falling between 95 and 99.4% by weight and a manganese content falling between 0.1 and 1.5% by weight.

The production method for planographic printing plate supports of this aspect is one embodiment of applying the invention to aluminum plates prepared from Mn-rich regenerated aluminum ingots.

The thirteenth aspect of the invention is the support for planographic printing plates produced according to any one of the above-mentioned 1st to 12th aspects.

On the roughened surface of the support of this aspect, formed is a photosensitive or thermosensitive plate layer to fabricate a planographic printing plate precursor. The precursor is processed into a printing plate, and the resulting printing plate is free from the problem of serious ink stains on printed matters and from the problem of blanket staining.

The fourteenth aspect of the invention is a planographic printing plate precursor that comprises the support of the 13th aspect and a photosensitive or thermosensitive plate layer formed on the roughened surface of the support.

The advantage of the planographic printing plate precursor of this aspect is that it realizes a printing plate not causing serious ink stains on printed papers and not causing blanket staining.

The fifteenth aspect of the invention is a method for producing a support for planographic printing plates, which comprises a step of roughening at least one surface of an aluminum plate and in which the surface-roughening step includes an AC-electrolytic surface-roughening step of processing the aluminum plate in an aqueous nitric acid solution having a nitrate ion concentration and an aluminum ion concentration of from 5 to 15 g/liter each, and an ammonium ion concentration of from 10 to 300 ppm, and having a bath temperature falling between 50 and 80° C.

In this method, even when the aluminum plate to be processed is prepared from regenerated aluminum ingots such as those mentioned above, its surface can be well roughened through the AC electrolysis of which the condition is specifically defined herein. In the thus-roughened surface, micropores are densely dispersed, and honeycomb pits are uniformly formed to present a honeycomb-like appearance. To fabricate a planographic printing plate, a plate layer is formed on the roughened surface of the support, and the advantage of the thus-fabricated printing plate is that it is free from the problem of serious ink staining on printed matters and from the problem of blanket staining.

In the sixteenth aspect of the invention, the AC-electrolytic surface-roughening step is so controlled that the ratio of the quantity of electricity QA of the alternating current applied to the aluminum plate acting as an anode, to the quantity of electricity QC thereof applied to the aluminum plate acting as a cathode, QA/QC falls between 0.9 and 1, the current duty is 0.5 and the current frequency falls between 40 and 120 Hz.

In this aspect, the aluminum plate is processed to have more uniform honeycomb pits formed therein.

In the seventeenth aspect of the invention, the alternating current to be applied to the aluminum plate in the AC-electrolytic surface-roughening step is so controlled that the pulse rise time, Tp, within which the current waveform rises up falls between 0.01 and 0.3 millisecond, and the quiescent time for which no current flows through the aluminum plate falls between 0.001 and 0.6 second.

As having the advantage of uniform honeycomb pits formed in its roughened surface, the support produced in the production method of this aspect is especially favorable for planographic printing plates.

In the AC-electrolytic surface-roughening step in the eighteenth aspect of the invention, used is an AC electrolytic cell unit which comprises an electrolytic cell containing therein the aqueous nitric acid solution and enabling the aluminum plate to pass through it, a power source for applying an alternating current to the aluminum plate, and a counter electrode disposed inside the cell so as to face the aluminum plate while the plate is electrolytically processed therein, and in which an alternating current is applied between the aluminum plate and the counter electrode to thereby electrolytically roughen the surface of the aluminum plate, and the AC mode is so controlled that it includes at least once the quiescent time for which no alternating current flows between the aluminum plate and the counter electrode and that the quiescent time falls between 0.001 and 0.6 second/once.

When two or more electrolytic cells of the type are connected in series and used for the electrolytic treatment herein, they are preferably so disposed that the time, for which no current flows between the aluminum plate not in any cell and the counter electrode in any one cell while the aluminum plate having been led out of one cell does not as yet reach the next cell, is at longest 0.6 second.

As having the advantage of uniform honeycomb pits formed in its roughened surface, the support produced in the production method of this aspect is especially favorable for planographic printing plates.

In the nineteenth aspect of the invention, the surface-roughening step comprises a first etching step of contacting the aluminum plate with an aqueous alkali solution to etch it, the AC-electrolytic surface-roughening step of roughening the thus-etched surface of the aluminum plate, and a second etching step of further contacting the thus-roughened aluminum plate with an aqueous alkali solution to etch it, in that order.

In this aspect, the aluminum plate is etched before and after its surface is roughened in the AC-electrolytic surface-roughening step. A plate layer is formed on the roughened surface of the support to prepare a planographic printing plate precursor, and the advantage of the precursor is that the image reproducibility of the resulting planographic printing plate is excellent.

In the twentieth aspect of the invention, the aluminum plate is dissolved to a degree of from 1 to 15 $g/m^2$ in the first etching step, and is dissolved to a degree of from 0.01 to 5 $g/m^2$ in the second etching step.

A plate layer is formed on the roughened surface of the support produced in this aspect, to thereby prepare a planographic printing plate precursor. The advantage of the thus-prepared precursor is that the image reproducibility in processing the plate layer therein to complete a planographic printing plate is extremely good.

In the twenty-first aspect of the invention, the surface-roughening step includes a first desmutting step of contacting the aluminum plate with an aqueous acid solution between the first etching step and the AC-electrolytic surface-roughening step, and includes a second desmutting step of further contacting the aluminum plate with an aqueous acid solution after the second-etching step.

In this aspect, the aluminum plate is processed in the first desmutting step prior to the AC-electrolytic surface-roughening step, whereby the intermetallic compounds and a simple substance silicon having deposited on the surface of the aluminum plate are removed. Accordingly, in the next AC-electrolytic surface-roughening step that follows the first desmutting step, the aluminum plate is effectively prevented from being unevenly processed owing to the intermetallic compound and the simple substance silicon, and, as a result, the support for planographic printing plates produced in this aspect has especially uniform honeycomb pits formed on its surface.

In addition, in this aspect, the aluminum plate is, after subjected to the second etching treatment, again desmutted in the second desmutting step, whereby the intermetallic compounds and the simple substance silicone not removed in the first desmutting step and still remaining on the surface of the aluminum plate are completely removed.

Therefore, when a plate layer is formed on the roughened surface of the support produced in this aspect, the resulting planographic printing plate precursor realizes a good printing plate not causing serious ink staining on printed matters and not causing blanket staining.

In the twenty-second aspect of the invention, the surface-roughening step includes a step of mechanically roughening at least one surface of the aluminum plate, prior to the first etching step.

Concretely, in the method of this aspect for producing a support for planographic printing plates, the aluminum plate to be the support is first processed in the mechanical surface-roughening step, then in the first etching step, then in the AC-electrolytic surface-roughening step, and then in the second etching step in that order. Accordingly, the support thus produced in the production method ensures good water-ink balance of planographic printing plates comprising it.

In the twenty-third aspect of the invention, the aluminum plate of which at least one surface has been roughened in the surface-roughening step is subjected to anodic oxidation to thereby form an oxide film on its roughened surface.

The oxide film thus formed on the roughened surface of the aluminum plate is dense and hard. Therefore, the advantage of the support for planographic printing plates produced in the production method of this aspect is that the durability of the roughened surface of the aluminum plate for the support is good.

In the twenty-fourth aspect of the invention, the surface of the aluminum plate having the oxide film formed thereon is made hydrophilic.

The advantage of the support for planographic printing plates produced in the production method of this aspect is that the adhesiveness between the oxide film formed on the roughened surface of the aluminum plate for the support and a plate layer to be formed on the oxide film is good.

In the twenty-fifth aspect of the invention, the anodic oxidation step includes a step of sealing micropores that exist in the oxide film formed on the surface of the aluminum plate.

In the support for planographic printing plates produced according to the production method of this aspect, the surface defects in the oxide film are significantly reduced. To fabricate a planographic printing plate, a plate layer is formed on the roughened surface of the support, and the advantage of the thus-fabricated printing plate is that it is free from the problem of serious ink staining on printed matters and from the problem of blanket staining.

In the twenty-sixth aspect of the invention, the aluminum plate has an aluminum content falling between 95 and 99.4% by weight and a silicon content falling between 0.15 and 1% by weight.

In general, regenerated aluminum ingots contain much Si or much Mn.

The production method for planographic printing plate supports of this aspect is one embodiment of applying the invention to aluminum plates prepared from Si-rich regenerated aluminum ingots.

In the twenty-seventh aspect of the invention, the aluminum plate has an aluminum content falling between 95 and 99.4% by weight and a manganese content falling between 0.1 and 1.5% by weight.

The production method for planographic printing plate supports of this aspect is one embodiment of applying the invention to aluminum plates prepared from Mn-rich regenerated aluminum ingots.

The twenty-eighth aspect of the invention is the support for planographic printing plates produced in the production method of any one of the 15th to 27th aspects mentioned hereinabove.

The twenty-ninth aspect of the invention is a planographic printing plate precursor fabricated by forming a photosensitive or thermosensitive plate layer on the roughened surface of the support of the 28th aspect as above.

The advantage of the planographic printing plate precursor of this aspect, which is fabricated by forming a photosensitive or thermosensitive plate layer on the roughened surface of the support of the 28th aspect as above, is that it realizes a printing plate not causing serious ink stains on printed papers and not causing blanket staining.

The thirtieth aspect of the invention is a method for producing a support for planographic printing plates, which comprises a surface-roughening step of electrolytically roughening an aluminum alloy plate in an acid solution with an alternating current applied thereto, and a step of processing the plate for anodic oxidation, and in which the electrolytic surface-roughening step includes a step of using an AC waveform that takes a pulse rise time falling between 1.5 and 6 milliseconds before it rises from its base (0) to its peak.

In the thirty-first aspect of the invention, the aluminum purity of the aluminum alloy plate falls between 95 and 99.4% by weight.

In the thirty-second aspect of the invention, the aluminum alloy plate contains at least five metals of the following:

Fe: from 0.3 to 1.0% by weight,
Si: from 0.15 to 1.0% by weight,
Cu: from 0.1 to 1.0% by weight,
Mg: from 0.1 to 1.5% by weight,
Mn: from 0.1 to 1.5% by weight,
Zn: from 0.1 to 0.5% by weight,
Cr: from 0.01 to 0.1% by weight, and
Ti: from 0.03 to 0.5% by weight.

In the thirty-third aspect of the invention, the production method of the 30th aspect includes the following steps, before and/or the electrolytic surface-roughening step:

(1) an alkali-etching step of processing the aluminum alloy plate in an aqueous alkali solution to etch it to a degree falling between 1 and 15 g/m$^2$;
(2) a desmutting step of desmutting the alkali-etched aluminum alloy plate in an acid solution.

In the thirty-fourth aspect of the invention, the alkali-etched aluminum alloy plate is desmutted as in the 33rd aspect, by processing it in an acid solution having an acid concentration of from 250 to 500 g/liter and an aluminum ion concentration of from 1 to 15 g/liter, at 60 to 90° C. for 1 to 180 seconds.

In the thirty-fifth aspect of the invention, the aluminum alloy plate is mechanically roughened on its surface, before it is processed in the alkali-etching step as in the 33rd aspect.

In the thirty-sixth aspect of the invention, the aluminum alloy plate is, after processed for anodic oxidation as in the 30th aspect, further processed for surface pore sealing and/or for surface hydrophilication.

In the thirty-seventh aspect of the invention, the surface of the aluminum alloy plate is activated before it is electrolytically roughened as in the 30th aspect.

The thirty-eighth aspect of the invention is the support for planographic printing plates produced according to the production method of any of the above-mentioned 30th to 38th aspects.

The thirty-ninth aspect of the invention is a planographic printing plate precursor, which is fabricated by forming an undercoat layer having a dry weight of from 0.001 to 1 g/m$^2$, a positive or negative photosensitive layer having a dry weight of from 1 to 3 g/m$^2$, and a mat layer having a dry weight of from 0.001 to 1 g/m$^2$, in that order on the surface of the support of the 38th aspect as above.

In the fortieth aspect of the invention, the planographic printing plate precursor of the 39th aspect has a surface roughness (Ra) falling between 0.3 and 0.6 $\mu$m, a value L* falling between 50 and 95, and a delta Eab* of at most 2.

The forty-first aspect of the invention is an aluminum plate for planographic printing plate supports, which has an aluminum content of from 95 to 99.4% by weight and is produced in a rolling process, and which, when measured in point of the number of the strains at its machine-direction (MD) edges and of the height of the strains according to a process comprising the following steps (a) to (d):

(a) cutting the aluminum plate in the direction nearly perpendicular to the machine direction thereof,
(b) putting the thus-cut aluminum piece on the flat or curved, sample-receiving face of a sample stand,
(c) pressing it against the sample-receiving face of the stand so that the center part of the aluminum piece around the center line thereof that runs in the machine direction is firmly stuck to the sample-receiving face of the stand throughout the overall length of the aluminum piece in the machine direction, and
(d) measuring the aluminum piece thus on the stand, in point of the number of the waved edge strains per the unit length of each edge and of the height of each edge strain, satisfies the conditions that the number of the MD edge strains thereof is at most 3.334 per meter of each edge, the maximum height of the edge strains is at most 2 mm, and the total height of all the edge strains is at most 2.666 mm.

For the aluminum plate, usable are those prepared by hot and/or cold rolling aluminum alloys that are produced by adding mother alloys and/or pure metal additives to virgin ingots such as those mentioned hereinabove, or those prepared by hot and/or cold rolling cast slabs of such virgin ingots. For it, however, preferred are aluminum plates prepared by hot and/or cold rolling cast slabs of recycled aluminum, scrapped aluminum and regenerated ingots such as those mentioned hereinabove, as well as aluminum plates prepared by hot and/or cold rolling cast slabs of such recycled aluminum, scrapped aluminum and regenerated ingots additionally containing scrapped aluminum of planographic printing plates.

The aluminum plate for planographic printing plate supports in this aspect is continuously processed for surface roughening, anodic oxidation, plate layer formation, cutting and slitting to fabricate planographic printing plate precursors, and the process is free from plate feed disorder such as plate meandering or entangling. In addition, when the planographic printing plate precursors thus prepared by processing the aluminum plate are further processed into printing plates, they do not meander or entangle in the processing units and in the developing units. Moreover, when the printing plate is set around the blanket in a planographic offset printer, it does not lift up from the surface of the blanket.

Another advantage of the aluminum plate for planographic printing plate supports is that the cost of its materials can be reduced since it can be produced from recycled aluminum, scrapped aluminum and regenerated ingots.

In the forty-second aspect of the invention, the aluminum plate for planographic printing plate supports of the 41st aspect is so profiled that its center part is thick and the area around its edges is thin, and its cross section is so controlled that the value a and the value pc defined by the following equations are at most 1% and at most 2%, respectively:

$$a=h/c,$$

$$pc=c/t_{max},$$

wherein $h=t_{min}-t_{edge}$; $c=t_{max}-t_{min}$; $t_{max}$=the maximum thickness of the center part of the aluminum web; $t_{min}$=the minimum thickness of the aluminum web; $t_{edge}$=the thickness of the edges of the aluminum web.

The aluminum plate for planographic printing plate supports of this aspect is so controlled that its center part is thick and the area around its edges is thin. Therefore, when wound up in coils, its edges are prevented from being roughly contacted with each other to be deformed. In addition, it is so controlled that the thickness of the center part of the aluminum plate is not so large and the thickness of the area around the edges thereof is not so small, as compared with the mean thickness of the plate in the direction of the width thereof. Therefore, when wound up in coils, the aluminum plate is not unfavorably deformed.

In the forty-third aspect of the invention, the silicon content of the aluminum plate for planographic printing plate supports falls between 0.15 and 1% by weight.

In general, recycled aluminum, scrapped aluminum and regenerated ingots contain much silicon or much manganese. The aluminum plate for planographic printing plate supports of this aspect is one embodiment of aluminum plates prepared from those containing much silicon.

In the forty-fourth aspect of the invention, the manganese content of the aluminum plate for planographic printing plate supports falls between 0.1 and 1.5% by weight.

The aluminum plate for planographic printing plate supports of this aspect is one embodiment of aluminum plates prepared from recycled aluminum, scrapped aluminum and regenerated ingots containing much manganese.

In the forty-fifth aspect of the invention, the aluminum plate for planographic printing plate supports is so defined that the degree of its bending in the machine direction is at most 0.3 mm/4 m.

In the forty-sixth aspect of the invention, the aluminum plate for planographic printing plate supports is so defined that the height of the burrs at its edges is at most 10 $\mu$m.

The forty-seventh aspect of the invention is a support for planographic printing plates, which is produced by roughening at least one surface of the aluminum plate for planographic printing plate supports of any one of the 41st to 46th aspects.

In the forty-eighth aspect of the invention, the aluminum plate for planographic printing plate supports, of which the surface has been roughened as in the 47th aspect, is subjected to anodic oxidation to thereby form an oxide film on its roughened surface.

The forty-ninth aspect of the invention is a method for inspecting aluminum plates for planographic printing plate supports, which comprises;

(a) a step of cutting a rolled aluminum plate in the direction nearly perpendicular to the machine direction thereof,
(b) a step of putting the thus-cut aluminum piece on the flat or curved, sample-receiving face of a sample stand,
(c) a step of pressing it against the sample-receiving face of the stand so that the center part of the aluminum piece around the center line thereof that runs in the machine direction is firmly stuck to the sample-receiving face of the stand throughout the overall length of the aluminum piece in the machine direction, and
(d) a step of measuring the aluminum piece thus on the stand, in point of the number of the waved edge strains per the unit length of each edge and of the height of each edge strain.

The rolled aluminum plate is generally wound up in coils in the machine direction thereof. Therefore, when its coils are uncoiled, the uncoiled plate is often still curved or curled in the machine direction as it is habituated to winding up in coils.

However, according to the method of this aspect for inspecting aluminum plates for planographic printing plate supports, the aluminum plate to be inspected is pressed against a sample stand in the overall length in the machine direction thereof as in the above, and the center part of the aluminum plate is kept firmly contacted with the sample-receiving face of the stand in the overall length of the aluminum plate. Therefore, the edge strains, if any, of the aluminum plate thus inspected will lift up from the sample-receiving face of the stand.

Specifically, according to the inspection method of this feature, uncoiled aluminum plates can be checked for the presence or absence of their edge strains while they are completely free from their habit to curl. Therefore, in the method, there should be no misunderstanding about the differentiation of the waved edge strains of uncoiled aluminum plates that are derived the habit of the uncoiled aluminum plates to curve, from the original edge strains that are intrinsic to the aluminum plates.

The sample stand usable in the inspection method may have a flat face to receive a sample thereon. For example, the sample stand of the type includes level tables made of cast matters such as cast iron, and glass level tables having a sample-receiving face of glass.

Apart from these, also usable herein are sample stands of which the sample-receiving face is columnar or curved. One example of the sample stands of the type is a blanket for planographic offset printers.

For pressing the aluminum plate against the sample-receiving face of the stand, for example, employable is a method of putting a weight that is longer than the overall length of the aluminum plate in the machine direction thereof, on the top face of the aluminum plate. This will be described hereinunder. Apart from the method, an operator may press the aluminum plate against the stand by hand.

The height of the edge strains of the aluminum plate may be measured, for example, by inserting a taper gauge into the space between the strained edge of the aluminum plate and the sample-receiving face of the sample stand on which it carries the aluminum plate, and reading the level of the taper gauge that indicates the height of the edge strain from the sample-receiving face of the stand, as will be described in the embodiments of the invention given hereinunder.

Apart from the method, also employable is a method of taking a picture of the aluminum plate that is on the sample-receiving face of the sample stand under pressure, by the use of an ordinary camera or a digital camera, and measuring the height of the edge strains of the aluminum plate on the picture.

In the fifties feature of the invention, the sample stand is a level table of which the sample-receiving face is flat.

The flat sample-receiving face of the level table is finished with high accuracy. Therefore, according to the inspection method of this feature, the edge strains of the aluminum plate inspected can be detected accurately.

In the fifty-first feature of the invention, one or more weights are put in the center part of the sample set on the sample-receiving face of the sample stand, covering the overall length of the sample in the machine direction thereof, and the sample is firmly pressed against the sample-receiving face of the stand by those weights.

According to the inspection method of this feature, the aluminum plate to be checked for the presence or absence of edge strains and for the height of edge strains, if any, can be surely pressed against the stand in the overall length in the machine direction thereof.

In the fifty-second feature of the invention, the sample to be inspected is set on the sample stand in such a manner that the outer side edge of the weight put on the sample is inside the adjacent side edge of the sample by 0.1 w to 0.3 w, with w indicating the width of the sample.

According to the inspection method of this feature, the center part of the aluminum plate can be surely firmly held on the sample-receiving face of the sample stand, and, when the aluminum plate has edge strains, its edge strains are prevented from being pressed against the sample stand and are therefore surely detected and measured.

DESCRIPTION OF THE PREFERRED EMBODIMENTS

Figure 1:
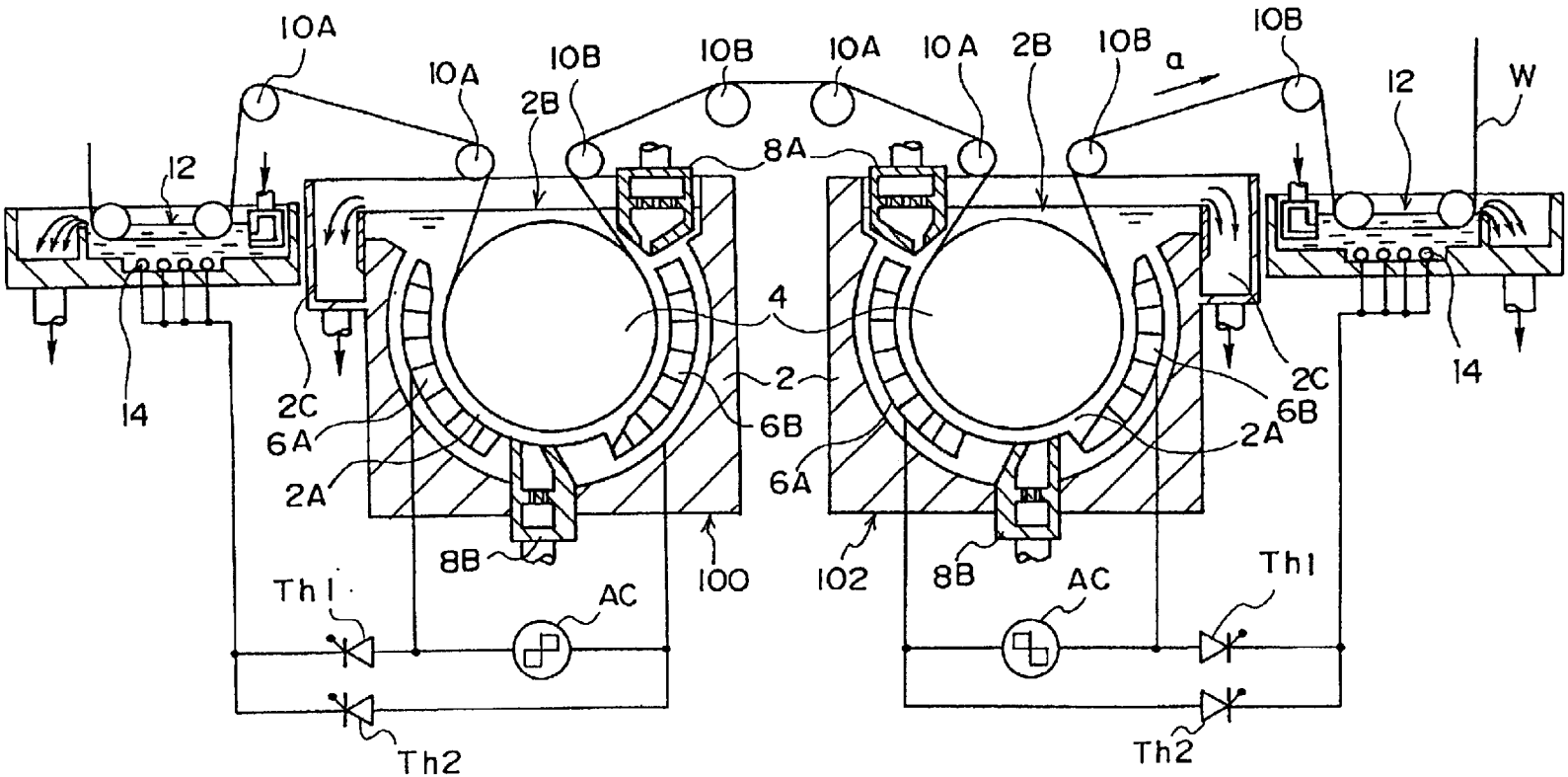
FIG. 1 is a cross-sectional view showing one example of a radial AC electrolytic cell unit to be used in the pre-electrolytic surface-roughening step and in the electrolytic surface-roughening step in the first embodiment of the method of the invention for producing a support for planographic printing plates.

First Embodiment:

1. Aluminum Plate:

The aluminum plate to be processed in this embodiment includes conventional, rolled aluminum plates for planographic printing plate supports, as well as sheets or plates of aluminum ingots regenerated from scrapped aluminum, recycled aluminum, etc.

The rolled aluminum plates include, for example, those of pure aluminum matters such as JIS A-1050, JIS A-1100, and those of aluminum alloys such as JIS A-3003, JIS A-3103, JIS A-5005.

As so mentioned hereinabove, the regenerated aluminum ingots for use herein may contain various elements of, for example, Fe, Si, Cu, Mg, Mn, Zn, Cr and Ti, but preferably have an aluminum content falling between 99.4 and 95% by weight. Some regenerated aluminum ingots are available on the market, one of which is JIS A-3104.

The Fe content of the aluminum plate preferably falls between 0.3 and 1.0% by weight. Even virgin aluminum plates contain from about 0.1 to 0.2% by weight of Fe, and the element Fe dissolves only a little in aluminum to form a solid solution therein, mostly forming intermetallic compounds therein. The aluminum plate of which the Fe content falls within the defined range is preferred, as it is hardly cracked while rolled and is inexpensive. More preferably, the Fe content of the aluminum plate falls between 0.5 and 1.0% by weight.

The Si content of the aluminum plate preferably falls between 0.15 and 1.0% by weight. Si is rich in scraps of JIS 2000, 4000 and 6000 aluminum matters. Virgin aluminum ingots contain from about 0.03 to 0.1% by weight of Si. In those, Si dissolves in aluminum to form a solid solution therein, or forms intermetallic compounds therein. When aluminum ingots that contains excess Si are heated, the solid solution of Si therein will often give a simple substance precipitate of Si. It is known that both the simple substance Si and the intermetallic compounds of FeSi, if any in supports of planographic printing plates, have negative influences on the printing plates to cause serious ink staining on printed matters. However, if the Si content of the aluminum plate falls within the defined range and even if the intermetallic compounds and the simple substance Si in the plate deposit on the surface of the plate, the deposits may be fully removed through treatment with sulfuric acid (in a desmutting step) that will be described hereinunder. Therefore, Si that satisfies the condition does not cause the problem of serious ink staining on printed matters, and the presence of Si in the aluminum plate in that condition is rather desirable in view of the production costs of the plate. More preferably, the Si content falls between 0.3 and 1.0% by weight.

The Cu content of the aluminum plate preferably falls between 0.1 and 1.0% by weight. Cu is rich in scraps of JIS 2000 and 4000 aluminum matters, and it dissolves relatively easily in aluminum to form a solid solution therein. If its content falls within the defined range, Cu having deposited on the surface of the aluminum plate could be fully removed through the desmutting treatment, and the presence of Cu in the aluminum plate in that condition is desirable in view of the production costs of the plate. More preferably, the Cu content falls between 0.3 and 1.0% by weight.

The Mg content of the aluminum plate preferably falls between 0.1 and 1.5% by weight. Mg is rich in scraps of JIS 2000, 3000, 5000 and 7000 aluminum matters. In particular, much Mg is in can-end matters of such scraps. Mg is therefore one principal element of impurity metals in aluminum scraps. Mg also dissolves relatively readily in aluminum to form a solid solution therein, and forms intermetallic compounds with Si. However, so far as the Mg content of the aluminum plate falls within the defined range, the intermetallic compounds of Mg could be readily removed through the desmutting treatment. Therefore, even when the aluminum plate for use herein is prepared by rolling scrapped aluminum or regenerated aluminum ingots, it realizes planographic printing plate precursors that are comparable to those in which the support is made of an aluminum plate prepared from virgin matters. More preferably, the Mg content falls between 0.5 and 1.5% by weight, even more preferably between 1.0 and 1.5% by weight.

The Mn content of the aluminum plate preferably falls between 0.1 and 1.5% by weight. Mn is rich in scraps of JIS 3000 aluminum matters. In particular, much Mn is in can-end matters of such scraps. Mn is therefore one principal element of impurity metals in aluminum scraps. Mg also dissolves relatively readily in aluminum to form a solid solution therein, and forms intermetallic compounds with AlFeSi. The Mn content falling within the defined range is desirable for the same reasons as those mentioned hereinabove for the Si content and the Mg content. More preferably, the Mn content falls between 0.5 and 1.5% by weight, even more preferably between 1.0 and 1.5% by weight.

The Zn content of the aluminum plate preferably falls between 0.1 and 0.5% by weight. Zn is rich especially in scraps of JIS 7000 aluminum matters, and it readily dissolves in aluminum to form a solid solution therein. So far as its content falls within the range, Zn could be readily removed through the desmutting treatment. The aluminum plate containing Zn in that range is preferred for use herein, as it is inexpensive and realizes planographic printing plate precursors that are comparable to those in which the support is made of an aluminum plate prepared from virgin matters. More preferably, the Zn content falls between 0.3 and 0.5% by weight.

The Cr content of the aluminum plate preferably falls between 0.01 and 0.1% by weight. Cr is an impurity metal often existing in scraps of JIS 5000, 6000 and 7000 aluminum matters, but its content is small. So far as its content falls within the range, Cr could be fully removed through the desmutting treatment, and therefore does not cause the problem of serious ink staining on printed matters. In addition, the presence of such Cr is desirable in view of the costs of the aluminum plates. More preferably, the Cr content falls between 0.05 and 0.1% by weight.

The Ti content of the aluminum plate falls between 0.03 and 0.5% by weight. Ordinary aluminum plates contain from 0.01 to 0.04% by weight of Ti that serves as a crystal-fining agent. The impurity metal Ti is relatively rich in scraps of JIS 5000, 6000 and 7000 aluminum matters. The Ti content falling within the defined range is desirable for the same reasons as those mentioned hereinabove for the Cr content and the Zn content. More preferably, the Ti content falls between 0.05 and 0.5% by weight.

The aluminum plate for use in this embodiment is produced, for example, by suitably rolling and heating cast slabs that are prepared by casting aluminum matters, scrapped aluminum or regenerated aluminum ingots such as those mentioned hereinabove in any ordinary manner, into rolled plates having a thickness of from 0.1 to 0.7 mm, optionally followed by leveling them.

For producing the aluminum plate in the manner as above, for example, employable is any of a DC casting method, a modified DC casting method in which at least one of soaking and annealing is omitted, or a continuous casting method.

The aluminum plate may be in any web form of long sheets or plates, or may be in any other form of cut leaves of which the size corresponds to that of final products, planographic printing plate precursors. The thickness of the webs and the cut leaves generally falls between 0.1 and 1 mm or so, preferably between 0.2 and 0.5 mm.

2. Surface-Roughening Treatment:

The method of this embodiment for producing a support for planographic printing plates may comprise only a surface-roughening step of roughening the surface of the aluminum plate, or may comprise, in addition to the surface-roughening step, an anodic oxidation step of oxidizing the roughened surface of the aluminum plate.

As so mentioned hereinabove, the surface-roughening step includes the following:

(1) a pre-electrolytic surface-roughening step (step (1));
(2) an alkali-etching step (step (2));
(3) a desmutting step with sulfuric acid (step (3));
(4) an electrolytic surface-roughening step (step (4)).

Prior to the steps (1) to (4), the surface-roughening step may further include any one of an etching step, prior to the surface-roughening electrolysis, of contacting the aluminum plate with an alkali solution to etch the plate and a mechanical step of mechanically roughening the surface of the aluminum plate, or both of them.

After the steps (1) to (4), the surface-roughening step may also include an etching step of further etching the electrolytically-roughened aluminum plate with an alkali solution, and a final desmutting step of further desmutting the aluminum plate after the second etching process.

The surface-roughening step may include all the mechanically surface-roughening step, the electrolytic surface-roughening step prior to the electrolysis, the steps (1) to (4), the etching step after the electrolysis, and the final desmutting step.

The steps (1) to (4) for the surface-roughening treatment are described in detail hereinunder.

(2-1) Pre-electrolytic Surface-Roughening Step:

In the pre-electrolytic surface-roughening step, an aluminum plate such as that mentioned above is processed in an aqueous hydrochloric acid solution to roughen its surface with an alternating or direct current applied thereto.

The hydrochloric acid concentration of the acid solution preferably falls between 1 and 20 g/liter. The acid solution may contain at least one chloride selected from aluminum chloride, sodium chloride and ammonium chloride. The chloride content of the solution preferably falls between 1 g/liter and the chloride saturation/liter. In addition, the acid solution may further contain any of Fe, Si, Cu, Mg, Mn, Zn, Cr and Ti ions.

Most preferably, the acid solution is prepared by adding aluminum chloride and ammonium chloride to diluted hydrochloric acid so that the acid concentration of the solution may fall between 5 and 15 g/liter, the aluminum ion concentration thereof may fall between 5 and 15 g/liter and the ammonium ion concentration thereof may fall between 10 and 300 ppm.

The temperature of the solution preferably falls between 10 and 95° C., most preferably between 30 and 50° C.

In the pre-electrolytic surface-roughening step, a direct current may be applied to the aluminum plate, but an alternating current is preferred to it. The alternating current may have any waveform of sine waves, rectangular waves, triangular waves, trapezoidal waves. Of those, preferred are a rectangular AC having a rectangular waveform, and a trapezoidal AC having a trapezoidal waveform. In the pre-electrolytic surface-roughening step, a combined current of an alternating current and a direct current may be applied to the aluminum plate.

The frequency of the alternating current preferably falls between 40 and 120 Hz, from the viewpoint of the cost for constructing the power source unit.

Also preferably, the ratio of the quantity of electricity QA of the alternating current applied to the aluminum plate acting as an anode, to the quantity of electricity QC thereof applied to the aluminum plate acting as a cathode, QC/QA falls between 0.9 and 1, as the aluminum plate is processed to have uniform honeycomb pits formed therein. More preferably, the ratio QC/QA falls between 0.95 and 0.99. In case where the electrolytic surface-roughening treatment is effected in an AC-electrolytic cell having therein auxiliary electrodes that are for dividing the anode current to the main electrode, the ratio QC/QA can be controlled to fall within the defined range by controlling the anode current to be divided toward the auxiliary electrodes, for example, as in JP-A 43500/1985 and 52098/1989.

The AC duty in the electrolytic surface-roughening treatment is most preferably 0.5, since the aluminum plate can be uniformly roughened in that condition and since the power source unit is easy to construct. The AC duty referred to in this embodiment is indicated by ta/T in which T is the AC current period and ta is the time for anodic reaction of the aluminum plate (anodic reaction time).

Through its cathodic reaction, the surface of the aluminum plate receives an oxide film of essentially aluminum hydroxide formed thereon, and the oxide film will be dissolved or broken. The dissolved or broken part of the oxide film may be the start point for the pitting reaction in the next-stage anodic reaction of the aluminum plate. Accordingly, the appropriate selection of the AC duty in this treatment is especially important for uniformly roughening the surface of the aluminum plate.

In case where the alternating current applied to the aluminum plate is a trapezoidal one, the time, tp, for which the AC value reaches from 0 to the plus or minus peak preferably falls between 0.01 and 2 milliseconds, more preferably between 0.01 and 0.3 millisecond. With the time tp falling within the defined range, more uniform honeycomb pits are formed in the processed surface of the aluminum plate.

On the other hand, the peak current Iap in the anode cycle of the alternating current and the peak current Icp in the cathode cycle thereof may be so defined that the total quantity of electricity for the anodic reaction of the aluminum plate from the start to the finish of the electrolytic surface-roughening treatment falls between 1 and 300 coulombs/$cm^2$. Preferably, however, they are from 10 and 200 A/$dm^2$ each. Also preferably, Icp/Iap falls between 0.9 and 1.5.

For the electrolytic surface-roughening treatment, the AC mode is preferably so controlled that it includes at least once the quiescent time for which no alternating current flows between the aluminum plate and the counter electrode and that the quiescent time falls between 0.001 and 0.6 second/once. In the defined condition, uniform honeycomb pits are formed throughout the processed surface of the aluminum plate. When two or more AC electrolytic cells are connected in series and used for the electrolytic surface-roughening treatment herein, they are preferably so disposed that the time, for which no current flows through the aluminum plate not in any cell while the aluminum plate having been led out of one cell does not as yet reach the next cell, falls between 0.001 and 0.6 second.

For the electrolytic surface-roughening treatment, usable are various types of AC-electrolytic cells, for example, vertical AC-electrolytic cells, flat AC-electrolytic cells as in JP-B 30036/1986, and radial AC-electrolytic cells as in JP-A 300843/1996; but preferred are radial AC-electrolytic cells.

Also preferred is an AC-electrolytic surface-roughening device comprising two radial AC-electrolytic cells connected in series, in which the upstream cell is for the former-stage AC electrolysis and the downstream cell is for the latter-stage AC electrolysis.

One example of the AC-electrolytic surface-roughening device is shown in FIG. 1.

As in FIG. 1, the AC-electrolytic surface-roughening device comprises a former-stage AC-electrolytic unit 100 positioned in the upstream site and a latter-stage AC-electrolytic unit 102 positioned in the downstream site.

Both the AC-electrolytic units 100 and 102 are composed of a cell body 2 having therein an electrolytic cell 2A filled with an aqueous hydrochloric acid solution; and a feed roller 4 which is inside the cell 2A to be rotatable around its axis extending in the horizontal direction, and which is to feed a long and thin web strip of an aluminum plate W in the direction of the arrow a, or that is, in the direction of from the left side to the right side in FIG. 1.

The inner all of the cell 2A is nearly cylindrically formed to surround the feed roller 4, on which are provided semi-cylindrical counter electrodes 6A and 6B in such a manner that they sandwich the feed roller 4 therebetween. The counter electrodes 6A and 6B each are divided into plural electrodes that are spaced from each other via an insulating spacer disposed between the adjacent ones. The electrodes may be made of, for example, graphite or metal, and the spacer may be made of, for example, a polyvinyl chloride resin. The thickness of each spacer preferably falls between 1 and 10 mm. Though not shown in FIG. 1, all those spaced electrodes of both the counter electrodes 6A and 6B are connected with the alternating current source, AC.

At its top, the cell 2A is opened to have a mouth 2B through which the aluminum plate W to be subjected to the AC-electrolytic surface-roughening treatment is led in and out of the cell 2A. Near the mouth 2B of the cell 2A and between the counter electrodes 6A and 6B, provided are an acidic electrolytic solution supply ducts 8A and 8B through which an acidic electrolytic solution, an aqueous nitric acid solution in this case, is replenished into the cell 2A.

Near the mouth 2B and above the cell 2A, disposed are upstream guide rollers 10A for guiding the aluminum plate W into the cell 2A, and downstream guide rollers 10B for guiding the aluminum plate W that has been electrolyzed in the cell 2A, outside the cell 2A.

In both the AC-electrolytic cell units 100 and 102, the cell body 2 is connected with an overflow cell 2C adjacent thereto. The overflow cell 2C acts to once pool therein the aqueous nitric acid solution having overflowed out of the cell 2A to thereby keep the intended constant liquid level of the aqueous nitric acid solution in the cell 2A. The overflow cell 2C is disposed upstream the cell 2A in the cell unit 100, and downstream the cell 2A in the cell unit 102.

The cell units 100 and 102 each are equipped with an auxiliary electrolytic cell 12 adjacent to the cell body 2. The auxiliary cell 12 is disposed upstream the cell body 2 in the cell unit 100, and downstream the cell body 2 in the cell unit 102.

The auxiliary cell 12 is shallower than the cell 2A, and its bottom 12A is flat. On the bottom 12A, provided are a plurality of columnar auxiliary electrodes 14.

The auxiliary electrodes 14 are preferably made of non-corrosive metal such as platinum or ferrite, and they may be tabular.

The auxiliary electrodes 14 are connected in parallel to the main electrode 6B on the side of the power source AC on which the main electrode is connected to AC, and a thyristor Th1 is so connected to them in the midway of the current from the power source AC that the current flows from that side toward the auxiliary electrodes 14 while the unit is put on.

Also on the side of the power source AC on which the main electrode 6A is connected to AC, the auxiliary electrodes 14 are connected in the same manner as above via a thyristor Th2 therebetween. Concretely, the thyristor Th2 is so connected that current from AC flows from that side toward the auxiliary electrodes 14 while the unit is put on.

Anytime when any of the thyristors Th1 and Th2 is put on, an anodic current flows through the auxiliary electrodes 14. Accordingly, the anodic current value to pass through the auxiliary electrodes 14 can be controlled through phase control of the thyristors Th1 and Th2, whereby the ratio QC/QA can be controlled in the desired manner.

The mechanism of the AC-electrolytic surface-roughening device of FIG. 1 is described below.

On the left side in FIG. 1, the aluminum plate W guided to the AC-electrolytic cell unit 100 is first led into the auxiliary electrolytic cell 12, and then into the electrolytic cell 2A by the upstream guide rollers 10A. Then, this is led from the left side to the right side in FIG. 1, by the feed roller 4, and then led out of the cell 2A by the downstream guide rollers 10B.

The aluminum plate W thus led out of the cell 2A in the cell unit 100 is then led into the cell 2A in the cell unit 102 by the upstream guide rollers 10A, while being led from the left side toward the right side in the cell 2A by the feed roller 4, and finally led into the auxiliary cell 12 adjacent to the cell unit 102, by the downstream guide rollers 10B.

In the cells 2A and the auxiliary cells 12 in the two AC-electrolytic cells 100 and 102, the aluminum plate W is roughened on its surface that faces the counter electrodes 6A and 6B, by the alternating current applied to the counter electrodes 6A and 6B and the anodic current applied to the auxiliary electrodes 14.

(2—2) Alkali-Etching Step:

In the alkali-etching step, the surface of the aluminum plate that has been roughened in the previous pre-electrolytic surface-roughening step is contacted with an alkali agent to etch it.

For contacting the aluminum plate with an alkali agent, for example, employable is a method of continuously passing the aluminum plate through a tank filled with an alkali agent; a method of dipping it in the tank; or a method of spraying an alkali agent onto the surface of the aluminum plate.

For the alkali agent, for example, used is a solution of an alkali hydroxide or an alkali metal salt. The alkali hydroxide or alkali metal salt concentration of the solution preferably falls between 0.01 and 30% by weight; and the temperature thereof preferably falls between 20 and 90° C.

The alkali hydroxide includes, for example, sodium hydroxide and potassium hydroxide.

The alkali metal salt includes, for example, alkali metal silicates such as sodium metasilicate, sodium silicate, potassium metasilicate and potassium silicate; alkali metal carbonates such as sodium carbonate and potassium carbonate; alkali metal aluminates such as sodium aluminate and potassium aluminate; alkali metal aldonates such as sodium gluconate and potassium gluconate; and alkali metal hydrogenphosphates such as potassium secondary phosphate, sodium tertiary phosphate and potassium tertiary phosphate. For the alkali agent, especially preferred are a solution of an alkali hydroxide solution and a solution of an alkali hydroxide and an alkali metal aluminate such as those mentioned above, as their etching power is high and they are inexpensive.

Preferably, the degree of etching the aluminum plate falls between 0.01 and 1 g/m$^2$. The etching time preferably falls between 1 and 180 seconds. So far as the degree of etching and the etching time both fall within the defined ranges, the fine hillocks to be formed on the surface of the aluminum plate through mechanical surface-roughening treatment may still remain to a desired degree as they are. Therefore, the thus-processed aluminum plate can be a support that realizes good planographic printing plates having high water retentiveness in the non-image area and capable of protecting the non-image area from receiving ink to cause an appearance problem such as blanket staining. That is, with the aluminum plate serving as a support, the planographic printing plate precursors can be well processed into planographic printing plates.

The etching treatment may be effected in any ordinary etching cell for aluminum plates. The etching cell may be for any of batch or continuous processes. In place of using such an etching cell, also usable herein is an ordinary spraying unit for spraying an alkali agent on aluminum plates.

(2-3) Desmutting Step With Sulfuric Acid:

In the desmutting step with sulfuric acid, the etched aluminum plate is contacted with an aqueous sulfuric acid solution having an acid concentration of from 250 to 500 g/liter and an aluminum ion concentration of from 1 to 15 g/liter and having a liquid temperature of from 60 to 90° C., for 1 to 180 seconds, to thereby dissolve and remove the black powdery smut having been formed on the surface of the aluminum plate. The smut consists essentially of oxides and hydroxides of impurity elements such as Fe.

For contacting the aluminum plate with such an aqueous sulfuric acid solution, for example, employable is a method of continuously passing the aluminum plate in a tank filled with the acid solution; a method of dipping it in the tank; or a method of spraying the acid solution onto the surface of the aluminum plate.

The aqueous sulfuric acid solution may contain, any other acid component such as phosphoric acid, hydrochloric acid, nitric acid and chromic acid, in addition to sulfuric acid.

The time for the desmutting treatment may fall between 1 and 180 seconds, but preferably between 50 and 120 seconds.

(2-4) Electrolytic Surface-Roughening Step:

As so mentioned hereinabove, the desmutted surface of the aluminum plate is electrolytically roughened in an aqueous nitric acid solution with an alternating current applied thereto.

The aqueous nitric acid solution to be used in the electrolytic surface-roughening step may be diluted nitric acid having an acid concentration of from 1 to 20 g/liter and containing at least one nitrate compound such as aluminum nitrate, sodium nitrate and ammonium nitrate to a degree falling between 1 g/liter and the saturation concentration of the compound.

In case where the aluminum plate contains any additional elements such as iron, copper, manganese, nickel, titanium, magnesium and silicon, the aqueous nitric acid solution to be used for processing it may contain any of these elements.

Preferably, the aqueous nitric acid solution is prepared by adding aluminum nitrate and ammonium nitrate to diluted nitric acid so that the nitric acid concentration of the resulting solution falls between 5 and 15 g/liter, the aluminum ion concentration thereof falls between 1 and 15 g/liter and the ammonium ion concentration thereof falls between 10 and 300 ppm.

The aluminum ion concentration and the ammonium ion concentration of the aqueous nitric acid solution generally increases while the aluminum plate is AC-electrolyzed in the solution.

For the alternating current to be applied to the aluminum plate for the electrolytic surface-roughening treatment therewith, and for the AC cell to be used for the treatment, referred to are the same as those mentioned hereinabove in the section of "(2-1) pre-electrolytic surface-roughening step". However, the electrolytic surface-roughening treatment in this step differs from the treatment in the pre-electrolytic surface-roughening step only in one point that the aqueous nitric acid solution mentioned above, and not the aqueous hydrochloric acid solution as in the pre-electrolytic surface-roughening step, is replenished through the acidic electrolytic solution supply ducts 8A and 8B.

(2-5) Mechanical Surface-Roughening Step:

If desired, the aluminum plate may be mechanically roughened on its surface. In the mechanical surface-roughening step, in general, one or both surfaces of the aluminum plate are rubbed with a roller brush having a large number of synthetic resin hairs of, for example, nylon (trade name), polypropylene or polyvinyl chloride resin planted in the entire surface of a cylindrical roller body, to thereby mechanically roughen the surfaces with it. For the mechanical surface-roughening treatment, also usable is an abrasive roller having an abrasive layer on its surface, in place of the roller brush.

The length of the brush hairs in the roller brush may be suitably determined, depending on the outer diameter of the roller brush and on the diameter of the roller body, and it generally falls between 10 and 100 mm.

For the abrasive material, for example, usable are siliceous sand and pumice stones. As compared with pumice stones, siliceous sand is hard and is difficult to crush. Therefore, siliceous sand is preferred, as the surface of the aluminum plate can be extremely efficiently grained with it.

Preferably, the mean grain size of the abrasive material falls between 3 and 40 $\mu$m, as realizing efficient surface roughening and as capable of reducing the grain pitches. More preferably, it falls between 10 and 30 $\mu$m.

For example, the abrasive material may be used as its slurry suspension in water. The abrasive slurry may additionally contain any of thickener, dispersant such as surfactant, as well as preservative.

(2-6) Etching Step before Pre-electrolysis:

Also if desired, the aluminum plate may be etched prior to being pre-electrolyzed. For effecting this etching, the aluminum plate may be etched with the same alkali solution as that used in the above-mentioned "alkali-etching step (2—2)" in the same manner as in the step (2—2).

Before etched prior to the electrolysis, the surface of the aluminum plate may be or may not be mechanically roughened in the step mentioned above.

The thus etched surface of the aluminum plate often has smut formed thereon, and it is desirable to desmut it after the etching step prior to the electrolysis.

For desmutting it, the aluminum plate may be processed in the same manner as in the above-mentioned "desmutting step with sulfuric acid (2-3)", using the same aqueous sulfuric acid solution as in the step (2-3). In place of using the aqueous sulfuric acid solution for the treatment, also usable is the aqueous nitric acid solution as in the "electrolytic surface-roughening step (2-4)" or the aqueous hydrochloric acid solution as in the "pre-electrolytic surface-roughening step (2-1)".

(2-7) Etching Step After Electrolytic Surface Roughening Treatment:

After having been electrolytically surface-roughened, the aluminum plate may be optionally etched again. In the etching step after the electrolysis, the electrolytically surface-roughened aluminum plate may be etched in the same manner as in the above-mentioned alkali-etching step, using the same alkali solution as in that step.

The etched surface of the aluminum plate after the second etching often has smut formed thereon, and it is desirable to desmut it in the final desmutting step that follows the second etching step.

(2-8) Final Desmutting Step:

For finally desmutting it, the aluminum plate may be processed in the same manner as in the above-mentioned desmutting step with sulfuric acid, using the same aqueous sulfuric acid solution as in that step. In place of using the aqueous sulfuric acid solution, also usable in the final desmutting step is the same aqueous nitric acid solution as in the above-mentioned electrolytic surface-roughening step, or the same aqueous hydrochloric solution as in the above-mentioned pre-electrolytic surface-roughening step.

(3) Anodic Oxidation Treatment:

In this embodiment, the surface-roughened aluminum plate is preferably processed for anodic oxidation.

For its anodic oxidation, the surface-roughened aluminum plate is processed in any ordinary manner.

For example, the aluminum plate is processed in an acidic electrolytic solution containing at least one acid component of sulfuric acid, phosphoric acid, oxalic acid, chromic acid and amidosulfonic acid, with a direct current, a pulsating current or an alternating current applied thereto.

The condition for the anodic oxidation could not be specified in a particular manner, as varying depending on the composition of the acidic electrolytic solution used. In general, however, the acid concentration of the acidic electrolytic solution preferably falls between 1 and 80% by weight, and the temperature thereof preferably falls between 5 and 70° C. The current density preferably falls between 1 and 60 A/dm$^2$, and the voltage preferably falls between 1 and 100 V. The time for electrolysis may fall between 10 and 300 seconds.

The acid component of the acidic electrolytic solution is preferably sulfuric acid, for example, as in JP-A 12853/1979 and 45303/1973.

The sulfuric acid concentration of the acidic electrolytic solution preferably falls between 10 and 300 g/liter (1 and 30% by weight); and the aluminum ion concentration thereof preferably falls between 1 and 25 g/liter (0.1 and 2.5% by weight), more preferably between 2 and 10 g/liter (0.2 and 1% by weight). The acidic electrolytic solution of the type may be prepared, for example, by adding aluminum to diluted sulfuric acid having an acid concentration of from 50 to 200 g/liter.

The bath temperature of the acidic electrolytic solution preferably falls between 30 and 60° C.

When the aluminum plate is subjected to anodic oxidation in the sulfuric acid-containing, acidic electrolytic solution, a direct current or an alternating current may be applied thereto.

In case where a direct current is applied to the aluminum plate, its current density preferably falls between 1 and 60 A/dm$^2$, more preferably between 5 and 30 A/dm$^2$.

When the aluminum plate is processed for anodic oxidation in a continuous process, it must be prevented from being "yellowed" owing to local concentration of current in a part of it. For this, for example, it is desirable that the current density is reduced to fall between 5 and 10 A/dm$^2$ in the initial stage of anodic oxidation, and then increased to fall between 30 and 50 A/dm$^2$ or more with the anodic oxidation going on.

In that case, it is also desirable to carry out the anodic oxidation in a mode of in-liquid current supply of applying the current to the aluminum plate via the acidic electrolytic solution. For the electrode via which the current is applied to the aluminum plate, usable is any one made of lead, iridium oxide, platinum or ferrite. For it, especially preferred is an electrode made of essentially iridium oxide, and an electrode coated with iridium oxide. For the base to be coated with iridium oxide into the coated electrode, preferred are bulb metals such as titanium, tantalum, niobium and zirconium. For it, more preferred are titanium and niobium. The bulb metals have relatively large electric resistance. Therefore, if desired, a core of copper may be cladded with such a bulb metal to form the base. In case where a copper core is cladded with such a bulb metal, it is difficult to construct a base having a complicated structure. In that case, therefore, the base to be constructed may be divided into some parts, then the copper cores corresponding to the thus-divided parts of the base are cladded with a bulb metal, and the thus-cladded cores may be combined into the intended final base.

Preferably, the degree of anodic oxidation on the aluminum plate is such that the amount of the oxide film formed thereon falls between 1 and 5 g/m$^2$, in view of the printing durability of the planographic printing plates comprising a support of the thus-processed aluminum plate. Also preferably, the difference between the amount of the oxide film formed in the center part of the aluminum plate and that of the oxide film formed in the area around the edges thereof is at most 1 g/m$^2$.

Also preferably, the aluminum plate thus having an oxide film formed thereon through such anodic oxidation is dipped in an aqueous solution of an alkali metal silicate such as sodium silicate or potassium silicate to thereby make the surface thereof hydrophilic; or it is coated with a hydrophilic undercoat layer of a hydrophilic vinyl polymer or any other hydrophilic compound.

For the details of the method of hydrophilicating the oxide layer on the aluminum plate with an aqueous solution of an alkali metal silicate such as sodium silicate or potassium silicate, referred to are the disclosures in U.S. Pat. Nos. 2,714,066 and 3,181,461; and for the details of the method of forming such a hydrophilic undercoat layer over the oxide film on the aluminum plate, referred to are the disclosures in JP-A 101651/1984 and 149491/1985. The hydrophilic vinyl polymer for the layer includes, for example, polyvinylsulfonic acid, and copolymers of sulfonic acid group-having vinyl monomers such as sulfonic acid group-having p-styrenesulfonic acid and other ordinary vinyl monomers such as alkyl (meth)acrylates; and the hydrophilic compound for it includes, for example, compounds having at least one of $NH_2$, COOH and sulfone groups.

If desired, the aluminum plate having an oxide film formed thereon through anodic oxidation may be contacted with boiling water, hot water or steam to thereby seal up the micropores in the oxide film.

3. Planographic Printing Plate Precursors:

The planographic printing plate precursor of this embodiment may be fabricated by forming a photosensitive or thermosensitive plate layer on the roughened surface of the aluminum plate that serves as the support for the planographic printing plate.

The photosensitive plate layer may be formed by applying a photosensitive resin solution onto the roughened surface of the aluminum plate followed by drying it in the dark. On the other hand, the thermosensitive plate layer may be formed by applying a thermosensitive resin solution onto the roughened surface of the aluminum plate followed by drying it.

For applying the photosensitive resin solution or the thermosensitive resin solution onto the aluminum plate, for example, employable are any known methods of spin coating, wire bar coating, dipping, air-knife coating, roll coating or blade coating.

The photosensitive resin include a positive photosensitive resin which, after exposed to light, becomes soluble in a developer; and a negative photosensitive resin which, after exposed to light, becomes insoluble in a developer.

One example of the positive photosensitive resin is a combination of a diazide compound, such as quinonediazide compound or naphthoquinonediazide compound, and a phenolic resin such as phenol-novolak resin or cresol-novolak resin.

Examples of the negative photosensitive resin are a combination of a diazo compound, for example, a diazo resin such as a condensate of aromatic diazonium salt with aldehyde, e.g., formaldehyde, or a salt of the diazo resin with an organic or inorganic acid, and a binder such as (meth) acrylate resin, polyamide resin or polyurethane; and a combination of a vinyl polymer such as (meth)acrylate resin or polystyrene resin, a vinyl monomer such as (meth)acrylate or styrene, and a photopolymerization initiator such as benzoin derivative, benzophenone derivative or thioxanthone derivative.

The solvent for the photosensitive resin solution may be any one which dissolves the photosensitive resin and which is volatile in some degree at room temperature, concretely including, for example, alcohol solvents, ketone solvents, ester solvents, ether solvents, glycol ether solvents, amide solvents, and carbonate solvents.

The alcohol solvents include, for example, ethanol, propanol and butanol. The ketone solvents include, for example, acetone, methyl ethyl ketone, methyl propyl ketone, methyl isopropyl ketone, and diethyl ketone. The ester solvents include, for example, ethyl acetate, propyl acetate, methyl formate, and ethyl formate. The ether solvents include, for example, tetrahydrofuran and dioxane. The glycol ether solvents include, for example, ethyl cellosolve, methyl cellosolve, and butyl cellosolve. The amide solvents include, for example, dimethylformamide and dimethylacetamide. The carbonate solvents include, for example, ethylene carbonate, propylene carbonate, diethyl carbonate, and dibutyl carbonate.

The photosensitive resin solution may further contain various colorants. The colorants include, for example, ordinary dyes, dyes that give their color after exposed to light, and dyes that lose their color to be almost or completely colorless after exposed to light. One example of the dyes that give their color after exposed to light is leuco dyes. On the other hand, the dyes that lose their color after exposed to light include, for example, triphenylmethane dyes, diphenylmethane dyes, oxazine dyes, xanthene dyes, iminonaphthoquinone dyes, azomethine dyes and anthraquinone dyes.

The planographic printing plate precursor thus fabricated in the manner as above is optionally cut into pieces of a desired size. In case where its plate layer is a photosensitive one, the precursor is exposed to light and developed to thereby form an intended printing image thereon. On the other hand, in case where its plate layer is a thermosensitive one, the precursor is exposed to IR laser to thereby directly write an intended printing image thereon. In that manner, the planographic printing plate precursor is processed into the final product, planographic printing plate.

EXAMPLES

This embodiment of the invention is described in detail with reference to the following Examples, which, however, are not intended to restrict the scope of the invention.

Example 1

<<Formation of Planographic Printing Plate Support>>

A melt of a regenerated aluminum ingot having the composition shown in Table 1 was degassed, filtered and then cast in a mode of DC casting into a cast slab.

The surface of the cast slab was cut off by a depth of 10 mm, then overheated, and thereafter hot-rolled at 400° C., without being soaked, into an aluminum alloy plate having a thickness of 4 mm.

Next, the aluminum alloy plate was cold-rolled to have a reduced thickness of 1.5 mm, then annealed, and thereafter again cold-rolled to have a further reduced thickness of 0.24 mm, and leveled to be an aluminum web.

TABLE 1

(unit: wt. %)

| Fe | Si | Cu | Ti | Mn | Mg | Zn | Cr | Total of other impurities | Al |
|---|---|---|---|---|---|---|---|---|---|
| 0.7 | 0.5 | 0.5 | 0.1 | 1.4 | 1.4 | 0.1 | 0.05 | 0.01 | 95.24 |

The aluminum web was surface-roughened and then processed for anodic oxidation, according to the process mentioned below.

1. Surface-Roughening:

While continuously conveyed in a processing apparatus, the aluminum web was surface-roughened according to the following:

(a) mechanical surface-roughening step,
(b) etching step before pre-electrolysis,
(c) pre-electrolytic surface-roughening step (step (1)),
(d) alkali-etching step (step (2)),
(e) desmutting step with sulfuric acid (step (3)),
(f) electrolytic surface-roughening step (step (4)),
(g) (second) etching step after electrolytic surface-roughening,
(h) final desmutting step.

Every time after the steps (a) to (h), the processing liquid was squeezed off from the aluminum web by the use of nip rollers, and the web was washed with water by spraying it with water from a water spray nozzle.

In all the etching step (b) before pre-electrolysis, the alkali-etching step (step (2)), the desmutting step (e) with sulfuric acid (step (3)), and the (second) etching step (g) after electrolytic surface-roughening, the processing solution was sprayed onto the both surfaces of the aluminum web. In these steps, used were spray nozzles with 4-mmϕ jet orifices aligned at intervals of 50 mm through the nozzle tube, through which the processing solution was sprayed over the aluminum web. The spray nozzles were so disposed that the distance between each jet orifice thereof and the surface of the aluminum web traveling along them was 50 mm.

The processing time is the time taken after the start of spraying the aluminum web with the processing solution to the end of removing the processing solution from the web with the nip rollers.

For washing the aluminum web having been processed in the steps (a) to (h), used were washing nozzles with spray tips to form a fan-shaped spray pattern, aligned at intervals of 100 mm through the nozzle tube, through which water was sprayed onto the both surfaces of the aluminum web. The washing nozzles were so disposed that the distance between each spray tip thereof and the surface of the aluminum web traveling along them was 100 mm.

The details of the processing steps (a) to (h) are described below.

(a) Mechanical Surface-roughening Step:

Using an abrasive slurry suspension that had been prepared by suspending siliceous sand (mean grain size: 25 μm) having a specific gravity of 1.12 in water, the aluminum web was mechanically roughened in a mechanical surface-roughening device with three roller brushes aligned above the aluminum web in the traveling route of the aluminum web.

Each roller brush used herein is so constituted that 6,10-nylon hairs each having a length of 50 mm and a diameter of 0.48 mm are densely planted in the entire surface of a stainless roller having a diameter of 300 mm.

On the other side of the traveling aluminum web opposite to the side thereof on which the roller brushes are disposed, two 200-mmϕ support rollers of stainless steel are disposed for every one roller brush, and the aluminum web travels between the roller brushes and the support rollers. The support rollers are so aligned that the center-to-center distance between the adjacent two rollers is 300 mm.

The roller brushes were pressed against the aluminum web so that the mean surface roughness of the roughened aluminum web could be 0.45 μm, while rotated in the traveling direction of the aluminum web. The pressure of the roller brushes under which they are pressed against the aluminum web was controlled on the basis of the load of the driving motor to drive the roller brushes.

While the aluminum web was mechanically roughened in the device, the siliceous sand concentration of the abrasive slurry was continuously monitored from the temperature and the specific gravity of the slurry, and water and siliceous sand were appropriately added to the slurry to keep the sand concentration of the slurry always constant. The siliceous sand having been ground fine in this process was continuously removed in a cyclone so that the grain size distribution in the abrasive slurry could be kept all the time nearly constant. During the process, the grain size of the siliceous sand in the abrasive slurry was kept falling between 1 and 35 μm.

(b) Etching Step Before Pre-electrolysis:

(Etching Treatment)

For etching the aluminum web before pre-electrolysis thereof, used was an alkali solution containing 27% by weight of sodium hydroxide and 6.5% by weight of aluminum ions and having a liquid temperature of 70° C. Through the spray nozzle as above, this was sprayed on the both surfaces of the aluminum web to etch them. Concretely, spraying the etching alkali solution on the aluminum web was so controlled that the degree of dissolution of the surface of the aluminum web having been mechanically roughened in the previous step, or that is, the degree of dissolution of the surface thereof to be pre-electrolytically roughened in the next step could be 8 g/m$^2$, while the degree of dissolution of the opposite surface of the aluminum web could be 2 g/m$^2$.

The relationship between the temperature, the specific gravity and the electroconductivity of the alkali solution, and the sodium hydroxide concentration and the aluminum ion concentration thereof was previously obtained. During the etching process, the temperature, the specific gravity and the electroconductivity of the alkali solution being used were monitored, and on the basis of their data, the sodium hydroxide concentration and the aluminum ion concentration of the solution were obtained. Water and aqueous 48 wt. % sodium hydroxide solution were appropriately added to the processing solution so that the sodium hydroxide concentration and the aluminum ion concentration of the solution could be kept all the time constant during the process. After having been thus etched, both surfaces of the aluminum web were washed with water by spraying water thereon through the washing nozzle as above.

(Desmutting Treatment)

Both the thus-etched surfaces of the aluminum web were then sprayed with an aqueous sulfuric acid solution through the spray nozzle as above, for 2 seconds. The processing solution contains 300 g/liter of sulfuric acid and 2 g/liter of aluminum ions, and its temperature was 70° C.

Figure 2:
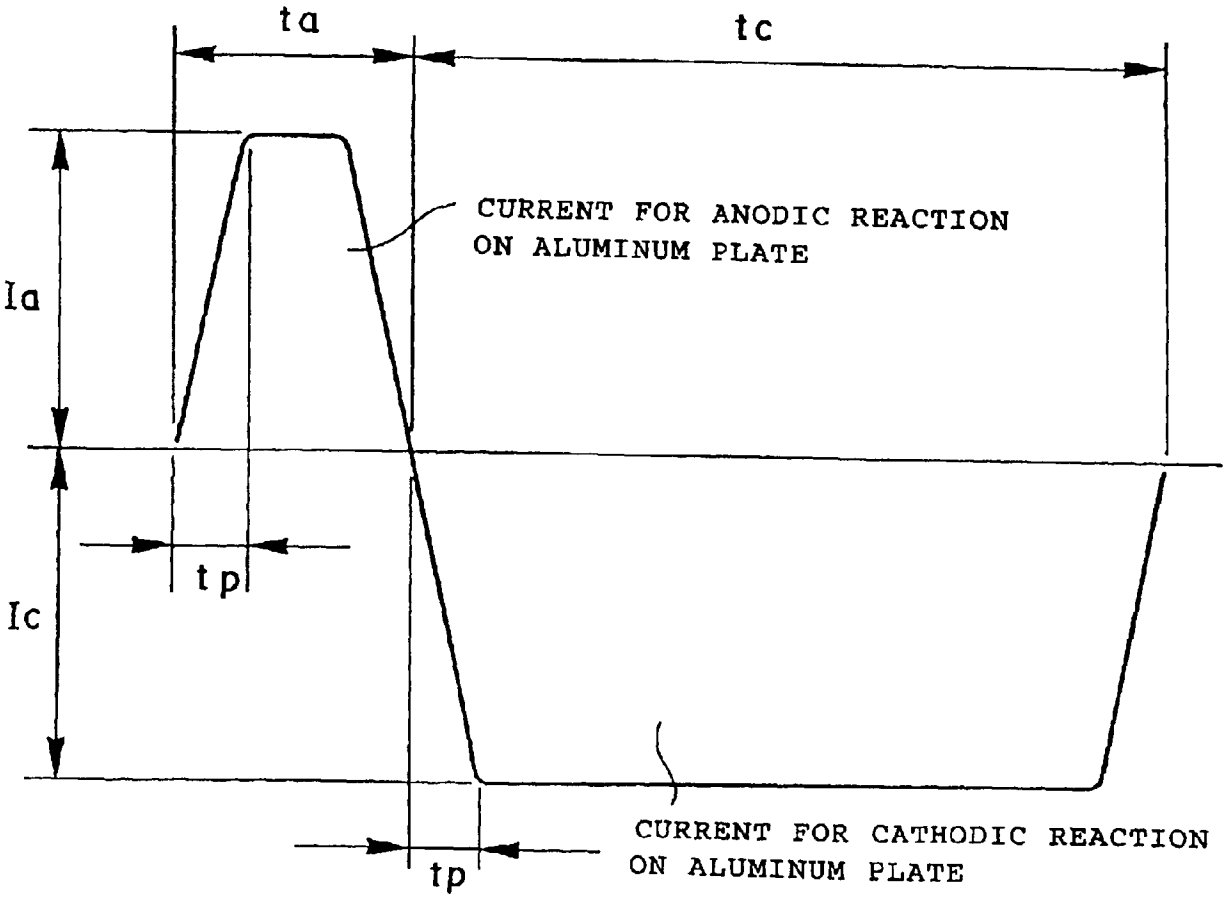
FIG. 2 is a graphic view showing one example of the trapezoidal waveform of an alternating current to be applied to the radial AC electrolytic cell unit of FIG. 1.

(c) Pre-electrolytic Surface-roughening Step:

In this step, used was the AC-electrolytic surface-roughening device of FIG. 1. Concretely, the aluminum web having been processed in the previous step was electrolytically surface-roughened in the device, in which a trapezoidal alternating current as in FIG. 2 was applied to both the two AC-electrolytic cells.

An aqueous hydrochloric acid solution at 35° C., which had been prepared by adding aluminum chloride to hydrochloric acid to have a hydrochloric acid concentration of 7.5 g/liter and an aluminum ion concentration of 5 g/liter, was put into the two AC-electrolytic cells, and the aluminum web was AC-electrolyzed therein.

The alternating current was so applied to the aluminum web passing through the device that the quantity of electricity to achieve the anodic reaction on the web could be 200 coulombs/$dm^2$.

The trapezoidal alternating current thus applied to the cells has a frequency of 60 Hz, and its pulse rise up time, tp, which it takes before rising from its base (0) to its plus or minus peak is 0.1 millisecond. The peak current Iap on the anode cycle side, and the peak current Icp on the cathode cycle side are both 50 A/$dm^2$; and the ratio Icp/Iap is 1.0. The current duty is 0.5.

The quiescent time in the upstream and downstream AC-electrolytic cell units was 0.5 second in the liquid supply nozzle site and 0.017 second in the insulators. The two AC-electrolytic cell units were so disposed that the time within which the aluminum web W moves from the former cell to the latter cell could be 0.5 second.

The relationship between the temperature and the electroconductivity of the aqueous hydrochloric acid solution and the speed of ultrasonic propagation through the solution, and the hydrochloric acid concentration and the aluminum ion concentration of the solution was previously obtained. During the process of electrolysis, 35 wt. % concentrated hydrochloric acid and water were appropriately introduced into the two cell bodies through the supply nozzles, while the excess aqueous hydrochloric acid solution was kept overflowing from them, to thereby control the temperature and the electroconductivity of the aqueous hydrochloric acid solution being used and also the speed of ultrasonic propagation through the solution to be all the time constant, and to control the hydrochloric acid concentration and the aluminum ion concentration of the bath in each cell also to be all the time constant.

(d) Alkali-etching Step:

Using an alkali solution having the same composition as that used in the etching step (b) but having a liquid temperature of 45° C., the aluminum web having been processed in the previous step (c) was etched in such a controlled manner that the degree of dissolution of the surface of the aluminum web having been mechanically roughened in the previous step, or that is, the degree of dissolution of the surface thereof to be electrolytically roughened in the next step could be 0.3 g/$m^2$, while the degree of dissolution of the opposite surface of the aluminum web could be 2 g/$m^2$.

The sodium hydroxide concentration and the aluminum ion concentration in the alkali solution used in this step were controlled in the same manner as in the etching step (b) prior to the electrolysis.

(e) Desmutting Step With Sulfuric Acid:

An aqueous sulfuric acid solution having the same composition and the same liquid temperature as those of the aqueous sulfuric acid solution used in the etching step (b) was sprayed on both surfaces of the aluminum web for 60 seconds to desmut them.

(f) Electrolytic Surface-roughening Step:

In an aqueous nitric acid solution prepared by mixing diluted hydrochloric acid having a concentration of 10 g/liter with aluminum nitrate and ammonium nitrate to have an aluminum ion concentration of 10 g/liter and an ammonium ion concentration of 140 ppm, and having a bath temperature of 50° C., the aluminum web was then electrolytically surface-roughened with an alternating current applied thereto.

In this electrolytic surface-roughening step, used was the AC-electrolytic surface-roughening device of FIG. 1, like in the pre-electrolytic surface-roughening step (c).

In this step, the same trapezoidal AC as that applied to the aluminum web in the pre-electrolytic surface-roughening step (c) was applied to the aluminum web, except that the pulse rise up time tp in this step was 0.2 milliseconds so that the quantity of electricity to achieve the anodic reaction on the web passing through the device could be 200 coulombs/$dm^2$. The quiescent time in this step is the same as that in the pre-electrolytic surface-roughening step (c).

(g) (Second) Etching Step After Electrolytic Surface-roughening:

An alkali solution containing 26% by weight of sodium hydroxide and 6.5% by weight of aluminum ions and having a liquid temperature of 45° C. was sprayed on both surfaces of the aluminum web through the spray nozzle as above to etch them. The degree of dissolution of the thus-etched surfaces of the aluminum web was 1 g/$m^2$.

The sodium hydroxide concentration and the aluminum ion concentration in the alkali solution used in this step were controlled in the same manner as those in the alkali solution used in the etching step (b) prior to the electrolysis.

(h) Final Desmutting Step:

An aqueous sulfuric acid solution having the same composition as that used in the desmutting treatment in the etching step (b) prior to the electrolysis was sprayed on both surfaces of the aluminum plate for 10 seconds to finally desmut them.

The relationship between the sulfuric acid concentration and the aluminum ion concentration in the aqueous sulfuric acid solution to be used, and the temperature, the specific gravity and the electroconductivity of the aqueous sulfuric acid solution was previously obtained. During the final desmutting process, the temperature, the specific gravity and the electroconductivity of the aqueous sulfuric acid solution being used were monitored, and on the basis of their data, water and 50 wt. % concentrated sulfuric acid were appropriately added to the processing solution, aqueous sulfuric acid solution so that the processing solution could all the time have the predetermined, constant sulfuric acid concentration and aluminum ion concentration during the process.

2. Anodic Oxidation:

In an aqueous sulfuric acid solution containing 100 g/liter of sulfuric acid and 5 g/liter of aluminum ions and having a bath temperature of 50° C., the aluminum web having been surface-roughened in the previous process was subjected to anodic oxidation, with a direct current applied thereto. The condition for the anodic oxidation was so controlled that the amount of the oxide film formed on the web could be 2.4 $g/m^2$.

The sulfuric acid concentration and the aluminum ion concentration in the aqueous sulfuric acid solution used in this treatment were controlled in the same manner as in the final desmutting step (h).

The surface of the thus-processed aluminum web to be a support for planographic printing plates was observed with a scanning electromicroscope, and it confirmed the formation of uniform honeycomb pits in the surface thereof.

<<Fabrication of Planographic Printing Plate Precursors>>

On the surface of the support for planographic printing plates that had been roughened according to the process mentioned above, formed were an undercoat layer and a photosensitive plate layer. The plate layer was formed by applying a photosensitive resin solution onto the undercoat layer and drying it thereon. The positive, planographic printing plate precursor thus fabricated has a dry film thickness of 2.0 $g/m^2$.

The precursor was imagewise exposed and then developed into a planographic printing plate. This was tried in offset printing, and it confirmed that the planographic printing plate tried was good, causing neither serious ink stains on printed matters nor blanket staining.

Comparative Example 1

The same process as in Example 1 was repeated, except that the aluminum web having been processed in the alkali-etching step (d) was desmutted with an aqueous nitric acid solution and not with sulfuric acid as in the step (e) in Example 1. The aqueous nitric acid solution used herein had an acid concentration of 10 g/liter and an aluminum ion concentration of 5 g/liter, and its liquid temperature was 45° C.

In this, the thus-processed aluminum web was then electrolytically surface-roughened in the step (f). Concretely, in the AC-electrolytic surface-roughening device of FIG. 1, the aluminum web was processed with an aqueous nitric acid solution having an acid concentration of 10 g/liter and an aluminum ion concentration of 5 g/liter and having a bath temperature of 50° C., with a trapezoidal AC applied thereto. In the device used herein, however, the two AC-electrolytic cell units were so disposed that the aluminum web being processed therein takes 10 seconds while it moves from the upstream cell to the downstream cell.

The pulse rise time, tp, of the trapezoidal AC used herein was 1.5 milliseconds; but the other factors thereof, the frequency, the voltage, Iap, Icp, the ratio Icp/Iap and the duty were all the same as those of the trapezoidal AC used in Example 1.

In this, the AC applied to the aluminum web was so controlled that the quantity of electricity to achieve the anodic reaction on the web in both the first and second AC-electrolytic cells while the web passes through the cells could be 100 $coulombs/dm^2$.

In the same manner and under the same condition as in Example 1 except the above-mentioned points, an aluminum web was processed to be a support for planographic printing plates.

The surface of the thus-processed aluminum web to be a support for planographic printing plates was observed with a scanning electromicroscope, and it confirmed the formation of obviously non-uniform honeycomb pits in the surface thereof, different from that in Example 1.

On the roughened surface of the support for planographic printing plates, formed was a plate layer. The resulting planographic printing plate precursor was imagewise exposed and then developed into a planographic printing plate.

This was tried in offset printing, in which the printed matters had serious ink stains in the non-image area thereof, and the blanket used was stained.

Comparative Example 2

A support for planographic printing plates was produced in the same manner as in Example 1, for which, however, the pre-electrolytic surface-roughening step (c), the alkali-etching step (d) and the desmutting step (e) with sulfuric acid were all omitted in the process of surface-roughening the aluminum web.

The surface of the support for planographic printing plates was observed with a scanning electromicroscope, and it confirmed that the honeycomb pits formed thereon were obviously non-uniform as compared with those in Example 1, and many streaks were found in the surface of the support.

On the roughened surface of the support for planographic printing plates, formed was a plate layer in the same manner as in Example 1. The resulting planographic printing plate precursor was imagewise exposed and then developed into a planographic printing plate. This was tried in offset printing, in which the printed matters had serious ink stains in the non-image area thereof, and the blanket used was stained.

Example 2

A support for planographic printing plates was produced in the same manner as in Example 1, and it was passed through a boiling pure water to thereby seal the micropores in the oxide film formed on the support.

The support thus having been subjected to the pore-sealing treatment was then dipped in an aqueous sodium silicate solution having a sodium silicate concentration of 2.5% by weight and having a liquid temperature of 70° C., for 14 seconds to thereby make the surface thereof hydrophilic it.

The relationship between the sodium silicate concentration of the aqueous sodium silicate solution to be used for this treatment, and the liquid temperature and the electroconductivity of the solution was previously obtained. During the process of this treatment, the liquid temperature and the electroconductivity of the aqueous sodium silicate solution being used were monitored to know the sodium silicate concentration of the solution; and water and stock sodium silicate No. 3 were added to the solution so that the solution could have all the time the predetermined constant sodium silicate concentration during the process.

After the surface of the support was thus made hydrophilic, a plate layer was formed thereon in the same manner as in Example 1. The resulting, planographic printing plate precursor was processed to have an image thereon, and a planographic printing plate was thus finished.

The planographic printing plate was tested for its printing properties. It confirmed that the printing plate is good, causing neither serious inks stains on the printed matters nor blanket staining.

Example 3

A support for planographic printing plates was produced in the same manner as in Example 1, and it was dipped in an aqueous sodium silicate solution having a sodium silicate concentration of 2.5% by weight and having a liquid temperature of 70° C., for 5 seconds to thereby make the surface thereof hydrophilic. Next, this was washed by spraying it with water, and then dried.

After dried, this was processed in the same manner as in Example 1 to form a plate layer on its surface. The resulting, planographic printing plate precursor was then processed to have an image thereon, and a planographic printing plate was thus finished.

The planographic printing plate was tested for its printing properties. It confirmed that the printing plate is good, causing neither serious inks stains on the printed matters nor blanket staining.

Example 4

A support for planographic printing plates was produced in the same manner as in Example 1, and this was dipped in an aqueous 1.5 wt. % polyvinylsulfonic acid solution having a liquid temperature of 70° C. for 5 seconds to make the surface thereof hydrophilic.

The relationship between the polyvinylsulfonic acid concentration of the aqueous solution to be used for this treatment, and the temperature and the electro conductivity of the solution was previously obtained. During the process of this treatment, the liquid temperature and the electroconductivity of the aqueous solution being used were monitored to know the polyvinylsulfonic acid concentration of the solution; and water and stock polyvinylsulfonic acid were added to the solution so that the solution could have all the time the predetermined constant acid concentration during the process.

After being made hydrophilic in such a manner, the support was washed by spraying it with water, and then dried.

After dried, this was processed in the same manner as in Example 1 to form a plate layer on its surface. The resulting, planographic printing plate precursor was then processed to have an image thereon, and a planographic printing plate was thus finished.

The planographic printing plate was tested for its printing properties. It confirmed that the printing plate is good, causing neither serious inks stains on the printed matters nor blanket staining.

Example 5

A support for planographic printing plates was produced in the same manner as in Example 1, for which, however, an aluminum plate made from a regenerated aluminum ingot having a composition shown in Table 2 below was used. In the process of surface-roughening the aluminum plate for this, the mechanical surface-roughening step (a) was omitted.

TABLE 2

(unit: wt. %)

| Fe | Si | Cu | Ti | Mn | Mg | Zn | Cr | Total of other impurities | Al |
|---|---|---|---|---|---|---|---|---|---|
| 0.45 | 0.27 | 0.19 | 0.03 | 0.83 | 0.9 | 0.12 | 0.03 | 0.01 | balance |

The surface of the support was observed with a scanning electromicroscope, and it confirmed the formation of uniform honeycomb pits therein.

On the roughened surface of the support, formed was a plate layer in the same manner as in Example 1, and the resulting, planographic printing plate precursor was imagewise exposed and developed to give a planographic printing plate.

Tried in printing, the printing plate was good, not causing serious ink stains in the non-image area of the printed matters.

As described in detail hereinabove, this embodiment of the invention provides a method for producing planographic printing plate supports in which even aluminum plates prepared from regenerated aluminum ingots are usable and the supports produced realize good planographic printing plates of excellent printing durability causing neither serious ink spot stains in printed matters nor blanket staining, and provides the planographic printing plate supports produced in the method, and planographic printing plate precursors comprising the support.

Second Embodiment:

1. Aluminum Plate:

The aluminum plate to be processed in this embodiment includes conventional, rolled aluminum plates for planographic printing plate supports, as well as sheets or plates of aluminum ingots regenerated from scrapped aluminum, recycled aluminum, etc.

The aluminum plate to be processed in this embodiments may be the same as that to be processed in the above-mentioned first embodiment, and its details are omitted herein.

2. Surface-Roughening Treatment, and Anodic Oxidation:

The method of this embodiment for producing a support for planographic printing plates may comprise only a surface-roughening step of roughening the surface of the aluminum plate, or may comprise, in addition to the surface-roughening step, an anodic oxidation step of oxidizing the roughened surface of the aluminum plate.

As so mentioned hereinabove, the aluminum plate is surface-roughened in a mode of AC electrolysis in an aqueous nitric acid solution having a specific composition. Before AC-electrolytically surface-roughed in such a manner, the aluminum plate may be mechanically surface-roughened and etched; and after AC-electrolytically surface-roughed, it may be etched again. In addition, the aluminum plate may be desmutted after the etching but before AC-electrolytically surface-roughened, and may be desmutted again after the second etching.

In case where the surface-roughened aluminum plate is subjected to anodic oxidation after the AC-electrolytically surface-roughening process, the oxide film formed thereon in the treatment of anodic oxidation may be made hydrophilic or may be subjected to pore-sealing treatment to seal the micropores therein.

The surface-roughening treatment and the anodic oxidation of the aluminum plate are described in detail hereinunder.

(2-1) AC-electrolytic Surface-Roughening Treatment:

In the method of this embodiment for producing a support for planographic printing plates, an aluminum plate such as that mentioned above is processed in an aqueous nitric acid solution having a nitrate ion concentration and an aluminum ion concentration of from 5 to 15 g/liter each, and an ammonium ion concentration of from 10 to 300 ppm, and having a bath temperature falling between 50 and 80° C., with an alternating current applied thereto.

The acid solution may contain, in addition to the components mentioned above, any of Fe, Si, Cu, Mg, Mn, Zn, Cr and Ti metals that are generally in aluminum plates.

The acid solution consisting essentially of nitric acid may be prepared, for example, by adding aluminum nitrate and ammonium nitrate to diluted nitric acid having a concentration of from 5 to 15 g/liter so that aluminum ion concentration and the ammonium ion concentration of the resulting solution may fall within the defined ranges as above.

The alternating current to be applied to the aluminum plate in the AC-electrolytic surface-roughening step may have any wave form of sine waves, rectangular waves, triangular waves, trapezoidal waves. Of those, preferred are rectangular waves and trapezoidal waves.

The frequency of the alternating current preferably falls between 40 and 120 Hz, from the viewpoint of the cost for constructing the power source unit.

Also preferably, the ratio of the quantity of electricity QA of the alternating current applied to the aluminum plate acting as an anode, to the quantity of electricity QC thereof applied to the aluminum plate acting as a cathode, QC/QA falls between 0.9 and 1, as the aluminum plate is processed to have uniform honeycomb pits formed therein. More preferably, the ratio QC/QA falls between 0.95 and 0.99.

In case where the AC-electrolytic surface-roughening treatment is effected in an AC-electrolytic cell having therein auxiliary anodes, it is desirable that the ratio QC/QA is controlled to fall within the defined range by controlling the anode current to be divided toward the auxiliary electrodes, for example, as in JP-A 43500/1985 and 52098/1989.

The AC duty in the AC-electrolytic surface-roughening treatment is most preferably 0.5, since the aluminum plate can be uniformly roughened in that condition and since the power source unit is easy to construct. The AC duty referred to in this embodiment is indicated by ta/T in which T is the AC current period and ta is the time for anodic reaction of the aluminum plate (anodic reaction time).

Through its cathodic reaction, the surface of the aluminum plate receives smut of essentially aluminum hydroxide, and the oxide film formed thereon will be dissolved or broken. The dissolved or broken part of the oxide film may be the start point for the pitting reaction in the next-stage anodic reaction of the aluminum plate. Accordingly, the appropriate selection of the AC duty in this treatment is especially important for uniformly roughening the surface of the aluminum plate.

In case where the alternating current applied to the aluminum plate is a trapezoidal one, the pulse rise up time, Tp, for which the AC value reaches from 0 to the plus or minus peak preferably falls between 0.01 and 0.3 milliseconds. With the pulse rise time Tp falling within the defined range, more uniform honeycomb pits are formed in the processed surface of the aluminum plate.

On the other hand, the peak current Iap in the anode cycle of the alternating current and the peak current Icp in the cathode cycle thereof may be so defined that the total quantity of electricity for the anodic reaction of the aluminum plate from the start to the finish of the AC-electrolytic surface-roughening treatment falls between 1 and 500 coulombs/$cm^2$. Preferably, however, they are from 10 and 200 A/$dm^2$ each. Also preferably, Icp/Iap falls between 0.9 and 1.5.

For the AC-electrolytic surface-roughening treatment, the AC mode is preferably so controlled that it includes at least once the quiescent time for which no alternating current flows between the aluminum plate and the counter electrode and that the quiescent time falls between 0.001 and 0.6 second/once. In the defined condition, uniform honeycomb pits are formed throughout the processed surface of the aluminum plate.

For the AC-electrolytic surface-roughening treatment, usable is an AC-electrolytic cell unit which comprises an electrolytic cell containing therein an aqueous nitric acid solution and enabling an aluminum plate to pass through it, a power source for applying an alternating current to the aluminum plate which is passing through the aqueous nitric acid solution in the electrolytic cell, and a counter electrode disposed inside the cell so as to face the aluminum plate while the plate is AC-electrolytically processed therein.

For the treatment, usable are various types of AC-electrolytic cells, for example, vertical AC-electrolytic cells, flat AC-electrolytic cells as in JP-B 30036/1986, and radial AC-electrolytic cells as in JP-A 300843/1996; but preferred are radial AC-electrolytic cells.

One example of radial AC-electrolytic cells employable herein comprises a drum disposed inside the cell body so that the aluminum web to be processed is wound around it, a pair of semi-cylindrical electrodes which are disposed inside the cell body to surround the drum and which are bonded to each other via an insulator therebetween to form a cylinder, and a power-supply roller, one example of power sources, which is disposed outside the cell body and rotates while brought into contact with the aluminum web. For example, the power-supply roller may be produced by homogenizing a cast roller of industrial pure aluminum at a high temperature to thereby convert the Al—Fe crystal matter in at least the surface thereof into a single phase of substantially $Al_3Fe$ to improve the corrosion resistance of the roller, as in JP-B 50138/1986.

(2—2) Mechanical Surface-Roughening Treatment:

If desired, the aluminum plate may be mechanically roughened on its surface. In the mechanical surface-roughening step, in general, one or both surfaces of the aluminum plate are rubbed with a roller brush having a large number of synthetic resin hairs of, for example, nylon (trade name), polypropylene or polyvinyl chloride resin planted in the entire surface of a cylindrical roller body, to thereby mechanically roughen the surfaces with it. For the mechanical surface-roughening treatment, also usable is an abrasive roller having an abrasive layer on its surface, in place of the roller brush.

The mechanical surface-roughening treatment in this embodiment may be the same as that in the first embodiment mentioned above, and its details are omitted herein.

(2-3) Etching Treatment:

Also if desired, the aluminum plate may be etched. To etch it, in general, the aluminum plate is contacted with an alkali agent.

For contacting the aluminum plate with an alkali agent, for example, employable is a method of continuously passing the aluminum plate through a tank filled with an alkali agent; a method of dipping it in the tank; or a method of spraying an alkali agent onto the surface of the aluminum plate.

For the alkali agent, for example, used is a solution of an alkali hydroxide or an alkali metal salt. The alkali hydroxide or alkali metal salt concentration of the solution preferably falls between 0.01 and 30% by weight; and the temperature thereof preferably falls between 20 and 90° C.

The alkali hydroxide includes, for example, sodium hydroxide and potassium hydroxide.

The alkali metal salt includes, for example, alkali metal silicates such as sodium metasilicate, sodium silicate, potassium metasilicate and potassium silicate; alkali metal carbonates such as sodium carbonate and potassium carbonate; alkali metal aluminates such as sodium aluminate and potassium aluminate; alkali metal aldonates such as sodium gluconate and potassium gluconate; and alkali metal hydrogenphosphates such as sodium secondary phosphate, potassium secondary phosphate, sodium tertiary phosphate and potassium tertiary phosphate. For the alkali agent, especially preferred are a solution of an alkali hydroxide solution and a solution of an alkali hydroxide and an alkali metal aluminate such as those mentioned above, as their etching power is high and they are inexpensive.

Preferably, the degree of etching the aluminum plate falls between 0.1 and 20 g/m$^2$, more preferably between 1 and 15 g/m$^2$, even more preferably between 2 and 10 g/m$^2$. The etching time preferably falls between 5 seconds and 5 minutes. So far as the degree of etching and the etching time both fall within the defined ranges, the fine hillocks formed on the surface of the aluminum plate through mechanical surface-roughening treatment may still remain to a desired degree as they are. Therefore, the thus-processed aluminum plate can be a support that realizes good planographic printing plates having high water retentiveness in the non-image area and capable of protecting the non-image area from receiving ink to cause blanket staining. With the aluminum plate serving as a support, the planographic printing plate precursors present a good appearance and can be well processed into planographic printing plates.

The etching treatment may be effected in any ordinary etching cell for aluminum plates. The etching cell may be for any of batch or continuous processes. In place of using such an etching cell, also usable herein is an ordinary spraying unit for spraying an alkali agent on aluminum plates.

(2-4) Desmutting Treatment:

The etched aluminum plate may be desmutted to remove the black powdery smut having been formed on the surface of the aluminum plate. The smut consists essentially of oxides and hydroxides of Fe, etc.

To desmut it, in general, the aluminum plate is dipped in an aqueous acid solution containing at least one of sulfuric acid, nitric acid, hydrochloric acid, phosphoric acid and chromic acid; or the aqueous acid solution is sprayed onto the surface of the aluminum plate.

The concentration of the acid solution preferably falls between 1 and 500 g/liter.

The acid solution may contain aluminum ions and other metal ions derived from the impurities such as Fe in the aluminum plate, dissolved therein, but the amount of the aluminum ions and other metal ions dissolved in the solution preferably falls between 0.1 and 15 g/liter.

The temperature of the acid solution preferably falls between 20 and 95° C., more preferably between 30 and 80° C.

The time for the desmutting treatment preferably falls between 1 and 180 seconds.

For the desmutting treatment, it is desirable to use the aqueous acid solution used for the electrolytic surface-roughening treatment, as the amount of the waste in the process can be reduced.

For the aqueous acid solution for the desmutting treatment, especially preferred are an aqueous sulfuric acid solution consisting essentially of sulfuric acid; an aqueous nitric acid solution consisting essentially of nitric acid; and an aqueous hydrochloric acid solution consisting essentially of hydrochloric acid.

(a) Aqueous Sulfuric Acid Solution:

The sulfuric acid concentration of the aqueous sulfuric acid solution preferably falls between 250 and 500 g/liter. The temperature of the solution preferably falls between 60 and 90° C. The solution may contain aluminum ions and other metal ions, as so mentioned hereinabove for the aqueous acid solution for the desmutting treatment. However, it is desirable that the aluminum ion concentration of the aqueous sulfuric acid solution is limited to such that it gives no solid aluminum sulfate deposit in the solution at the temperature of the solution mentioned hereinabove. Concretely, the aluminum ion concentration of the solution preferably falls between 0.1 and 15 g/liter, more preferably between 0.1 and 10 g/liter.

The desmutting time in the aqueous sulfuric acid solution preferably falls between 1 and 180 seconds. In case where the desmutting treatment in the solution is effected prior to the electrolytic surface-roughening treatment mentioned above, the desmutting time therein preferably falls between 60 and 120 seconds; but where it is effected prior to the anodic oxidation to be mentioned below, the desmutting time in the solution preferably falls between 1 and 10 seconds.

(b) Aqueous Nitric Acid Solution:

The nitric acid concentration of the aqueous nitric acid solution preferably falls between 1 and 20 g/liter. The solution may contain at least one nitrate selected from aluminum nitrate, sodium nitrate and ammonium nitrate. Preferably, however, the nitrate content of the solution falls between 1 g/liter and the nitrate saturation/liter. In addition, the solution may further contain any of Fe, Si, Cu, Mg, Mn, Zn, Cr and Ti ions.

Most preferably, the aqueous nitric acid solution is prepared by adding aluminum nitrate and ammonium nitrate to diluted nitric acid so that it has a nitric acid concentration of from 5 to 15 g/liter, an aluminum ion concentration of from 5 to 15 g/liter and an ammonium ion concentration of from 10 to 300 ppm.

The temperature of the solution preferably falls between 40 and 80° C., most preferably between 50 and 70° C.

(c) Aqueous Hydrochloric Acid Solution:

The hydrochloric acid concentration of the aqueous hydrochloric acid solution preferably falls between 1 and 20 g/liter. The solution may contain at least one chloride selected from aluminum chloride, sodium chloride and ammonium chloride. The chloride content of the solution preferably falls between 1 g/liter and the chloride saturation/liter. In addition, the solution may further contain any of Fe, Si, Cu, Mg, Mn, Zn, Cr and Ti ions.

Most preferably, the aqueous hydrochloric acid solution is prepared by adding aluminum chloride and ammonium chloride to diluted hydrochloric acid so that it has a hydrochloric acid concentration of from 5 to 15 g/liter, an aluminum ion concentration of from 5 to 15 g/liter and an ammonium ion concentration of from 10 to 300 ppm.

The temperature of the solution preferably falls between 10 and 95° C., most preferably between 30 and 50° C.

(3) Anodic Oxidation Treatment:

The surface-roughened aluminum plate may be processed for anodic oxidation in any ordinary manner.

For its anodic oxidation, for example, the aluminum plate is processed in an electrolytic solution containing at least one of sulfuric acid, phosphoric acid, oxalic acid, chromic acid and amidosulfonic acid, with a direct current or a pulsating current applied thereto.

Apart from the electrolytic solution mentioned above, also usable for the anodic oxidation is an electrolytic solution containing at least one such acid component of sulfuric acid, phosphoric acid, oxalic acid, chromic acid and amidosulfonic acid, and aluminum ions.

The electrolyte content of the electrolytic solution preferably falls between 1 and 80% by weight; and the temperature of the solution preferably falls between 5 and 70° C.

The anodic oxidation is preferably effected to such an extent that the amount of the oxide film formed through it falls between 0.1 and 10 $g/m^2$, from the viewpoint of the abrasion resistance of the thus-processed aluminum plate to serve as a support for planographic printing plates and of the durability of the planographic printing plate precursors comprising, as the support, the aluminum plate. Also preferably, the current density for the anodic oxidation falls between 0.5 and 60 $A/dm^2$; and the voltage for it falls between 1 and 100 V. The time for electrolysis for the treatment preferably falls between 1 second and 5 minutes.

Preferably, the aluminum plate thus having an oxide film formed thereon through such anodic oxidation is dipped in an aqueous solution of an alkali metal silicate such as sodium silicate or potassium silicate to thereby make the surface thereof hydrophilic; or it is coated with a hydrophilic undercoat layer of a hydrophilic vinyl polymer or any other hydrophilic compound.

For the details of the method of hydrophilicating the oxide layer on the aluminum plate with an aqueous solution of an alkali metal silicate such as sodium silicate or potassium silicate, referred to are the disclosures in U.S. Pat. Nos. 2,714,066 and 3,181,461; and for the details of the method of forming such a hydrophilic undercoat layer over the oxide film on the aluminum plate, referred to are the disclosures in JP-A 101651/1984 and 149491/1985. The hydrophilic vinyl polymer for the layer includes, for example, polyvinylsulfonic acid, and copolymers of sulfonic acid group-having vinyl monomers such as sulfonic acid group-having p-styrenesulfonic acid and other ordinary vinyl monomers such as alkyl (meth)acrylates; and the hydrophilic compound for it includes, for example, compounds having at least one of $NH_2$, COOH and sulfone groups.

If desired, the aluminum plate having an oxide film formed thereon through anodic oxidation may be contacted with boiling water, hot water or steam to thereby seal up the micropores in the oxide film.

3. Planographic Printing Plate Precursors:

The planographic printing plate precursor of this embodiment may be fabricated by applying a photosensitive resin solution or a thermosensitive resin solution onto the mechanically-roughened surface the aluminum plate that serves as the support for the planographic printing plate, followed by drying it in the dark.

For applying the photosensitive resin solution or the thermosensitive resin solution onto the aluminum plate, for example, employable are any known methods of spin coating, wire bar coating, dipping, air-knife coating, roll coating or blade coating.

The photosensitive resin to be used for forming the plate layer include a positive photosensitive resin which, after exposed to light, becomes soluble in a developer; and a negative photosensitive resin which, after exposed to light, becomes insoluble in a developer.

One example of the positive photosensitive resin is a combination of a diazide compound, such as quinonediazide compound or naphthoquinonediazide compound, and a phenolic resin such as phenol-novolak resin or cresol-novolak resin.

Examples of the negative photosensitive resin are a combination of a diazo compound, for example, a diazo resin such as a condensate of aromatic diazonium salt with aldehyde, e.g., formaldehyde, or a salt of the diazo resin with an organic or inorganic acid, and a binder such as (meth) acrylate resin, polyamide resin or polyurethane; and a combination of a vinyl polymer such as (meth)acrylate resin or polystyrene resin, a vinyl monomer such as (meth)acrylate or styrene, and a photopolymerization initiator such as benzoin derivative, benzophenone derivative or thioxanthone derivative.

The solvent for the photosensitive resin solution may be any one which dissolves the photosensitive resin and which is volatile in some degree at room temperature, concretely including, for example, alcohol solvents, ketone solvents, ester solvents, ether solvents, glycol ether solvents, amide solvents, and carbonate solvents.

The alcohol solvents include, for example, ethanol, propanol and butanol. The ketone solvents include, for example, acetone, methyl ethyl ketone, methyl propyl ketone, methyl isopropyl ketone, and diethyl ketone. The ester solvents include, for example, ethyl acetate, propyl acetate, methyl formate, and ethyl formate. The ether solvents include, for example, tetrahydrofuran and dioxane. The glycol ether solvents include, for example, ethyl cellosolve, methyl cellosolve, and butyl cellosolve. The amide solvents include, for example, dimethylformamide and dimethylacetamide. The carbonate solvents include, for example, ethylene carbonate, propylene carbonate, diethyl carbonate, and dibutyl carbonate.

The photosensitive resin solution may further contain various colorants. The colorants include, for example, ordinary dyes, dyes that give their color after exposed to light, and dyes that lose their color to be almost or completely colorless after exposed to light. One example of the dyes that give their color after exposed to light is leuco dyes. On the other hand, the dyes that lose their color after exposed to light include, for example, triphenylmethane dyes, diphenylmethane dyes, oxazine dyes, xanthene dyes, iminonaphthoquinone dyes, azomethine dyes and anthraquinone dyes.

The planographic printing plate precursor thus fabricated in the manner as above is optionally cut into pieces of a desired size. Then, the precursor is exposed to light and developed, or exposed to laser rays to thereby directly write an intended printing image thereon. In that manner, the planographic printing plate precursor is processed into the final product, planographic printing plate.

EXAMPLES

This embodiment of the invention is described in detail with reference to the following Examples, which, however, are not intended to restrict the scope of the invention.

Example 1

<<Formation of Planographic Printing Plate Support>>

A melt of a regenerated aluminum ingot having the composition shown in Table 3 was degassed, filtered and then cast in a mode of DC casting into a cast slab.

The surface of the cast slab was cut off by a depth of 10 mm, then overheated, and thereafter hot-rolled at 400° C., without being soaked, into an aluminum alloy plate having a thickness of 4 mm.

Next, the aluminum alloy plate was cold-rolled to have a reduced thickness of 1.5 mm, then annealed, and thereafter again cold-rolled to have a further reduced thickness of 0.24 mm, and leveled to be an aluminum web.

TABLE 3

(unit: wt. %)

| Fe | Si | Cu | Ti | Mn | Mg | Zn | Cr | Total of other impurities | Al |
|---|---|---|---|---|---|---|---|---|---|
| 0.7 | 0.5 | 0.5 | 0.1 | 1.4 | 1.4 | 0.1 | 0.05 | 0.01 | 95.24 |

While continuously conveyed in a processing apparatus, the aluminum web was processed to undergo the following treatments in that order:

(1) mechanical surface-roughening,
(2) first etching,
(3) first desmutting,
(4) AC-electrolytic surface-roughening,
(5) second etching,
(6) second desmutting,
(7) anodic oxidation.

Every time after the steps (1) to (7), the processing liquid was squeezed off from the aluminum web by the use of nip rollers, and the web was washed with water by spraying it with water from a water spray nozzle.

In the steps (2), (3), (5) and (6) of the above-mentioned steps (1) to (7), the processing solution was sprayed onto the both surfaces of the aluminum web through spray nozzles disposed on both sides of the traveling route of the web. The spray nozzles have 4-mmϕ jet orifices aligned at intervals of 50 mm in the direction of the nozzle tube, through which the processing solution was sprayed over the aluminum web. The spray nozzles were so disposed that the distance between each jet orifice thereof and the surface of the aluminum web traveling along them was 50 mm. The processing time is the time taken after the start of spraying the aluminum web with the processing solution to the end of removing the processing solution from the web with the nip rollers.

For washing the aluminum web with water, used were washing nozzles aligned on both sides of the traveling route of the web, through which water was sprayed onto the both surfaces of the web traveling between them. The washing sprays had spray tips to form a fan-shaped spray pattern, aligned at intervals of 100 mm in the direction of the nozzle tube. The washing nozzles were so disposed that the distance between each spray tip thereof and the surface of the aluminum web traveling along them was 100 mm.

The details of the processing steps (1) to (7) are described below.

(1) Mechanical Surface-roughening:

Using an abrasive slurry suspension that had been prepared by suspending siliceous sand (mean grain size: 25 μm) having a specific gravity of 1.12 in water, the aluminum web was mechanically roughened in a mechanical surface-roughening device with three roller brushes aligned above the aluminum web in the traveling route of the web.

Each roller brush used herein is so constituted that 6,10-nylon hairs each having a length of 50 mm and a diameter of 0.48 mm are densely planted in the entire surface of a stainless roller having a diameter of 300 mm.

On the other side of the traveling aluminum web opposite to the side thereof on which the roller brushes are disposed, two 200-mmϕ) support rollers of stainless steel are disposed for every one roller brush, and the aluminum web travels between the roller brushes and the support rollers. The support rollers are so aligned that the center-to-center distance between the adjacent two rollers is 300 mm.

The roller brushes were pressed against the aluminum web so that the mean surface roughness of the roughened aluminum web could be 0.45 μm, while rotated in the traveling direction of the aluminum web. The pressure of the roller brushes under which they are pressed against the aluminum web was controlled on the basis of the load of the driving motor to drive the roller brushes.

While the aluminum web was mechanically roughened in the device, the siliceous sand concentration of the abrasive slurry was continuously monitored from the temperature and the specific gravity of the slurry, and water and siliceous sand were appropriately added to the slurry to keep the sand concentration of the slurry always constant. The siliceous sand having been ground fine in this process was continuously removed in a cyclone so that the grain size distribution in the abrasive slurry could be kept all the time nearly constant.

(2) First Etching:

For etching the aluminum web, prior to the electrolysis, used was an alkali solution containing 27% by weight of sodium hydroxide and 6.5% by weight of aluminum ions and having a liquid temperature of 70° C. This was sprayed on the both surfaces of the aluminum web to etch them. Concretely, spraying the etching alkali solution on the aluminum web was so controlled that the degree of dissolution of the mechanically-roughened surface of the aluminum web could be 8 g/m$^2$, while the degree of dissolution of the opposite surface thereof could be 2 g/m$^2$.

The relationship between the temperature, the specific gravity and the electroconductivity of the alkali solution, and the sodium hydroxide concentration and the aluminum ion concentration thereof was previously obtained. During the etching process, the temperature, the specific gravity and the electroconductivity of the alkali solution being used were monitored, and on the basis of their data, the sodium hydroxide concentration and the aluminum ion concentration of the solution were obtained. Water and aqueous 48 wt. % sodium hydroxide solution were appropriately added to the processing solution so that the sodium hydroxide concentration and the aluminum ion concentration of the solution could be kept all the time constant during the process.

(3) First Desmutting:

Both the thus-etched surfaces of the aluminum web were then sprayed with an aqueous sulfuric acid solution for 2 seconds. The processing solution contains 300 g/liter of sulfuric acid and 2 g/liter of aluminum ions, and its temperature was 70° C.

(4) AC-electrolytic Surface-roughening:

In this step, the aluminum web was processed in an aqueous nitric acid solution prepared by adding aluminum nitrate and ammonium nitrate to diluted hydrochloric acid (concentration: 10 g/liter) to have a nitric acid concentration of 10 g/liter, an aluminum ion concentration of 10 g/liter and an ammonium ion concentration of 140 ppm, with an alternating current applied thereto. The temperature of the acid solution used herein was 55° C.

The radial AC-electrolytic cell described in the section of "(2-1) AC-electrolytic Surface-Roughening Treatment" was used herein, and this was equipped with a liquid supply nozzle through the bottom of the cell body.

The alternating current was so applied to the aluminum web passing through the AC-electrolytic cell that the quantity of electricity to achieve the anodic reaction on the web could be 200 coulombs/dm$^2$.

The alternating current applied to the cell has a trapezoidal waveform and has a frequency of 60 Hz, and its pulse rise up time, Tp, is 0.2 millisecond. The peak current Iap on the anode cycle side, and the peak current Icp on the cathode cycle side are both 50 A/dm$^2$; and the ratio Icp/Iap is 1.0. The current duty is 0.5.

In the AC-electrolytic cell, the quiescent time was 0.5 second in the liquid supply nozzle and 0.017 seconds in the insulator.

From the temperature and the electroconductivity of the aqueous nitric acid solution in the cell and from the speed of ultrasonic propagation through the solution therein, the nitric acid concentration, the aluminum ion concentration and the ammonium ion concentration of the solution were monitored. During the process of electrolysis, 67 wt. % concentrated nitric acid and water were appropriately introduced into the cell through the liquid supply nozzle in accordance with the quantity of electricity applied to the cell, while the excess aqueous nitric acid solution was kept overflowing from it, to thereby control the nitric acid concentration, the aluminum ion concentration and the ammonium ion concentration of the bath in the cell to be all the time constant.

(5) Second Etching:

An aqueous alkali solution having a sodium hydroxide concentration of 26% by weight and an aluminum ion concentration of 6.5% by weight and having a liquid temperature of 45° C. was sprayed onto the both surfaces of the aluminum web to such an extent that the amount of aluminum web dissolution could be 1 g/m$^2$.

In this step, the sodium hydroxide concentration and the aluminum ion concentration of the alkali solution used were controlled in the same manner as in the first etching step (2).

(6) Second Desmutting:

The same aqueous sulfuric acid solution as that used in the first desmutting step (3) was sprayed onto the both surfaces of the aluminum plate for 10 seconds.

The relationship between the sulfuric acid concentration and the aluminum ion concentration of the aqueous sulfuric acid solution, and the temperature, the specific gravity and the electroconductivity of the solution was previously obtained. During this second desmutting process, the temperature, the specific gravity and the electroconductivity of the aqueous sulfuric acid solution being used were monitored, and on the basis of their data, water and 50 wt. % concentrated sulfuric acid were appropriately added to the processing solution so that the sulfuric acid concentration and the aluminum ion concentration of the solution could be kept all the time constant during the process.

(7) Anodic Oxidation:

In an aqueous sulfuric acid solution containing 100 g/liter of sulfuric acid and 5 g/liter of aluminum ions and having a bath temperature of 50° C., the aluminum web having been finally desmutted in the previous step (6) was subjected to anodic oxidation, with a direct current applied thereto. The condition for the anodic oxidation was so controlled that the amount of the oxide film formed on the web could be 2.4 g/m$^2$.

The sulfuric acid concentration and the aluminum ion concentration in the aqueous sulfuric acid solution used in this treatment were controlled in the same manner as in the second desmutting step (6).

<<Fabrication of Planographic Printing Plate Precursors>>

On the surface of the support for planographic printing plates that had been roughened according to the process mentioned above, formed were an undercoat layer and a photosensitive plate layer. The plate layer was formed by applying a photosensitive resin solution onto the undercoat layer and drying it thereon. The positive, planographic printing plate precursor thus fabricated has a dry film thickness of 2.0 g/m$^2$.

The precursor was imagewise exposed and then developed into a planographic printing plate.

The non-image part of the planographic printing plate was observed with a scanning electronic microscope, and it confirmed the formation of uniform honeycomb pits therein.

<<Evaluation>>

The planographic printing plate was tried in printing. After thus tried, its surface was visually checked as to how it was stained, and the staining resistance of the printing plate was evaluated. The result is given in Table 5 below.

Comparative Example 1

A planographic printing plate support was produced in the same manner as in Example 1 except for the following points.

The first desmutting treatment (3) was effected in an aqueous nitric acid solution having a nitric acid concentration of 10 g/liter. The temperature of the solution was 40° C.

For the AC-electrolytic surface-roughening treatment (4), two same radial AC-electrolytic cells as that used in Example 1 were connected in series and used for AC electrolysis.

For the AC electrolysis, used was an aqueous nitric acid solution having an nitric acid concentration of 10 g/liter and an aluminum ion concentration of 5 g/liter. Its temperature was 40° C.

In each radial AC-electrolytic cell, a trapezoidal alternating current was applied between the carbon counter electrode and the aluminum web. Its pulse rise up time, Tp, was 1.5 milliseconds.

The time which the aluminum web took while it moves from the upstream cell to the downstream cell was 10 seconds, for which the aluminum web received no AC.

In both the upstream and downstream cells, the AC applied to the aluminum web was so controlled that the quantity of electricity to achieve the anodic reaction on the web passing through the two cells could be 100 coulombs/dm$^2$.

Except the above, the process and the condition for producing the support herein were the same as those in Example 1. Also in the same manner as in Example 1, a plate layer was formed on the roughened surface of the support to fabricate a planographic printing plate precursor.

The precursor was imagewise exposed and then developed into a planographic printing plate.

The non-image part of the planographic printing plate was observed with a scanning electronic microscope, and it confirmed that the honeycomb pits formed therein were obviously non-uniform as compared with those in Example 1.

In addition, as is obvious from the results given in Table 5, the non-image part of the planographic printing plate was, after tried in printing, much stained with ink.

Example 2

A planographic printing plate support was produced in the same manner as in Example 1, and it was passed through a boiling pure water to thereby seal the micropores in the oxide film formed on the support.

The support thus having been subjected to the pore-sealing treatment was then dipped in an aqueous sodium silicate solution having a sodium silicate concentration of 2.5% by weight and having a liquid temperature of 70° C., for 14 seconds to thereby make the surface thereof hydrophilic.

The relationship between the sodium silicate concentration of the aqueous sodium silicate solution to be used for this treatment, and the liquid temperature and the electroconductivity of the solution was previously obtained. During the process of this treatment, the liquid temperature and the electroconductivity of the aqueous sodium silicate solution being used were monitored to know the sodium silicate concentration of the solution; and water and stock sodium silicate No. 3 were added to the solution so that the solution could have all the time the predetermined constant sodium silicate concentration during the process.

After the surface of the support was thus made hydrophilic, a plate layer was formed thereon in the same manner as in Example 1. The resulting, planographic printing plate precursor was processed to have an image thereon, and a planographic printing plate was thus finished.

The non-image part of the planographic printing plate was observed with a scanning electronic microscope, and it confirmed the formation of uniform honeycomb pits therein.

In the same manner as in Example 1, the planographic printing plate was tested for its printing properties. It confirmed that the printing plate is good. The result is given in Table 5.

Example 3

A planographic printing plate support was produced in the same manner as in Example 1, and it was dipped in an aqueous sodium silicate solution having a sodium silicate concentration of 2.5% by weight and having a liquid temperature of 70° C., for 5 seconds to thereby make the surface thereof hydrophilic. Next, this was washed by spraying it with water, and then dried.

After dried, this was processed in the same manner as in Example 1 to form a plate layer on its surface. The resulting, planographic printing plate precursor was then processed to have an image thereon, and a planographic printing plate was thus finished. The non-image part of the planographic printing plate was observed with a scanning electronic microscope, and it confirmed the formation of uniform honeycomb pits therein.

In the same manner as in Example 1, the planographic printing plate was tested for its printing properties. It confirmed that the printing plate is good like those of Examples 1 and 2. The result is given in Table 5.

Example 4

A planographic printing plate support was produced in the same manner as in Example 1, and this was dipped in an aqueous 1.5 wt. % polyvinylsulfonic acid solution having a liquid temperature of 70° C. for 5 seconds to thereby making the surface of the plate hydrophilic.

The relationship between the polyvinylsulfonic acid concentration of the aqueous solution to be used for this treatment, and the temperature and the electroconductivity of the solution was previously obtained. During the process of this treatment, the liquid temperature and the electroconductivity of the aqueous solution being used were monitored to know the polyvinylsulfonic acid concentration of the solution; and water and stock polyvinylsulfonic acid were added to the solution so that the solution could have all the time the predetermined constant acid concentration during the process.

After being made hydrophilic in such a manner, the support was washed by spraying it with water, and then dried.

After dried, this was processed in the same manner as in Example 1 to form a plate layer on its surface. The resulting, planographic printing plate precursor was then processed to have an image thereon, and a planographic printing plate was thus finished.

The non-image part of the planographic printing plate was observed with a scanning electronic microscope, and it confirmed the formation of uniform honeycomb pits therein.

In the same manner as in Example 1, the planographic printing plate was tested for its printing properties. It confirmed that the printing plate is good like those of Examples 1 and 2. The result is given in Table 5.

Example 5

A planographic printing plate support was produced in the same manner as in Example 1, for which, however, an aluminum plate made from a regenerated aluminum ingot having a composition shown in Table 4 below was used. In the process of the steps (1) to (7) for surface-roughening the aluminum plate for this, the mechanical surface-roughening step (1) was omitted.

TABLE 4

(unit: wt. %)

| Fe | Si | Cu | Ti | Mn | Mg | Zn | Cr | Total of other impurities | Al |
|---|---|---|---|---|---|---|---|---|---|
| 0.45 | 0.27 | 0.19 | 0.03 | 0.83 | 0.9 | 0.12 | 0.03 | 0.01 | balance |

The surface of the support was observed with a scanning electromicroscope, and it confirmed the formation of uniform honeycomb pits therein.

On the roughened surface of the support, formed was a plate layer in the same manner as in Example 1, and the resulting, planographic printing plate precursor was imagewise exposed and developed to give a planographic printing plate.

In the same manner as in Example 1, the planographic printing plate was tested for its printing properties. Its printability was good, and its non-image part was not seriously stained with ink. The result is given in Table 5.

TABLE 5

| | Staining of Non-Image Part of Planographic Printing Plate (blanket staining) |
|---|---|
| Example 1 | A |
| Example 2 | A |
| Example 3 | A |
| Example 4 | A |
| Example 5 | A |
| Comp. Example 1 | C |

A: Excellent, B: Good, C: Average.

As described in detail hereinabove, this embodiment of the invention provides a method for producing planographic printing plate supports in which even aluminum plates prepared from regenerated aluminum ingots are usable and the supports produced realize good planographic printing plates of excellent printing durability causing neither serious ink stains in printed matters nor blanket staining.

Third Embodiment:

<<Method for Producing Planographic Printing Plate Supports>>

In this embodiment, planographic printing plates supports are produced by preparing a web-like aluminum or aluminum alloy plate followed by processing it for at least surface roughening and anodic oxidation.

Concretely, the surface-roughening treatment in the method preferably comprises at least (1) a degreasing step of removing the rolling oil from the aluminum alloy plate, (2) a mechanical surface-roughening step and an alkali-etching step, (3) an electrolytic surface-roughening step, and (4) a desmutting step. After having been surface-roughed in that manner, the plate is then subjected to (5) anodic oxidation to be finally a support for planographic printing plates. The method for producing the planographic printing plate support is described in detail hereinunder.

<Material for Aluminum Alloy Plate>

The material for the aluminum alloy plate to be processed herein may be any known one, described, for example, in *Aluminum Handbook,* 4th Ed. (1990, by the Light Metal Association of Japan). It includes, for example, aluminum alloys of JIS1050, JIS1100, JIS3003, JIS3103 and JIS3005. For use herein, however, preferred are aluminum alloy plates of virgin aluminum alloys, aluminum scraps or secondary aluminum ingots having an aluminum (Al) content of from 95 to 99.4% by weight and containing at least five of iron (Fe), silicon (Si), copper (Cu), magnesium (Mg), manganese (Mn), zinc (Zn), chromium (Cr) and titanium (Ti).

For use in this embodiment, preferred are aluminum alloy plates having an Al content of from 95 to 99.4% by weight. Those of which the Al content is larger than 99.4% by weight are undesirable, since their tolerance for impurities is reduced and their effect for lowering the production costs will lower. However, those of which the Al content is smaller than 95% by weight are also undesirable, since their impurity content increases and they will be cracked or damaged while rolled. More preferably, the Al content of the aluminum alloy plates for use herein falls between 95 and 99% by weight, even more preferably between 95 and 97% by weight.

The other matters of the aluminum alloy plates for use herein, including the content of the impurities such as Fe, Si and Cu, are the same as those of the aluminum plates for use in the first embodiment mentioned hereinabove, and their details are omitted herein.

<Electrolytic Surface-Roughening Step>

This is for electrochemically roughening the surface of an aluminum alloy plate in an acid solution with an alternating current applied to the plate that serves as an electrode, and differs from the mechanical surface-roughening treatment that will be mentioned hereinunder.

The acid solution to be used in this embodiment may be any ordinary one generally used for electrochemical surface-roughening treatment with a direct current or an alternating current, for which, however, preferred is an acid solution consisting essentially of hydrochloric acid or nitric acid. The wording "consisting essentially of" used herein means that the component directed to by it in the aqueous solution amounts to at least 30% by weight, preferably at least 50% by weight of all the components constituting the solution. The same shall apply to the other components of the solution.

As so mentioned hereinabove, the acid solution consisting essentially of nitric acid may be any and every one generally used for electrochemical surface-roughening treatment with a direct current or an alternating current. For example, it may be prepared by adding at least one nitrate compound such as aluminum nitrate, sodium nitrate and ammonium nitrate to an aqueous nitric acid solution having a nitric acid concentration of from 5 to 15 g/liter, to a degree falling between 0.01 g/liter and the saturation concentration of the compound. The acid solution consisting essentially of nitric acid may further contain metals that are generally in aluminum alloys, such as iron, copper, manganese, nickel, titanium, magnesium and silicon, dissolved therein.

Preferably, the acid solution consisting essentially of nitric acid contains nitric acid, an aluminum salt and a nitrate, and is prepared by adding aluminum nitrate and ammonium nitrate to an aqueous nitric acid solution having a nitric acid concentration of from 5 to 15 g/liter, so that the resulting solution may contain from 1 to 15 g/liter, more preferably from 1 to 10 g/liter of aluminum ions and from 10 to 300 ppm of ammonium ions. The aluminum ions and the ammonium ions in the solution spontaneously increase while the solution is used for electrochemical surface to be used for the treatment preferably falls between 10 and 95° C., more preferably between 40 and 80° C.

Like that of essentially nitric acid, the acid solution consisting essentially of hydrochloric acid for use herein may be any and every one generally used for electrochemical surface-roughening treatment with a direct current or an alternating current. For example, it may be prepared by adding at least one chloride compound such as aluminum chloride, sodium chloride and ammonium chloride to an aqueous hydrochloric acid solution having a hydrochloric acid concentration of from 5 to 15 g/liter, to a degree falling between 0.01 g/liter and the saturation concentration of the compound. The acid solution consisting essentially of hydrochloric acid may further contain metals that are generally in aluminum alloys, such as iron, copper, manganese, nickel, titanium, magnesium and silicon, dissolved therein.

The alternating current waveform for the electrochemical surface-roughening treatment is so designed that the time, Tp, for which its current rises from 0 (zero) to the peak falls between 1.5 and 6 msec. If Tp is shorter than 1.5 msec, uniform crater-like pits are difficult to form in the roughened surface of the aluminum alloy plate; but if longer than 6 msec, the profile of the roughened surface thereof will be unstable. Preferably, Tp falls between 2 and 5 msec, more preferably between 2.5 msec and 4.5 msec.

Satisfying the condition of Tp as above, usable herein is AC of any type of sine waves (50 Hz or 60 Hz commercial AC), rectangular waves, trapezoidal waves and triangular waves. Especially preferred is sine-wave or trapezoidal-wave AC. In case where a sine-wave AC (commercial AC) is used herein, its waveform may be modified through fringe angle control with a thyristor. Using the thus-modified sine-wave AC, the roughened surface may have any desired profile advantageous for industrial use. The commercial AC for use herein may be a single-phase AC or a three-phase AC. Preferred is a sine-wave AC modified through phase-angle control. In case where a trapezoidal-wave AC is used herein, its rise up time may be modified. Using the thus-modified trapezoidal-wave AC, the roughened surface may have any desired profile advantageous for industrial use.

Figure 3:
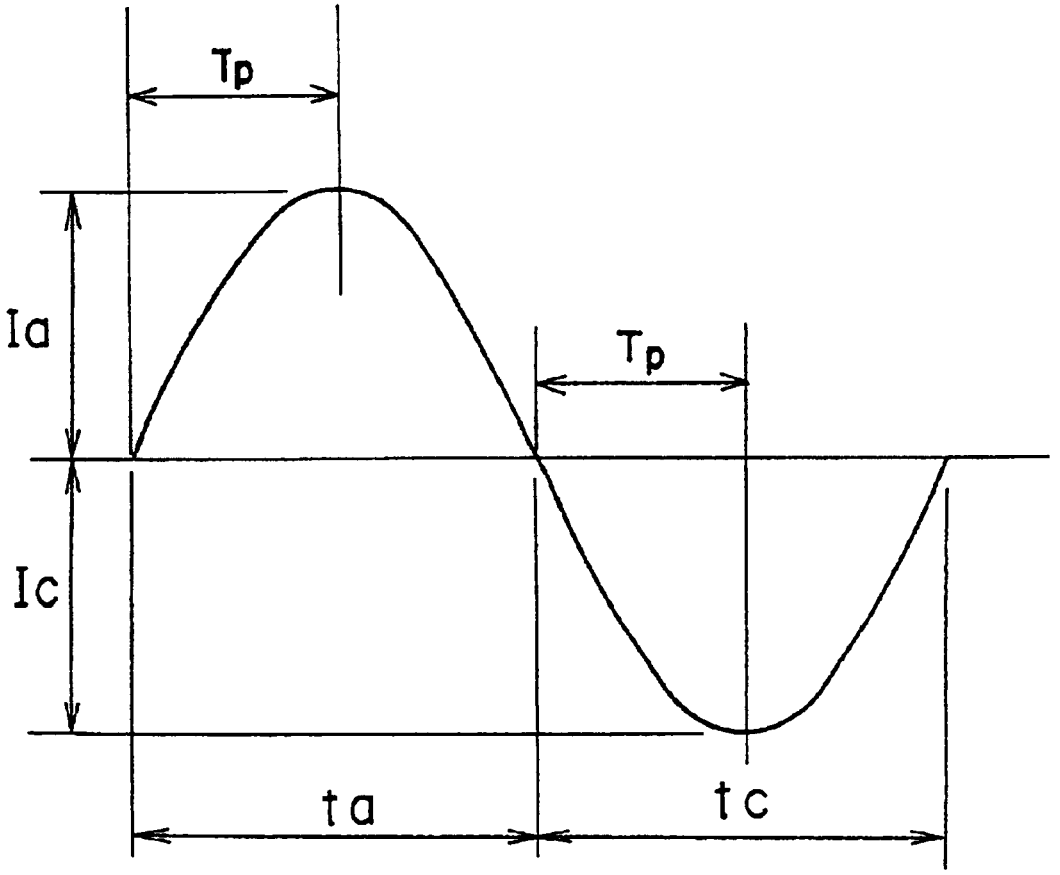
FIG. 3 is an explanatory view showing one example of the alternating current waveform (sine wave) for the third embodiment of the invention.
Figure 4:
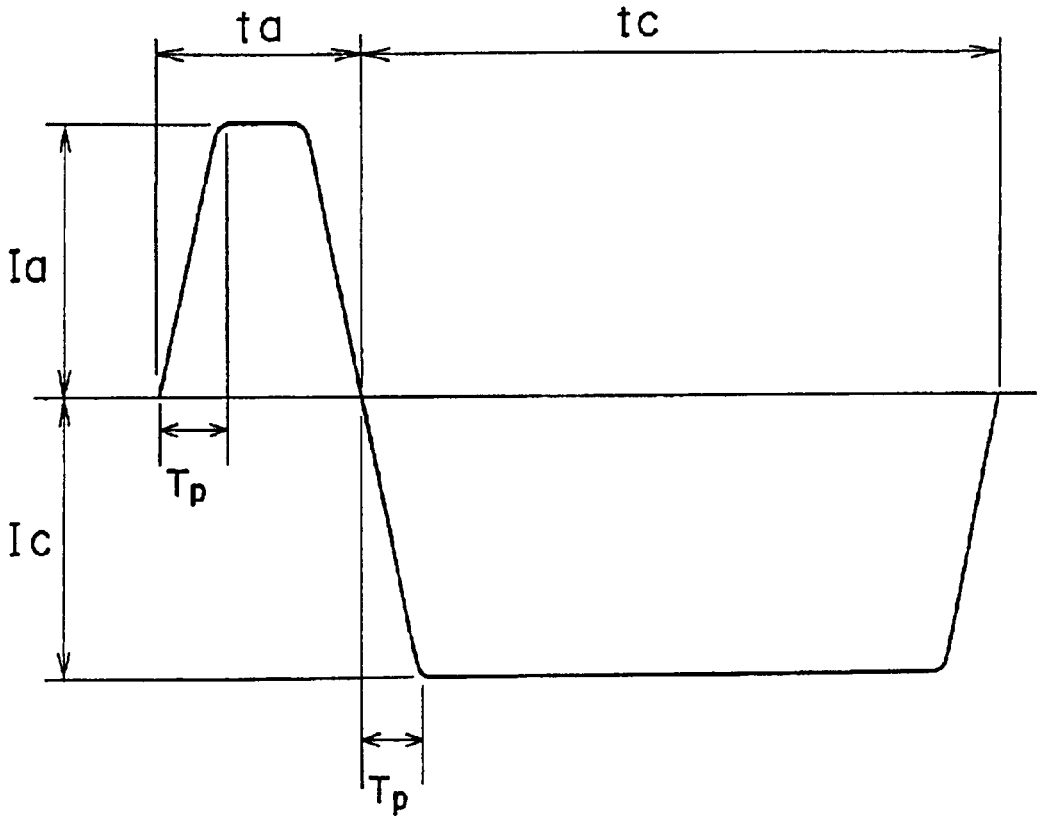
FIG. 4 is an explanatory view showing one example of the alternating current waveform (trapezoidal wave) for the third embodiment of the invention.

The frequency of AC for use herein preferably falls between 40 and 150 Hz, more preferably between 50 and 120 Hz, even more preferably between 50 and 60 Hz. FIG. 3 and FIG. 4 show one example of sine waveforms and trapezoidal waveforms, respectively, that are preferably used in this embodiment. The sine waveform and the trapezoidal waveform both have a longer rise up time, and the voltage for them can be reduced in planning power sources. The low-voltage power sources are inexpensive.

The alternating current for the electrochemical surface-roughening treatment in this embodiment is preferably so controlled that the ratio of the quantity of electricity QA of the alternating current applied to the aluminum alloy plate acting as an anode, to the quantity of electricity QC thereof applied to the aluminum plate acting as a cathode, QC/QA falls between 0.9 and 1, more preferably between 0.95 and 0.99.

The AC duty in the electrochemical surface-roughening treatment may fall between 0.25 and 0.5, but preferably between 0.33 and 0.5 for easy construction of power sources. The AC duty referred to in this embodiment is indicated by ta/T in which T is the AC current period and ta is the time for anodic reaction of the aluminum alloy plate.

Through its cathodic reaction, the surface of the aluminum alloy plate receives a smut component of essentially aluminum hydroxide formed thereon, and, in addition, the oxide film formed thereon will be dissolved or broken. The dissolved or broken part of the oxide film may be the start point for the pitting reaction in the next-stage anodic reaction of the aluminum alloy plate. Accordingly, the appropriate selection of the AC duty in this treatment has a great influence on the uniformity of the roughened surface of the plate. However, in view of the producibility of the power sources for use herein, the more preferred range of the AC duty falls between 0.33 and 0.5.

Regarding the current density of trapezoidal or rectangular AC waves for use herein, the peak current Ia in the anode cycle of the AC and the peak current Ic in the cathode cycle thereof preferably fall between 10 and 200 $A/dm^2$ each. Ic/Ia preferably falls between 0.9 and 1.5. Also preferably, the total quantity of electricity for the anodic reaction of the aluminum plate from the start to the finish of the electrochemical surface-roughening treatment falls between 50 and 800 $C/dm^2$.

The AC-electrolytic cell for the electrochemical surface-roughening treatment in this embodiment may be any known one, including, for example, vertical, flat and radial cells. The power-supply system for the aluminum alloy plate to be processed in the cell may be a direct power-supply system with a conductor roll, or an in-liquid power-supply system (indirect supply system) with no conductor roll.

The electrolytic solution to pass through the electrolytic cell may run therethrough in the direction parallel to or opposite to the direction of the aluminum web (aluminum alloy plate) traveling therethrough. One or more AC sources may be connected to one electrolytic cell. Two or more electrolytic cells may be used for the treatment.

In the indirect power-supply system, it is desirable that the ratio of the quantity of electricity to be applied to the aluminum alloy plate acting as an anode to the quantity of electricity to be applied to it acting as a cathode is controlled according to the method of using auxiliary anodes described in JP-B 37716/1994 and 42520/1993. Especially preferably, in this, the current to pass through the auxiliary anodes are controlled by commutators such as thyristors, diodes, GTO. According to the method described in JP-B 37716/1994, it is easy to control both the quantity of electricity (current) of AC to be applied to the aluminum alloy plate of which the surface is electrochemically roughened while the plate acts as an anode relative to the main carbon electrode, and that to be applied thereto while the plate acts as a cathode. Another advantage of the method is that the power source devices for it are inexpensive to construct because they receive little influence of magnetic deviation of transformers.

For controlling the current value in the electrochemical surface-roughening treatment with a sine-wave AC, any of transformers and variable inductance regulators may be used. In this case, the current value for the electrolysis is fed back to the variable inductance regulator used. For controlling the current value in this case, a thyristor may be used for phase control, as in JP-A 25381/1980.

In the electrochemical surface-roughening treatment, if the distance between the aluminum alloy plate being processed and the counter electrode and also the liquid flow rate in the cell are not kept constant, the current flow will be localized, and if so, the surface of the aluminum alloy plate will be unevenly processed. The aluminum alloy plates thus unevenly processed are unsuitable for planographic printing plate supports. To solve the problem, a chamber to store the processing liquid therein may be provided in the line, and the processing liquid may be sprayed onto the aluminum web through a liquid supply nozzle having 1 to 5 mm-wide slits aligned in the lateral direction of the aluminum web. More preferably, two or more such liquid storage chambers are provided in the line, and these are connected with each other via a pipe provided with a valve and a liquid meter by which the amount of the processing liquid to be sprayed onto the aluminum web through the slits of the liquid supply nozzle is controlled.

Preferably, the distance between the aluminum alloy plate and the electrode in the electrolytic cell falls between 5 and 100 mm, more preferably between 8 and 15 mm. For keeping the distance constant, the system described in JP-B 30036/1986 may be used, in which the traveling aluminum alloy plate is hydrostatically pressed against a sliding surface on which the plate slides while it passes through the electrolytic cell. For this, also employable is the method described in JP-A 300843/1996, in which the distance between the electrode and the aluminum alloy plate is kept constant by the use of a large-diameter roller.

For electrochemically surface-roughening the aluminum alloy plate in a direct power-supply system, preferred is using the conductor roll described in JP-A 177441/1983 in the apparatus described in JP-A 123400/1981. The conductor roll may be provided either above or below the aluminum alloy plate, but it is desirable to provide it above the aluminum alloy plate in such a manner that the thus-disposed conductor roll is pressed against the aluminum alloy plate by means of a nipper. The length for which the aluminum alloy plate is kept in contact with the conductor roll preferably falls between 1 mm and 300 mm in the machine direction. A pass roll is provided on the other side opposite to the side of the conductor roll so that the aluminum alloy plate runs between the two rolls. The pass roll is preferably made of rubber. The pressure of the conductor roll and the hardness of the rubber roll are defined in any desired manner, not causing arc spots in the aluminum alloy plate processed. Providing the conductor roll above the aluminum alloy plate facilitates the exchange and the maintenance of the roll. Preferably, the conductor roll is so designed that the rotor at its edge is driven by a power-supply brush disposed in contact with the rotor.

Also preferably, the conductor roll pressed against the aluminum alloy plate is all the time kept cooled with an electrolytic solution of which the composition and the temperature are the same as those of the electrolytic solution used for electrochemically surface-roughening the plate, in order to prevent the plate from having arc spots in its roughened surface. If the electrolytic solution applied to the conductor roll for cooling it is contaminated with impurities, it will cause arc spots in the roughened surface of the aluminum alloy plate. To evade the trouble, it is desirable that the cooling liquid spray is protected by a filter cloth cover or the like, or a fine-mesh filter is disposed in the duct upstream the spray nozzle.

Figure 5:
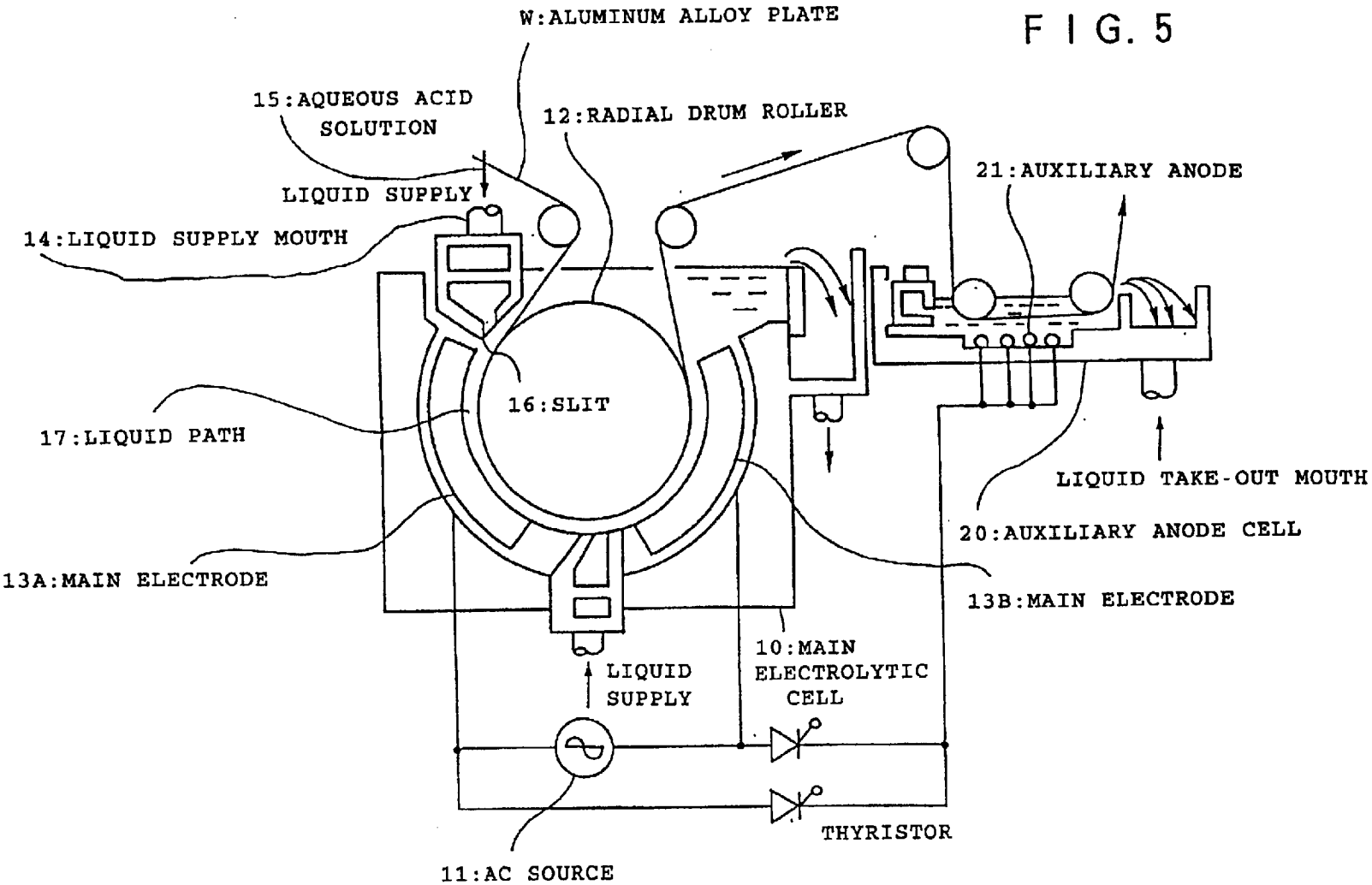
FIG. 5 is a graphic view showing one example of the device usable for electrolytic surface-roughening treatment in the third embodiment of the invention.

The electrolytic device for the surface-roughening treatment may be any known one, including, for example, vertical, flat and radial electrolytic devices. Especially preferred is a radial electrolytic device as in JP-A 165300/1993. FIG. 5 is a schematic view showing the radial electrolytic device used in this embodiment. As in FIG. 5, the aluminum alloy plate W introduced into the radial electrolytic device is wound around the radial drum roller 12 disposed in the main electrolytic cell 10, and while traveling in the cell 10, the plate W is electrolyzed by the action of the main electrodes 13*a*, 13*b* connected to the AC source 11. An acid solution 15 is fed into a liquid supply unit through the liquid supply mouth 14, and, via the slit 16, it is led into the liquid path 17 between the radial drum roller 12 and the main electrodes 13*a*, 13*b*. Next, the aluminum alloy plate W thus processed in the main electrolytic cell 10 is again electrolyzed in the auxiliary anode cell 20. In the cell 20, disposed are auxiliary anodes 21 to face the aluminum alloy plate W traveling thereon. The acid solution 15 is led into the cell 20 so as to flow between the auxiliary anodes 21 and the aluminum alloy plate W. The auxiliary anodes 21 may be selected from known oxygen-generating electrodes, for example, those of ferrite, iridium oxide or platinum, or those of platinum cladded or plated with a bulb metal such as titanium, niobium or zirconium. The main electrodes 13*a*, 13*b* may be selected from cathodes of carbon, platinum, titanium, niobium, zirconium or stainless steel, or from those for fuel cells. Especially preferred is carbon. The carbon for the electrodes may be commercially-available non-permeable graphite for chemical devices, or resin-containing graphite.

The flowing direction of the acid solution to be led into the main electrolytic cell 10 and the auxiliary anode cell 20 may be parallel to or opposite to the traveling direction of the aluminum alloy plate W. The relative flow rate of the acid solution to the aluminum alloy plate preferably falls between 10 and 1000 cm/sec.

One or more AC sources may be connected to one electrolytic device. If desired, two or more electrolytic devices may be used, and the electrolytic condition in each device may be the same or different.

After thus electrolyzed, the aluminum alloy plate is preferably passed between a pair of nip rollers to remove the processing solution from it and then sprayed with water in order that the plate does not carry the processing solution to the next step.

In the electrolytic surface-roughening step, it is also desirable that nitric acid and water are appropriately added to the processing acid solution, in proportion to the current applied to the acid solution that anodically reacts with the aluminum alloy plate in the device, thereby to keep the concentration of the acid solution in the device all the time constant during the process. For this, for example, based on the data of the nitric acid concentration and the aluminum ion concentration of the acid solution that are derived from (i) the electroconductivity of the acid solution, (ii) the speed of ultrasonic propagation through the solution and (iii) the temperature of the solution monitored in the process, the amount of nitric acid and water to be added to the processing acid solution is controlled, and the same volume of the acid solution as that of the nitric acid and water added to the solution is kept successively overflowing from the device.

Prior to the electrolytic surface-roughening treatment, the aluminum alloy plate is preferably dipped in an aqueous dimethylaminoborane solution to activate its surface, as in JP-A 239852/2000. If a copper component is partly segregated on the surface of the aluminum alloy plate to be electrochemically roughened, the part having the copper component thereon could not be well roughened and will cause surface defects. To solve the problem, the aluminum alloy plate is previously dipped in an aqueous dimethylaminoborane solution to activate its surface. The thus-activated surface is uniformly roughened with no surface defects, and the thus-processed aluminum alloy plate is favorable for planographic printing plate precursors.

In the treatment, dimethylaminoborane acts as a reducing agent for activating copper that exists on the surface of the aluminum alloy plate. Its amount to be applied to the plate preferably falls between 1.0 and 10 g/liter.

The solution of the activating agent as above may contain any other components, such as aluminum salt, surfactant. The temperature for the activation treatment preferably falls between 20 and 60° C.; and the time for dipping the aluminum alloy plate in the solution or for spraying it with the solution may fall between 1 and 30 seconds.

<Mechanical Surface-Roughening Step, Alkali-Etching Step, Desmutting Step>

Preferably, the aluminum alloy plate is processed for mechanical surface roughening, alkali-etching and desmutting, before it is electrolytically surface-roughened (which will be referred to as "the first-stage treatment" hereinafter) and/or after it is electrolytically surface-roughened but before processed for anodic oxidation (which will be referred to as "the second-stage treatment" hereinafter). If desired, it may be etched with acid. However, these processing steps are merely for demonstrating some examples of the process of this embodiment, to which, therefore, the invention is not whatsoever limited. Needless-to-say, these processing steps the other steps mentioned below are optional steps.

(Mechanical Surface-Roughening Step)

The aluminum alloy plate is optionally processed for mechanically roughening its surface. For it, for example, the plate is roughened with a brush or the like. Preferably, the mechanical surface-roughening treatment is the first-stage treatment to be effected prior to the above-mentioned electrolytic surface-roughening treatment.

For mechanically surface-roughening it, the aluminum alloy plate is preferably processed with a rotary nylon brush roll having a hair diameter of from 0.07 to 0.57 mm while an abrasive slurry is applied onto the surface of the plate. The abrasive agent to be used may be any known one. For it, for example, preferred are siliceous sand, quartz, aluminum hydroxide and their mixtures, as in JP-A 135175/1994 and JP-B 40047/1875.

The specific gravity of the abrasive slurry preferably falls between 1.05 and 1.3. For applying the abrasive slurry onto the surface of the aluminum alloy plate, for example, employable is a method of spraying the plate with the slurry; or a method of applying the slurry to the plate with a wire brush. Also employable for mechanically surface-roughening the aluminum alloy plate is a method of transferring the surface profile of an embossed pressure roll to the surface of the plate. Further employable are the methods described in JP-A 074898/1980, 162351/1986 and 104889/1988. Apart from those, also employable is a method of brushing the surface of the aluminum alloy plate in an aqueous slurry that contains a mixture of alumina and quartz grains in a ratio by weight falling between 95/5 and 5/95, as in International Patent Publication No. 509108/1997. In this method, the volume-average grain size of the grains constituting the mixture preferably falls between 1 and 40 μm, more preferably between 1 and 20 μm.

The water absorbability of the nylon brush for use herein is preferably low. For it, for example, preferred is Toray's Nylon Bristle 200 T of 6,10-nylon. It has a softening point of 180° C.; a melting point falling between 212 and 124° C.; a specific gravity falling between 1.08 and 1.09; a water content falling between 1.4 and 1.8 at 20° C. and 65% RH, and between 2.2 and 2.8 at 20° C. and 100% RH; a dry tensile strength falling between 4.5 and 6 g/d; a dry tensile elongation falling between 20 and 35%; a boiling water shrinkage falling between 1 and 4%; a dry tensile resistance falling between 39 and 45 g/d; and a Young's modulus (in dry) falling between 380 and 440 kg/mm$^2$.

(Alkali-Etching Step)

It is desirable that the surface of the aluminum alloy plate is chemically etched in an aqueous alkali solution in both the first-stage treatment and the second-stage treatment. The concentration of the aqueous alkali solution to be used preferably falls between 1 and 30% by weight, and the solution may contain not only aluminum but also any other alloying components that are in the aluminum alloy plate. The additional metal content of the solution may fall between 0.5 and 10% by weight.

For the aqueous alkali solution, especially preferred is an aqueous solution consisting essentially of sodium hydroxide.

The liquid temperature of the aqueous alkali solution for the alkali-etching treatment to be effected before the electrochemical surface-roughening treatment or after the mechanical surface-roughening treatment preferably falls between room temperature and 95° C.; and the time for the treatment preferably falls between 1 and 120 seconds. The amount of dissolution of the aluminum alloy plate etched in this treatment preferably falls between 1 and 15 g/m$^2$, more preferably between 3 and 10 g/m$^2$. In case where the chemical etchants are mixed to prepare the aqueous alkali solution, it is desirable to use liquid sodium hydroxide and sodium aluminate for the etchants.

After thus etched with the alkali solution, the aluminum alloy plate is preferably passed between a pair of nip rollers to remove the processing solution from it and then sprayed with water in order that the plate does not carry the processing solution to the next step.

(Acid-Etching Step)

If desired, the aluminum plate alloy may be chemically etched with an acid solution. Preferably, the acid-etching treatment is effected in the second-stage treatment. Also preferably, it may be effected after the alkali-etching treatment. Concretely, the aluminum alloy plate having been etched with an alkali solution, is further etched with an acid solution, whereby silica and other intermetallic compounds and also a single substance Si existing on its surface are removed. This is favorable as reducing the defects of the oxide film to be formed on the plate in the subsequent treatment of anodic oxidation.

The acid employable for the acid etching treatment includes, for example, phosphoric acid, nitric acid, sulfuric acid, chromic acid, hydrochloric acid and their mixed acids. Preferred is an aqueous sulfuric acid solution. The concentration of the acid solution preferably falls between 300 and 500 g/liter, and the solution may contain not only aluminum but also any other alloying components of the aluminum alloy plate.

Preferably, the liquid temperature for the acid-etching treatment fall between 60 and 90° C., more preferably between 70 and 80° C.; and the time for the treatment preferably falls between 1 and 10 seconds. The amount of dissolution of the aluminum alloy plate to be etched in this treatment preferably falls between 0.01 and 0.2 g/m$^2$. Also preferably, the acid concentration, for example, the sulfuric acid concentration, and the aluminum ion concentration of the acid solution are so defined that the solution forms no crystal at room temperature. The preferred aluminum ion concentration of the acid solution falls between 0.1 and 15 g/liter, more preferably between 5 and 15 g/liter.

After thus etched with acid, the aluminum alloy plate is preferably passed between a pair of nip rollers to remove the processing solution from it and then sprayed with water in order that the plate does not carry the processing solution to the next step.

(Desmutting Step)

In case where the aluminum alloy plate is chemically etched with an aqueous alkali solution, it generally receives smut formed on its surface. Preferably, therefore, the thus-etched aluminum alloy plate is desmutted by processing it with an acid solution that contains any of phosphoric acid, nitric acid, sulfuric acid, chromic acid, hydrochloric acid or mixed acids of two or more such acids. Preferably, the desmutting treatment is appropriately effected in both the first-stage treatment and the second-stage treatment. More preferably it is effected after the alkali-etching treatment.

The concentration of the acid solution (concretely, the sulfuric acid concentration in case where acid solution is a sulfuric acid solution) preferably falls between 250 and 500 g/liter. Also preferably, the acid solution contains from 1 to 15 g/liter of aluminum. In addition, it may contain from 0.001 to 15 g/liter of the other alloying components (except aluminum) of the aluminum alloy plate, dissolved therein.

The liquid temperature of the acid solution for the desmutting treatment preferably falls between 60° C. and 90° C., more preferably between 60 and 70° C. The processing time for the treatment preferably falls between 1 and 180 seconds, more preferably between 1 and 120 seconds, even more preferably between 2 and 60 seconds.

After thus desmutted, the aluminum alloy plate is preferably passed between a pair of nip rollers to remove the processing solution from it and then sprayed with water in order that the plate does not carry the processing solution to the next step.

For the desmutting solution (acid solution), preferably used is the waste of the acid solution used in the previous surface-roughening step, as reducing the waste in the process.

Preferably, the first-stage treatment to be effected prior to the surface-roughening treatment of this embodiment comprises mechanically surface-roughening the aluminum alloy plate and/or etching it with an alkali solution to such a degree that the amount of dissolution of the etched plate falls between 1 and 15 g/m$^2$ (more preferably between 3 and 10 g/m$^2$), followed by desmutting it with an acid solution such as that mentioned above.

Also preferably, the second-stage treatment to be effected after the surface-roughening treatment and before the anodic oxidation (this is described in detail hereinunder) comprises etching the aluminum alloy plate with an acid solution, for example, with an aqueous sulfuric acid solution at 60 to 90° C. for 1 to 10 seconds, or etching it with an aqueous alkali solution to such a degree that the amount of dissolution of the etched plate falls between 0.01 and 5 g/m$^2$, and thereafter desmutting it in an acid solution such as that mentioned above or etching it with an aqueous sulfuric acid solution at 60 to 90° C. for 1 to 10 seconds. When the aluminum alloy plate is etched with an alkali solution, it is desirable that the thus-etched plate is further etched with an acid solution at 60 to 90° C. for 1 to 10 seconds so as to remove silica and other intermetallic compounds as well as the simple substance Si from the surface of the plate. As so mentioned hereinabove, the acid-etched plate is free from the problem of surface defects of the oxide film to be formed thereon through anodic oxidation in the later treatment. As a result, the thus-processed aluminum alloy plate is, when used for the support of printing plates, free from the trouble of spot-like ink stains in the non-image area of printed matters.

After the aluminum alloy plate has been processed in an aqueous acid or alkali solution or has been mechanically surface-roughened with an abrasive agent, it is desirable that the plate is washed to remove the chemicals and the abrasive agent from the surface of the processed plate. For washing it, for example, usable is water or dry ice.

In general, the aluminum alloy plate processed in this embodiment is washed every time before it is processed with different types of chemicals or in different processing tanks. Preferably, the time which the plate takes after it has been processed in a tank and before it is washed, or it takes after it has been washed and before it is introduced into the next tank is 10 seconds or shorter, more preferably falling between 0.1 and 10 seconds. If the time is longer than 10 seconds, the processed surface will be chemically changed and will be unevenly processed in the later steps.

The distance between one processing tank and the next processing time between which the aluminum alloy plate is washed is preferably 15 seconds or shorter, more preferably 5 seconds or shorter in terms of the time to be taken by the plate that is transferred from the previous tank to the next tank. If the time is longer than 15 seconds, the processed surface of the plate will be chemically changed and could not be uniformly roughened in the later steps.

For washing the aluminum alloy plate being processed, preferably employed are the methods mentioned below. For reducing the amount of the washing waste, the method of washing the plate with dry ice powder is especially preferred.

(1) Washing With Water:

For washing the aluminum alloy plate for planographic printing plates, in general, the plate is, after passed between a pair of nip rollers to remove the processing solution from it, exposed to water jets from spray tips. In the method, the water jets are preferably directed to the aluminum alloy plate at an angle of from 45 to 90 degrees toward the downstream of the traveling direction of the plate. The jetting pressure of the washing water may fall generally between 0.5 and 5 $kg/cm^2$ at the tip of the jetting nozzle; and the temperature thereof preferably falls between 10 and 80° C. While washed in that manner, the traveling speed of the aluminum alloy plate preferably falls between 20 and 200 m/min. The amount of water to be applied to the aluminum alloy plate in one washing treatment preferably falls between 0.1 and 10 $liters/m^2$. In one washing tank, washing water is jetted toward the aluminum alloy plate through at least two spray nozzles directed to the top face of the plate and through at least two spray nozzles directed to the back face thereof. One spray nozzle has from 5 to 30 spray tips at pitch intervals of from 50 to 200 mm. Preferably, the jet angle of each spray tip falls between 10 and 15 degrees, and the distance between the aluminum alloy plate and the spray tip jet face falls between 10 and 250 mm. The spray pattern from each spray tip may be ring-shaped, circular, oval, square, or rectangular, but is preferably circular, oval, square or rectangular. The flow distribution (indicating the sprayed water condition on the surface of the aluminum alloy plate) may be ring-like distribution, uniform distribution or mountain-like distribution. In case where plural spray tips are aligned through one spray nozzle, the flow distribution from every one is preferably mountain-like distribution that facilitates uniform flow distribution on the entire surface of the aluminum alloy plate as a whole. The flow distribution varies, depending on the spray pressure and the distance between the spray tips and the aluminum alloy plate. The drop size of the water spray also varies, depending on the structure of the spray tips, the spray pressure and the quantity of the sprayed water, but preferably falls between 10 and 10000 $\mu$m, more preferably between 100 and 1000 $\mu$m. Preferably, the spray nozzles are made of a material resistant to the pressure of the liquid that runs through them at high speed so as not to be abraded by the liquid. Preferred examples of the material are brass, stainless steel, ceramics; and especially preferred are ceramics.

The spray nozzles with spray tips may be disposed at an angle of from 45 to 90 degrees relative to the traveling direction of the aluminum alloy plate. Preferably, they are so disposed that the longer center line of the spray pattern from each spray tip is perpendicular to the traveling direction of the aluminum alloy plate.

The washing time is preferably not longer than 10 seconds, more preferably falling between 0.5 and 5 seconds, from the viewpoint of industrial advantages.

(2) Washing With Dry Ice Powder:

For washing the aluminum alloy plate by jetting dry ice powder onto both surfaces of the plate, employable is any known shot-blasting device such as that described in JP-A 66905/1998. In the device, any known jet nozzles such as those described in JP-A 28901/1998 and 28902/1998 may be aligned on the both sides of the aluminum alloy plate that passes through the device. For example, the jet nozzles may be aligned straight in the traveling direction of the plate. Preferably, however, they are aligned obliquely so that the spray patterns from them may overlap on the plate in the cross direction of the plate. Preferably, the distance between the spray nozzles and the aluminum alloy plate falls between 1 and 100 mm, more preferably between 10 and 50 mm.

For preparing the dry ice powder to be used herein, usable is the device described in J-UM-A 38104/1995. The jetting gas may be $N_2$ or air. The volume-average particle size of the dry ice powder preferably falls between 1 and 1000 $\mu$m, more preferably between 10 and 100 $\mu$m. The amount of $CO_2$ supply (in terms of the solid weight thereof) from one spray nozzle preferably falls between 0.1 and 1 kg/min; and the $CO_2$ pressure preferably falls between 1 and 20 MPa. The washing pressure on the aluminum alloy plate preferably falls between 1 and 20 MPa.

<Anodic Oxidation Step>

In the support production method of this embodiment, the aluminum alloy plate is preferably subjected to anodic oxidation after the surface-roughening treatment or after the second-stage treatment, for further enhancing the abrasion resistance of its surface. Concretely, the aluminum alloy plate is dipped in an electrolytic solution in which the plate serves as an anode, and electrolyzed therein to form an oxide film thereon through anodic oxidation of the plate.

After having been thus processed for anodic oxidation, if desired, the oxide film formed on the aluminum alloy plate may be made hydrophilic or may be further processed for sealing micropores existing therein.

The electrolytic solution to be used for the anodic oxidation of the aluminum alloy plate may be any and every one that acts to form a porous oxide film on the plate. In general, it is sulfuric acid, phosphoric acid, oxalic acid, chromic acid, or their mixture. The concentration of the electrolytic solution may be determined, depending on the type of the electrolyte therein.

The condition for the anodic oxidation could not be determined in a specified manner, as varying depending on the type of the electrolytic solution used. In general, the concentration of the electrolytic solution may fall between 1 and 80% by weight; the temperature thereof may fall between 5 and 70° C.; the current density may fall between 1 and 60 A/cm$^2$; the voltage may fall between 1 and 100 V; and the time of electrolysis may fall between 10 seconds and 300 seconds.

In case where the anodic oxidation is effected according to a sulfuric acid method in which the electrolytic solution used is an aqueous sulfuric acid solution, a direct current is generally applied to the system, but an alternating current may also be used. The amount of the oxide film to be formed through the anodic oxidation may fall between 1 and 10 g/m$^2$, but preferably between 1 and 5 g/m$^2$. If it is smaller than 1 g/m$^2$, the printing durability of the planographic printing plates comprising the aluminum alloy plate that serves as a support will be poor, and the non-image area of the printing plates will be readily scratched. If so, ink adheres to the scratches, therefore often causing ink stains in printed matters. On the other hand, if the amount of the oxide film is larger than 10 g/m$^2$, the oxide film will locally concentrate at the edges of the aluminum alloy plate.

Preferably, the difference between the amount of the oxide film formed in the edges and that in the center part of the aluminum alloy plate is at most 1 g/m$^2$.

The electrolytic solution for the anodic oxidation is preferably an aqueous sulfuric acid solution. Its details are described in JP-A 128453/1979 and 45303/1973. Preferably, the aqueous sulfuric acid solution for use herein has a sulfuric acid concentration falling between 10 and 300 g/liter, and an aluminum ion concentration falling between 1 and 25 g/liter. More preferably, it is prepared by adding aluminum sulfate to an aqueous sulfuric acid solution having a concentration of from 50 to 200 g/liter, to thereby have an aluminum ion concentration falling between 2 and 10 g/liter. The bath temperature in the treatment preferably falls between 30 and 60° C.

In the direct current method of using a direct current, the current density preferably falls between 1 and 60 A/cm$^2$, more preferably between 5 and 40 A/cm$^2$.

In case where the aluminum alloy plate (in the form of a sheet) is continuously processed for anodic oxidation, the profile of the current density to be applied thereto is preferably so controlled that the current density is kept low, falling between 5 and 10 A/cm$^2$ in the initial stage, and then gradually increased in the latter stage to reach 30 to 50 A/cm$^2$ or more, in order to prevent local current concentration that will partly yellow the processed plate. In this mode, it is desirable that the current density is gradually increased in 5 to 15 steps. Also preferably, an independent power source is provided in each step, and the current density to be applied to the aluminum alloy plate is suitably controlled to have the intended profile as above, by controlling the current from the independent power sources. For the power supply, preferred is an in-liquid power-supply system with no conductor roll. In general, the anode may be iridium oxide or lead; and the cathode is aluminum. One example of the anodic oxidation device is described in Japanese Patent Application No. 178624/1999.

The aqueous sulfuric acid solution for the anodic oxidation may contain minor elements that are in the aluminum alloy plate, dissolved therein. During the anodic oxidation, aluminum dissolves out into the aqueous sulfuric acid solution being used in the process. For the process control, the sulfuric acid concentration and the aluminum ion concentration of the processing solution must be monitored. In the process, if the aluminum ion concentration of the processing solution, aqueous sulfuric acid solution is set too low, the solution must be frequently exchanged. If so, the waste increases, and it is uneconomical and problematic in point of the protection of the environment. On the contrary, if the aluminum ion concentration of the processing solution is set high, the voltage for electrolysis increases, and it is uneconomical as the power cost increases.

Regarding the relationship between the sulfuric acid concentration and the aluminum ion concentration of the processing solution for the anodic oxidation, and the temperature thereof, it is desirable that (i) the sulfuric acid concentration of the solution falls between 100 and 200 g/liter, more preferably between 130 and 180 g/liter, the aluminum ion concentration thereof falls between 2 and 10 g/liter, more preferably between 3 and 7 g/liter, and the temperature thereof falls between 30 and 40° C., more preferably between 33 and 38° C., or (ii) the sulfuric acid concentration of the solution falls between 50 and 125 g/liter, more preferably between 80 and 120 g/liter, the aluminum ion concentration thereof falls between 2 and 10 g/liter, more preferably between 3 and 7 g/liter, and the temperature thereof falls between 40 and 70° C., more preferably between 50 and 60° C.

For power supply to the aluminum alloy sheet to be processed for anodic oxidation, employable is any of a direct power-supply system in which the power is directly applied to the plate via a conductor roll, and an in-liquid power-supply system in which the power is indirectly applied to the plate via the electrolytic solution therein.

For the direct power-supply system, generally used is a low-speed low-current density anodic oxidation device in which the aluminum alloy plate is conveyed at a relatively low line speed of 30 m/min or lower; and for the indirect power-supply system, generally used is a high-speed high-current density anodic oxidation device in which the plate is conveyed at a high line speed of higher than 30 m/min.

For the indirect power-supply system, employable is a mountain-shaped or straight cell layout, for example, as in *Continuous Surface Processing Technology* (by the General Technology Center of Japan, Sep. 30, 1986), page 289. High-speed high-current devices are unsuitable to the indirect power-supply system with a conductor roll, as causing sparks between the conductor roll and the aluminum alloy plate running around the roll.

For preventing the conductor roll from sparking and for preventing the aluminum alloy plate from becoming hot, it is desirable that the conductor roll and the part of the aluminum alloy plate passing in air are sprayed with an electrolytic solution having the same composition and the same temperature as those of the electrolytic solution used for the anodic oxidation. The conductor roll may be above or below the aluminum alloy plate.

In case where two or more anodic oxidation cells are used and all the cells are driven according to the direct power-supply system as above, the conductor rolls to be used therein are generally made of aluminum. For prolonging their life, it is desirable that the rolls are produced by homogenizing cast rolls of industrial pure aluminum at a high temperature to thereby convert the Al—Fe crystal matter in the surface thereof into a single phase of $Al_3Fe$ to improve the corrosion resistance of the rolls, as in JP-B 50138/1986.

A large current is applied to the aluminum alloy plate in the step of anodic oxidation of the plate. In the step, therefore, the aluminum alloy plate receives the Lorentz's force from the magnetic field generated by the current running through the bus bar in the device. One problem with it in that condition is that the aluminum alloy plate meanders while processed for anodic oxidation. To solve the problem, preferred is the method described in JP-A 51290/1982.

In addition, from the magnetic field generated by the large current running through it, the aluminum alloy plate further receives Lorentz's force that acts toward the center of the plate in the cross direction thereof. In that condition, therefore, the aluminum alloy plate is often bent while processed for anodic oxidation. To solve the problem, it is desirable to provide plural pass rollers having a diameter of from 100 to 200 mm in each anodic oxidation cell at pitch intervals of from 100 to 3000 mm in such a manner that they overlap at an angle of from 1 to 15 degrees to thereby prevent the aluminum alloy plate from being bent owing to the Lorentz's force which the plate has received.

The amount of the oxide film formed on the aluminum alloy plate through anodic oxidation varies in the cross direction of the plate. Concretely, it is larger at the edges of the plate, and the oxide film formed around the edges thereof is thicker. One problem with it is that the aluminum alloy plate could not be well wound up in a winding device. To solve the problem, the processing solution in the anodic oxidation device is stirred, for example, as in JP-B 30275/1987 and 21840/1980. If the problem could not be well solved even by the method, it is desirable to oscillate the plate-winding device in the cross direction of the plate, at a frequency of from 0.1 to 10 Hz to a degree of amplitude of from 5 to 50 mm. Combining the solution stirring method and the device oscillating method is especially preferred for completely solving the problem.

The aluminum alloy plate for planographic printing plate supports may be roughened on its one surface only or on both surfaces thereof. In the former, one roughened surface of the plate is coated with an undercoat layer, and a photosensitive layer and mat layer are formed thereon to finish final products (one-face planographic printing plate precursors). In the latter, the two roughened surfaces of the plate are both coated with an undercoat layer, and a photosensitive layer and mat layer are formed thereon to finish final products (two-face planographic printing plate precursors).

For its effective use, the anodic oxidation cell must be so designed that it is applicable to both the two cases, one for processing only one surface of the plate and the other for processing both the two surfaces thereof at the same time. To satisfy the requirement, it is desirable that the counter electrode in the anodic oxidation cell is U-shaped so that the aluminum alloy plate to be processed in the call can travel along the U-shaped counter electrode. In the former case of processing only one surface of the aluminum alloy plate in the thus-designed cell, the other surface of the plate may have an oxide film of from 0.1 to 1 g/m$^2$ formed thereon, and the thus-formed oxide film is to prevent the other surface of the plate from being scratched. The plate does not require any thicker oxide film on the other surface thereof. To solve the problem of energy saving in both the two cases, preferred is the cell structure described in JP-B 58233/1988, which is specially so designed that an insulating material is disposed between a strip of the metal plate of which one surface only is to be electrolyzed, and the counter electrode that faces the other surface of the strip to be not electrolyzed, and the insulating material is moved from its original site when the both surfaces of the metal plate strip are desired to be electrolyzed. In the thus-designed cell structure, the current does not flow toward the insulated surface of the metal plate strip in the former case, but flows toward the both surfaces thereof when the insulating material is removed in the latter case.

In the anodic oxidation cell for one-face electrolysis with a direct current, it is also desirable that the counter electrode, cathode is disposed above the aluminum alloy plate (for example, in the form of a web), and an insulating plate of polyvinyl chloride is disposed below the plate, spaced from the plate by a distance of from 5 to 20 mm therebetween.

After thus processed for anodic oxidation to form an oxide film thereon, the aluminum alloy plate may be processed to etch the oxide film, and then further processed with steam, hot water, or a hot aqueous solution containing at least one compound selected from organic solvents, amine compounds, organic acids, oxyphosphates and boric acid, as in JP-B 12518/1981. Thus processed, the aluminum alloy plate is more favorable for planographic printing plate supports. Needless-to-say, the etching treatment after the anodic oxidation is not indispensable to this embodiment.

It is desirable that the chemicals used for the electrolytic surface-roughening treatment, the mechanical surface-roughening treatment, the desmutting treatment, the chemical etching treatment (alkali-etching treatment), the anodic oxidation and the hydrophilication are recycled as much as possible.

In the aqueous sodium hydroxide solution that contains aluminum ions dissolved therein, aluminum may be separated from sodium hydroxide through crystallization. In the aqueous sulfuric acid solution, the aqueous nitric acid solution or the aqueous hydrochloric acid solution that contains aluminum ions dissolved therein, sulfuric acid, nitric acid or hydrochloric acid may be recovered through electrodialysis or treatment with ion-exchange resin.

The aqueous hydrochloric acid solution with aluminum ions dissolved therein may be evaporated to recover the acid, for example, as in JP-A 282272/2000.

Regarding the surface characteristic values of the aluminum alloy plate of which the surface has been roughened in this embodiment, it is desirable that the surface factors thereof measured with a contact surface-roughness gauge fall within the ranges mentioned below.

The factors include mean surface roughness (Ra); 10-point mean roughness (Rz)—for this, the cross section of the plate is sampled to have a predetermined length, a straight line that is parallel to the mean line of the curved surface line of the cross section but does not cross the curved surface line is drawn on the cross section, and the sum of the mean height of the highest five mountains in the vertical direction of the straight line and the mean depth of the deepest five valleys in the same direction indicates the 10-point mean roughness (Rz) in the unit of $\mu$m; maximum height (Rmax)—for this, the highest mountain and the deepest valley in the cross section are sandwiched between two straight lines both parallel to the straight line that is parallel to the mean line, and the distance between the two straight lines indicates the maximum height (Rmax) in the unit of $\mu$m; mean depth (Rp)—this is indicated by the distance between the highest mountain and the straight line parallel to the mean line in the cross section; and mean mountain-to-mountain distance (Sm)—for this, the wave of the surface curve is filtered and measured with a roughness gauge, this is sampled to have a predetermined length, the distance between one point at which the curve is crossed by the mean line and runs from one mountain toward the neighboring valley, and the next point at which the curve is crossed by the mean line and runs from the next mountain toward the neighboring valley is measured for every mountain, and the data are averaged to indicate the mean mountain-to-mountain distance (Sm), all as in JIS 0601-1982.

In this embodiment, the preferred range of these factors are as follows: Ra falls between 0.3 and 0.6 μm; Rz falls between 2 and 5 μm; Rmax falls between 2 and 5 μm; Rp falls between 0.5 and 1.5 μm; and Sm falls between 20 and 70 μm. Also preferably, the non-porosity (%), determined on the basis of the Abbot curve drawn at a cutting depth Cv of three times the height Ra of the plate falls between 15 and 35. Also preferably, the area per bearing (tpmi) at the cutting depth of three times the height of Ra of the plate falls between 10 and 50%, for which referred to is the disclosure in JP-A 150353/1987.

Also preferably, the degree of whiteness of the plate falls between 0.14 and 0.45, measured with a Macbeth densitometer after processed for anodic oxidation.

In the process of anodic oxidation of the aluminum alloy plate in this embodiment, any known plated or lined steel units, plating units, electrolytic capacitors, as well as ordinary metal rolls, resin roll, rubber rolls and nonwoven rolls generally used in continuous production lines for planographic printing plates are all employable.

For example, the material and the surface properties of the rolls (e.g., pass rolls) to be used in the device for producing the planographic printing plate support of this embodiment are appropriately selected and determined, depending on the chemicals to be used in the process and on the surface condition of the aluminum alloy plate to be processed in the process, while the corrosion resistance, the abrasion resistance, the heat resistance and the chemical resistance of the rolls are all taken into consideration. For the metal rolls, generally used are hard chromium-plated rolls. For the rubber rolls, employable are those of natural rubber, isoprene rubber, styrene-butadiene rubber, butadiene rubber, butyl rubber, chloroprene rubber, chlorosulfonated polyethylene, nitrile rubber, acrylic rubber, epichlorohydrin rubber, urethane rubber, polysulfide rubber, fluorine rubber, as well as those of such materials containing minor additives. The hardness of the rubber roll preferably falls between 60 and 90.

In the process of surface-roughening the planographic printing plate support, and also in the process of forming a photosensitive layer on the support and drying the layer thereon that will be described hereinunder, it is desirable not to use silicon-containing materials for the devices, for the lubricating oils, and for the working clothes, gauges, and other working instruments. This is because, if some silicon component adheres to the aluminum alloy plate processed in these processes, it will form spot defects of from 0.1 to 5 mm in diameter, and will greatly lower the yield of good products. In addition, it is also desirable that the cosmetics, the hairdressings and the printed matters that may be in the working environment are all free from silicon.

<Hydrophilication Step>

After processed for anodic oxidation as above, the aluminum alloy plate is optionally but preferably made hydrophilic (i.e., the surface thereof is made hydrophilic). For the hydrophilication, preferably used are alkali metal silicates (e.g., aqueous sodium silicate solution), as in U.S. Pat. Nos. 2,714,066, 3,181,461, 3,280,734 and 3,902,734. In this method, concretely, the aluminum alloy plate is dipped in an aqueous sodium silicate solution, or is electrolyzed in the aqueous solution. Other preferred methods for the hydrophilication are described in JP-B 22063/1961 in which is used potassium fluorozirconate, and in U.S. Pat. Nos. 3,276,868, 4,153,461 and 4,689,272 in which is used polyvinylphosphonic acid. Of those, especially preferred are the methods of hydrophilicating the oxide film on the aluminum alloy plate with an aqueous solution of sodium silicate or polyvinylphosphonic acid.

<Pore-Sealing Step>

In this embodiment, it is desirable that the aluminum alloy plate is, after processed for anodic oxidation as above, further processed for sealing the micropores existing in the oxide film formed on the plate. For sealing the micropores, for example, the plate is dipped in hot water or in a hot aqueous solution containing an organic or inorganic salt, or is exposed to steam in a steam bath. After having been thus processed for sealing the micropores, it is further desirable that the plate is made hydrophilic in the manner as above. The inorganic salt includes, for example, silicates, borates, phosphates and nitrates; and the organic salt includes, for example, carboxylates.

<<Devices for the Production Method of this Embodiment>>

Next described are the devices for the production method of this embodiment for producing aluminum supports for planographic printing plates.

The production method of this embodiment for producing the supports preferably comprises (1) feeding a rolled and coiled aluminum alloy plate from a let-off device equipped with a multi-shaft turret into the next processing device, (2) processing the plate for mechanical surface-roughening, alkali-etching, acid-etching, desmutting, electrochemical surface-roughening, anodic oxidation, pore-sealing and hydrophilication as above in the respective devices, then drying the thus-processed plate, and (3) taking up the plate into coils in a take-up device equipped with a multi-shaft turret, or leveling the plate, then cutting it into pieces having a predetermined length, and piling them. If desired, the process may further comprise a step of forming an undercoat layer, a photosensitive layer and a mat layer on the processed surface of the plate, and a step of drying the layers thereon, and the thus-finished planographic printing plate precursors may be wound up into coils in a take-up device.

Also preferably, the aluminum alloy plate is, while processed in the production method of this embodiment, continuously checked for surface defects with a defect detector. For this, the method comprises at least one step of checking the plate for surface defects and marking the defective plate by sticking a label to the edge of the defective plate. Also preferably, the production line of this embodiment is equipped with a reservoir device in the plate let-off step and in the plate take-up step, in which the reservoir device has the function of keeping the traveling speed of the aluminum alloy plate all the time constant even when the line is stopped for taking the finished plate coils out of the line. Also preferably, the production process of this embodiment further comprises an additional step of welding the aluminum alloy plates by ultrasonic waves or arcs, after the plate let-off step.

Preferably, the production line of this embodiment is equipped with at least one device for detecting the traveling site of the aluminum alloy plate and correcting it. Also preferably, this is equipped with at least one driving device for reducing the plate tension and for controlling the traveling speed of the plate, and at least one dancer roll device for controlling the plate tension.

It is also desirable to provide a tracking device in every step of the production line. The tracking device detects as to whether or not the plate processed in each step is in a desired condition and records it; and before the finished plate is coiled up, a label is stuck to the edge of the plate at the check point. Based on the thus-stuck label, the finished plate is judged as to whether or not it has been processed in the desired condition after the label.

Preferably, the finished aluminum alloy plate is statically electrified along with a paper sheet to be inserted between the adjacent plates, and adsorbed thereto, and then cut and/or slit into pieces having a predetermined length. Based on the information of the label stuck to the edge of the finished aluminum alloy plates, it is desirable that the plates are, before or after cut into pieces having a predetermined length, divided into good ones and defective ones, and only the good plates are collected.

In the production line including the let-off step as above, it is important that the optimum tension of the aluminum alloy plate is set in different conditions, depending on the size (thickness, width) of the plate, the material thereof and the traveling speed thereof. For this, for example, a driving device for reducing the plate tension and for controlling the traveling speed of the plate, and a dancer roll for controlling the plate tension may be used, and it is desirable to provide plural tension sensors and tension controllers in the production line. In this, the signals from the tension sensors are fed back to the tension controllers, and the plate tension and the traveling speed of the plate are thereby appropriately controlled. In general, the driving device for travel control comprises a combination of a direct current motor and a main driving roller. The main driving roller is generally made of a rubber material. However, when the aluminum alloy plate to be processed is wet, the roller may be made of a laminate of nonwoven fabrics. The pass rollers are generally made of rubber or metal. However, in the area in which the aluminum alloy plate will slip on them, the pass rollers may be individually connected to a motor or reduction gears, and some auxiliary driving devices that rotate at a constant speed while controlled by the signal from the main driving device may be provided for the pass rollers.

Also preferably, the surface roughness profile of the planographic printing plate support of this embodiment is so controlled that its arithmetic mean surface roughness (Ra) indicated by the difference between the mean surface roughness ($R^1$) in the machine direction and the mean surface roughness ($R^2$) in the direction perpendicular to the machine direction, ($R^1$–$R^2$), is not larger than 30% of the mean surface roughness ($R^1$) in the machine direction, that the mean curvature in the machine direction is not larger than $1.5\times10^{-3}$ $mm^{-1}$, that the curvature distribution in the cross direction is not larger than $1.5\times10^{-3}$ $mm^{-1}$, and that the curvature in the direction perpendicular to the machine direction is not larger than $1.0\times10^{-3}$ $mm^{-1}$, as in JP-A 114046/1998.

Also preferably, the planographic printing plate support of this embodiment having been produced through the above-mentioned surface-roughening process is corrected by the use of a correcting roll having a roll diameter of from 20 mm to 80 mm and a rubber hardness of from 50 to 95 degrees. Thus corrected, the aluminum alloy plates are well flattened and realize good planographic printing plate precursors that may be well processed in an automatic plate-making machine not causing the trouble of exposure deviation. In this connection, JP-A 194093/1997 discloses a method and a device for measuring the curing degree of aluminum webs, a method and a device for correcting the curled aluminum webs, and a device for cutting the corrected aluminum webs.

In the production line of continuously producing the planographic printing plate support, each step may be electrically monitored as to whether or not the devices are driven in suitable conditions, and the condition of each step may be recorded in a tracking device as to whether or not it is the desired condition. Before the finished aluminum alloy plate is wound up into coils in the continuous production line, a label may be stuck to the edge of the plate, and based on the thus-stuck label, the finished plate is judged as to whether or not it has been processed in the desired condition after the label. Before cut and collected, therefore, the finished plates can be divided into good ones and defective ones, and only the good plates can be collected.

In the process of surface-roughening the aluminum alloy plate in the manner as above, it is desirable to monitor at least one of the temperature, the specific gravity and the electroconductivity of the liquid running through the line and the speed of ultrasonic propagation through the running liquid. Based on the data from the monitors, the composition of the running liquid is determined, and the concentration thereof may be kept all the time constant through feedback control and/or feed-forward control of the data.

For example, the acid solution running in the line contains aluminum ions, and the components of the aluminum alloy plate processed in the line dissolve in the running solution. The same shall apply to the alkali solution running in the line. Therefore, in order to keep the aluminum ion concentration and the acid or alkali concentration of the running solution all the time constant in the line, it is desirable to intermittently add water and the acid, or water and the alkali to the running solution to thereby keep the composition of the solution all the time constant in the line. Preferably, the concentration of the acid or alkali to be added to the running solution falls between 10 and 98% by weight.

For controlling the acid or alkali concentration of the running solution, for example, preferred are the methods mentioned below.

The electroconductivity or the specific gravity of the processing solution of which the concentration is predetermined and which is to be used in the line, or the speed of ultrasonic propagation through the solution is previously measured at different temperatures, and the temperature-dependent data are recorded in a table. In the line in which the aluminum alloy plate is processed, the electroconductivity or the specific gravity of the running solution or the speed of ultrasonic propagation through the running solution are monitored and their data are compared with the data in the data table to know the real-time concentration of the running solution. One example of accurately and stably measuring the ultrasonic propagation time is disclosed in JP-A 235721/1994. A system of concentration measurement based on the ultrasonic propagation speed is disclosed in JP-A 77656/1983. A method of preparing data tables that indicate the correlation between the component-dependent physical data of solutions and the components thereof, and determining the concentration of each component of multi-component solutions is disclosed in JP-A 19559/1992.

When the method of concentration measurement based on the ultrasonic propagation speed is combined with the method of monitoring the data of the electroconductivity and the temperature of the running liquid, and applied to the process of surface-roughening the aluminum alloy plate for planographic printing plate supports, it ensures accurate real-time process control. With that, products of constant quality can be produced, and the yield of good products increases. Not only the data of the combination of temperature, ultrasonic propagation speed and electroconductivity of processing solutions as above, but also the data of other concentration and temperature-dependent physical properties of processing solutions, for example, those of the combination of temperature and specific gravity of processing solutions, those of the combination of temperature and electroconductivity thereof, or those of the combination of temperature, electroconductivity and specific gravity thereof may be prepared in data tables, and based on the data tables, the real-time concentration of each component of multi-component running solutions can be determined. When the method is applied to the process of surface-roughening the aluminum alloy plate for planographic printing plate supports of this embodiment, it produces the same results as above.

In addition, the specific gravity and the temperature of the running solutions in the process of this embodiment may be monitored, and the data may be compared with the data table previously prepared in the manner as above to determine the slurry concentration of the running solutions. In that manner, it is possible to rapidly and accurately determine the slurry concentration of the running solutions.

The ultrasonic propagation speed through the processing liquids is often influenced by the bubbles in the liquids. Therefore, it is desirable that the measurement is effected in a vertical tube in which the liquid to be measured runs upward from below. Preferably, the inner pressure of the vertical tube in which the ultrasonic propagation speed through the liquid is measured falls between 1 and 10 $kg/cm^2$; and the frequency of the ultrasonic waves falls between 0.5 and 3 MHz.

In addition, the specific gravity and the electroconductivity of the processing liquids and also the ultrasonic propagation speed through the liquids are often influenced by the ambient temperature. Therefore, it is desirable that the measurement of these is effected in a tube which is kept warmed and in which the temperature fluctuation does not overstep ±0.3° C. In addition, it is desirable that the electroconductivity and the specific gravity, or the electroconductivity and the ultrasonic propagation speed are measured at the same temperature. Therefore, it is especially desirable that the measurement of these is effected in the same duct or in the same line flow. The pressure fluctuation in the measurement will result in the temperature fluctuation therein. Therefore, the pressure fluctuation is as small as possible. In addition, the flow rate distribution in the duct in which the measurement is effected is as small as possible. Further, since the measurement is often influenced by the slurries, impurities and bubbles in the liquids. Therefore, it is desirable that the liquids are previously filtered or degassed.

<<Planographic Printing Plate Support>>

<Undercoat Layer>

The planographic printing plate support produced according to the production method of this embodiment may be optionally coated with an (organic) undercoat layer, before it is coated with a photosensitive layer to fabricate a planographic printing plate precursor.

The organic compound for the organic undercoat layer is selected, for example, from carboxymethyl cellulose, dextrin, arabic gum; organic phosphonic acids such as amino group-having phosphonic acids (e.g., 2-aminoethylphosphonic acid), and other optionally-substituted phenylphosphonic acids, naphthylphosphonic acids, alkylphosphonic acids, glycerophosphonic acids, methylenediphosphonic acids and ethylenediphosphonic acids; organic phosphoric acids such as optionally-substituted phenylphosphoric acids, naphthylphosphoric acids, alkylphosphoric acids and glycerophosphoric acids; organic phosphinic acids such as optionally-substituted phenylphosphinic acids, naphthylphosphinic acids, alkylphosphinic acids and glycerophosphinic acids; amino acids such as glycine and β-alanine; and hydroxyl group-having amine hydrochlorides such as triethanolamine hydrochloride. Two or more of these may be combined for the layer.

The organic undercoat layer may be formed, for example, according to the methods mentioned below.

(a) The organic compound mentioned above is dissolved in water, or in an organic solvent such as methanol, ethanol or methyl ethyl ketone or in a mixed solvent of these; and the resulting solution is applied onto the support of this embodiment and dried thereon; or (b) the organic compound mentioned above is dissolved in water, or in an organic solvent such as methanol, ethanol or methyl ethyl ketone or in a mixed solvent of these; the support of this embodiment is dipped in the resulting solution to thereby make the support adsorb the organic compound; and this is washed with water or the like, and dried to thereby form the intended organic undercoat layer on the support.

In the method (a), the solution containing from 0.005 to 10% by weight of an organic compound may be applied onto the support in any known manner. For example, it may be applied thereonto in a mode of bar coating, spin coating, spraying or curtain coating.

In the method (b), the organic compound concentration of the dipping solution may fall between 0.01 and 20% by weight, preferably between 0.05 and 5% by weight; the temperature thereof may fall between 20 and 90° C., preferably between 25 and 50° C.; and the dipping time may fall between 0.1 seconds and 20 minutes, preferably between 2 seconds and 1 minute. The pH value of the solution may be controlled by adding thereto a basic substance such as ammonia, triethylamine or potassium hydroxide, or an acid substance such as hydrochloric acid or phosphoric acid, and it may fall between 1 and 12. For improving the tone reproducibility of the photosensitive, planographic printing plate precursor to be fabricated, a yellow dye may be added to the dipping solution.

After dried, the amount of the organic undercoat layer formed may fall between 2 and 200 $mg/m^2$, preferably between 5 and 100 $mg/m^2$. If it is smaller than 2 $mg/m^2$ or larger than 200 $mg/m^2$, the printing durability of the printing plate to be finally produced herein will be poor.

<Back Coat Layer>

On the back surface (not coated with a photosensitive layer) of the planographic printing plate precursor that comprises the support of this embodiment, if desired, a coating layer of an organic polymer compound (this will be referred to as "back coat layer") may be formed. This is for preventing the photosensitive layer of other planographic printing plate precursors from being scratched when the precursors are piled.

The essential ingredient of the back coat layer is preferably at least one resin selected from saturated copolyester resins, phenoxy resins, polyacetal resins and vinylidene chloride copolymer resins, having a glass transition point of not lower than 20° C.

The saturated copolyester resins comprise dicarboxylic acid units and diol units. The dicarboxylic acid units for the polyesters for use in this embodiment include, for example, those of aromatic carboxylic acids such as phthalic acid, terephthalic acid, isophthalic acid, tetrabromophthalic acid, tetrachlorophthalic acid; and those of saturated aliphatic dicarboxylic acids such as adipic acid, azelaic acid, succinic acid, oxalic acid, suberic acid, sebacic acid, malonic acid and 1,4-cyclohexanedicarboxylic acid.

The back coat layer may optionally contain any of dyes and pigments for coloration; silane coupling agents, diazo resins of diazonium salts, organic phosphonic acids, organic phosphoric acids and cationic polymers for improving the adhesiveness of the layer to the support; and ordinary wax, higher fatty acids, higher fatty acid amides, silicone compounds of dimethylsiloxane, modified dimethylsiloxane and polyethylene powder that serve as a lubricant.

The thickness of the back coat layer may be basically such that it well protects the photosensitive layers of other planographic printing plate precursors from being scratched while the precursors are piled, even when a buffer sheet is not present between the adjacent precursors piled. Preferably, it falls between 0.01 and 8 $\mu$m. If its thickness is smaller than 0.01 $\mu$m, the back coat layer will fail to protect the photosensitive layers of other planographic printing plate precursors from being scratched while the precursors are piled. However, if its thickness is larger than 8 $\mu$m, the back coat layer will be swollen by the chemicals used in processing the precursors into printing plates, and its thickness will vary. If so, the printing pressure applied to the printing plates will vary, and the properties of the printed matters will be worsened.

For coating the back surface of the support with the back coat layer, employable are various methods. For example, the components of the back coat layer are dissolved in a suitable solvent, and the resulting solution is applied onto the back surface of the support, and dried; or the components are formed into an emulsion, and the resulting emulsion is applied onto it, and dried; or the components are formed into a film, and the film is stuck to the support with an adhesive or under heat; or, using an extruder, the components are melt-extruded onto the support to form a film thereon. For ensuring the desired thickness of the layer as above, most preferred is the method of dissolving the components in a suitable solvent followed by applying the resulting solution onto the support and drying it thereon. Organic solvents usable in the method are described in JP-A 251739/1987. One or more of these may be used in the method either singly or as combined.

In fabricating the planographic printing plate precursors, the back coat layer to be on the back of the support and the photosensitive layer to be on the face thereof may be formed in any desired order. The two may be formed at the same time.

<<Planographic Printing Plate Precursor>>

A photosensitive layer described below is formed on the support to fabricate the planographic printing plate precursor of this embodiment. When the precursor is exposed to light and developed, it has an image formed thereon. With the thus-formed image thereon, this serves as a planographic printing plate.

<[I] Embodiment of Photosensitive Layer Containing o-naphthoquinonediazidosulfonate and Phenol/cresol Mixed Novolak Resin>

A photosensitive layer that comprises an o-naphthoquinonediazidosulfonate and a phenol/cresol mixed novolak resin may be formed on the support of this embodiment.

The o-naphthoquinonediazide compound is one type of o-quinonediazide compounds, and this is described, for example, in U.S. Pat. Nos. 2,766,118, 2,767,092, 2,772,972, 2,859,112, 3,102,809, 3,106,465, 3,635,709, 3,647,443, and many other publications. All the compounds disclosed in these are favorable to the invention.

Of those, especially preferred for use herein are o-naphthoquinonediazidosulfonates and o-naphthoquinonediazidocarboxylates of aromatic hydroxy compounds, and o-naphthoquinonediazidosulfonamides and o-naphthoquinonediazidocarbonamides of aromatic amino compounds. In particular, o-naphthoquinonediazidosulfonates with condensates of pyrogallol and acetone, such as those described in U.S. Pat. No. 3,635,709; o-naphthoquinonediazidosulfonates and o-naphthoquinonediazidocarboxylates with OH-terminated polyesters, such as those described in U.S. Pat. No. 4,028,111; o-naphthoquinonediazidosulfonates and o-naphthoquinonediazidocarboxylates with homopolymers of p-hydroxystyrene or with copolymers thereof with other comonomers, such as those described in BP 1,494,043; and o-naphthoquinonediazidosulfonamides and o-naphthoquinonediazidocarbonamides with copolymers of p-aminostyrene with other comonomers are especially good.

The o-quinonediazide compounds may be used singly, but are preferably combined with alkali-soluble resins. For the alkali-soluble resins, preferred are novolak-type phenolic resins. Concretely, they include phenol-formaldehyde resins, o-cresol-formaldehyde resins, and m-cresol-formaldehyde resins. More preferably, the phenolic resins are combined with condensates of $C_{3-8}$ alkyl-substituted phenol or cresol and formaldehyde, such as t-butylphenol-formaldehyde resin, as in U.S. Pat. No. 4,028,111.

For forming visible images through exposure, for example, any of o-naphthoquinonediazido-4-sulfonyl chloride, salts of p-diazodiphenylamine with inorganic anions, trihalomethyloxadiazole compounds, or benzofuran-having trihalomethyloxadiazole compounds may be added to the o-quinonediazide compounds.

The photosensitive layer may contain an image colorant. For the image colorant, for example, usable are triphenylmethane dyes such as Victoria blue BOH, crystal violet, oil blue. For it, especially preferred are the dyes described in JP-A 293247/1987. In addition, the layer may contain, as a lipo-sensitizer, any of novolak resins prepared through condensation of $C_{3-15}$ alkyl-substituted phenol, e.g., t-butylphenol, n-octylphenol or t-butylphenol, with formaldehyde, such as those described in JP-B 23253/1982; and o-naphthoquinonediazido-4- or -5-sulfonates with such novolak resins, such as those described in JP-A 242446/1986.

For improving its developability, the photosensitive layer may further contain a nonionic surfactant, as in JP-A 251740/1987. The components mentioned above may be dissolved in solvents capable of dissolving them, and the resulting composition may be applied onto the support of this embodiment. The solvents include, for example, ethylene dichloride, cyclohexane, methyl ethyl ketone, ethylene glycol monomethyl ether, ethylene glycol monoethyl ether, 2-methoxyethyl acetate, 1-methoxy-2-propanol, 1-methoxy-2-propyl acetate, methyl lactate, ethyl lactate, dimethylsulfoxide, dimethylacetamide, dimethylformamide, water, N-methylpyrrolidone, tetrahydrofurfuryl alcohol, acetone, diacetone alcohol, methanol, ethanol, isopropanol, diethylene glycol dimethyl ether. These may be used either singly or as combined.

<[II] Embodiment of Photosensitive Layer Containing Diazo Resin and Water-insoluble Oleophilic Polymer Compound>

A photosensitive layer that comprises a diazo resin and a water-insoluble oleophilic polymer compound may be formed on the support of this embodiment.

The diazo resin includes, for example, inorganic salts of diazo resins, which are organic solvent-soluble reaction products of condensates of p-diazodiphenylamine with formaldehyde or acetaldehyde, and hexafluorophosphates or tetrafluoroborates; and organic solvent-soluble, organic acid salts of diazo resins, which are reaction products of the condensates as above and sulfonic acids such as p-toluenesulfonic acid or its salts, or phosphinic acids such as benzenephosphinic acid or its salts, or hydroxyl compounds such as 2,4-dihydroxybenzophenone, 2-hydroxy-4-methoxybenzophenone-5-sulfonic acid or its salts, as in U.S. Pat. No. 3,300,309. Other diazo resins favorable for use in this embodiment are co-condensates containing structural units of aromatic compounds having at least one organic group selected from carboxyl group, sulfonic acid group, sulfinic acid group, phosphorus oxyacid group and hydroxyl group, and structural units of diazonium compounds, preferably aromatic diazonium compounds. The aromatic ring is preferably a phenyl group and a naphthyl group. Various aromatic compounds having at least one of carboxyl group, sulfonic acid group, sulfinic acid group, phosphorus oxyacid group and hydroxyl group are known. Preferred for use herein are 4-methoxybenzoic acid, 3-chlorobenzoic acid, 2,4-dimethoxybenzoic acid, p-phenoxybenzoic acid, 4-anilinobenzoic acid, phenoxyacetic acid, phenylacetic acid, p-hydroxybenzoic acid, 2,4-dihydroxybenzoic acid, benzenesulfonic acid, p-toluenesulfinic acid, 1-naphthalenesulfonic acid, phenylphosphoric acid, phenylphosphonic acid.

For the aromatic diazonium compounds to form the structural units of the co-condensate diazo resins, for example, usable are the diazonium salts described in JP-B 48001/1974. Especially preferred are diphenylamine-4-diazonium salts. They are derived from 4-aminodiphenylamines, which include, for example, 4-aminodiphenylamine, 4-amino-3-methoxydiphenylamine, 4-amino-2-methoxydiphenylamine, 4'-amino-2-methoxydiphenylamine, 4'-amino-4-methoxydiphenylamine, 4-amino-3-methyldiphenylamine, 4-amino-3-ethoxydiphenylamine, 4-amino-3-β-hydroxyethoxydiphenylamine, 4-amino-diphenylamine-2-sulfonic acid, 4-amino-diphenylamine-2-carboxylic acid, 4-amino-diphenylamine-2'-carboxylic acid. Especially preferred are 3-methoxy-4-amino-4-diphenylamine, and 4-aminodiphenylamine.

Other diazo resins except the co-condensate diazo resins with acid group-having aromatic compounds are, for example, diazo resins condensed with acid group-having aldehyde or its acetal compounds, such as those described in JP-A 18559/1992, 163551/1991 and 253857/1991; and these are preferred for use herein. The pair anions for the diazo resins are those that form stable salts with diazo resins and make the resins soluble in organic solvents.

These include organic carboxylic acids such as decanoic acid and benzoic acid; organic phosphoric acid such as phenylphosphoric acid; and sulfonic acids. Typical examples of the compounds are aliphatic and aromatic sulfonic acids such as methanesulfonic acid, fluoroalkanesulfonic acids (e.g., trifluoromethanesulfonic acid), laurylsulfonic acid, dioctylsulfosuccinic acid, dicyclohexylsulfosuccinic acid, camphorsulfonic acid, tolyloxy-3-propanesulfonic acid, nonylphenoxy-3-propanesulfonic acid, nonylphenoxy-4-butanesulfonic acid, dibutylphenoxy-3-propanesulfonic acid, diamylphenoxy-3-propanesulfonic acid, dinonylphenoxy-3-propanesulfonic acid, dibutylphenoxy-4-butanesulfonic acid, dinonylphenoxy-4-butanesulfonic acid, benzenesulfonic acid, toluenesulfonic acid, mesitylenesulfonic acid, p-chlorobenzenesulfonic acid, 2,5-dichlorobenzenesulfonic acid, sulfosalicylic acid, 2,5-dimethylbenzenesulfonic acid, p-acetylbenzenesulfonic acid, 5-nitro-o-toluenesulfonic acid, 2-nitrobenzenesulfonic acid, 3-chlorobenzenesulfonic acid, 3-bromobenzenesulfonic acid, 2-chloro-5-nitrobenzenesulfonic acid, butylbenzenesulfonic acid, octylbenzenesulfonic acid, decylbenzenesulfonic acid, dodecylbenzenesulfonic acid, butoxybenzenesulfonic acid, dodecyloxybenzenesulfonic acid, 2-hydroxy-4-methoxybenzophenone-5-sulfonic acid, isopropylnaphthalenesulfonic acid, butylnaphthalenesulfonic acid, hexylnaphthalenesulfonic acid, octylnaphthalenesulfonic acid, butoxynaphthalenesulfonic acid, dodecyloxynaphthalenesulfonic acid, dibutylnaphthalenesulfonic acid, dioctylnaphthalenesulfonic acid, triisopropylnaphthalenesulfonic acid, tributylnaphthalenesulfonic acid, 1-naphthol-5-sulfonic acid, naphthalene-1-sulfonic acid, naphthalene-2-sulfonic acid, 1,8-dinitro-naphthalene-3,6-disulfonic acid, dimethyl 5-sulfoisophthalate; OH-containing aromatic compounds such as 2,2',4,4'-tetrahydroxybenzophenone, 1,2,3-trihydroxybenzophenone, 2,2',4-trihydroxybenzophenone; halogeno-Lewis acids such as hexafluorophosphoric acid, tetrafluoroboric acid; perhalogenic acids such as $HClO_4$, $HIO_4$. However, these are not limitative. Of those, especially preferred are butylnaphthalenesulfonic acid, dibutylnaphthalenesulfonic acid, hexafluorophosphoric acid, 2-hydroxy-4-methoxybenzophenone-5-sulfonic acid, and dodecylbenzenesulfonic acid.

The diazo resins for use in this embodiment may have any desired molecular weights, depending on the molar ratio of the constituent monomers and on the condition for condensation. For effective use in this embodiment, however, the diazo resins preferably have a molecular weight falling between 400 and 100,000 or so, more preferably between 800 and 8,000 or so.

The water-insoluble oleophilic polymer compounds are, for example, copolymers having structural units of any of the following monomers (1) to (17). In general, they have a molecular weight of from 1,000 to 200,000 or so.

(1) Aromatic OH-having acrylamides, methacrylamides, acrylates, methacrylates, and hydroxystyrenes, for example, N-(4-hydroxyphenyl)acrylamide, N-(4-hydroxyphenyl) methacrylamide, o-, m- or p-hydroxystyrene, o-, m- or p-hydroxyphenyl acrylate and methacrylate.

(2) Aliphatic OH-having acrylates and methacrylates, such as 2-hydroxyethyl acrylate, 2-hydroxyethyl methacrylate, 4-hydroxybutyl methacrylate.

(3) Unsaturated carboxylic acids such as acrylic acid, methacrylic acid, maleic anhydride, itaconic acid.

(4) (Substituted) alkyl acrylates such as methyl acrylate, ethyl acrylate, propyl acrylate, butyl acrylate, amyl acrylate, hexyl acrylate, cyclohexyl acrylate, octyl acrylate, benzyl acrylate, 2-chloroethyl acrylate, glycidyl acrylate, N-dimethylaminoethyl acrylate.

(5) (Substituted) alkyl methacrylates such as methyl methacrylate, ethyl methacrylate, propyl methacrylate, butyl methacrylate, amyl methacrylate, cyclohexyl methacrylate, benzyl methacrylate, glycidyl methacrylate, N-dimethylaminoethyl methacrylate.

(6) Acrylamides and methacrylamides, such as acrylamide, methacrylamide, N-methylolacrylamide, N-methylolmethacrylamide, N-ethylacrylamide, N-hexylmethacrylamide, N-cyclohexylacrylamide, N-hydroxyethylacrylamide, N-phenylacrylamide, N-nitrophenylacrylamide, N-ethyl-N-phenylacrylamide.

(7) Vinyl ethers such as ethyl vinyl ether, 2-chloroethyl vinyl ether, hydroxyethyl vinyl ether, propyl vinyl ether, butyl vinyl ether, octyl vinyl ether, phenyl vinyl ether.

(8) vinyl esters such as vinyl acetate, vinyl chloroacetate, vinyl butyrate, vinyl benzoate.

(9) Styrenes such as styrene, α-methylstyrene, chloromethylstyrene.

(10) Vinyl ketones such as methyl vinyl ketone, ethyl vinyl ketone, propyl vinyl ketone, phenyl vinyl ketone.

(11) Olefins such as ethylene, propylene, isobutylene, butadiene, isoprene.

(12) N-vinylpyrrolidone, N-vinylcarbazole, 4-vinylpyridine, acrylonitrile, methacrylonitrile.

(13) Unsaturated imides such as maleimide, N-acryloylacrylamide, N-acetylmethacrylamide, N-propionylmethacrylamide, N-(p-chlorobenzoyl) methacrylamide.

(14) Unsaturated sulfonamides, for example, methacrylamides such as N-(o-aminosulfonylphenyl)methacrylamide, N-(m-aminosulfonylphenyl)methacrylamide, N-(p-amino) sulfonylphenylmethacrylamide, N-(1-(3-aminosulfonyl) naphthyl)methacrylamide, N-(2-aminosulfonylethyl) methacrylamide, and acrylamides having the same substituents as above; and methacrylates such as o-aminosulfonylphenyl methacrylate, m-aminosulfonylphenyl methacrylate, p-aminosulfonylphenyl methacrylate, 1-(3-aminosulfonylnaphthyl) methacrylate, and acrylates having the same substituents as above.

(15) Unsaturated monomers having a crosslinkable group in the side chain, such as N-(2-(methacryloyloxy)ethyl)-2, 3-dimethylmaleimide, vinyl cinnamate. The monomers may be copolymerized with comonomers.

(16) Phenolic resins and polyvinylacetal resins such as polyvinylformal resins, polyvinylbutyral resins, described in U.S. Pat. No. 3,751,257.

(17) Alkali-solubilized polyurethane compounds described in JP-B 19773/1979, JP-A 904747/1982, 182437/1985, 58242/1987, 123452/1987, 123453/1987, 113450/1988, 146042/1990.

To the copolymers, if desired, any of polyvinylbutyral resins, polyurethane resins, polyamide resins, epoxy resins, novolak resins and natural resins may be added.

For obtaining visible images directly through exposure and for obtaining visible images after development, dyes may be added to the photosensitive composition for the photosensitive layer in this embodiment. The dyes include, for example, triphenylmethane dyes, diphenylmethane dyes, oxazine dyes, xanthene dyes, iminonaphthoquinone dyes, azomethine dyes and anthraquinone dyes, such as typically Victoria Pure Blue BOH (from Hodogaya Chemical), Oil Blue #603 (from Orient Chemical), Patent Pure Blue (from Sumitomo-Mikuni Chemical), crystal violet, brilliant green, ethyl violet, methyl violet, methyl green, erythrosine B, basic fuchsine, malachite green, oil red, m-cresol purple, rhodamine B, auramine, 4-p-diethylaminophenyliminaphthoquinone, cyano-p-diethylaminophenylacetanilide. These are examples of colorants that lose their color to be colorless, or change their color into different colors.

Colorants for the dyes which are originally colorless but form color after processed are leuco dyes. Their examples are primary or secondary arylamine dyes, such as typically triphenylamine, diphenylamine, o-chloroaniline, 1,2,3-triphenylguanidine, naphthylamine, diaminodiphenylmethane, p,p'-bis-dimethyllaminodiphenylamine, 1,2-dianilinoethylene, p,p',p"-tris-dimethylaminotriphenylmethane, p,p'-bis-dimethylaminodiphenylmethylimine, p,p',p"-triamino-o-methyltriphenylmethane, p,p'-bis-dimethylaminodiphenyl-4-anilinonaphthylmethane, p,p',p"-triaminotriphenylmethane. Especially preferred for use herein are triphenylmethane dyes, diphenylmethane dyes, and more preferred are triphenylmethane dyes. Still more preferred is Victoria Pure Blue BOH.

The photosensitive composition for the photosensitive layer in this embodiment may further contain other various additives. For the additives, for example, preferred are alkyl ethers (e.g., ethyl cellulose, methyl cellulose), fluorine-containing surfactants and nonionic surfactants (fluorine-containing surfactants are especially preferred) which are for improving the coatability of the composition; plasticizers for improving the flexibility and the abrasion resistance of the film of the composition (e.g., butylphthalyl polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, acrylic or methacrylic acid oligomers and polymers—of those, especially preferred is tricresyl phosphate); lipo-sensitizers for improving the lipo-sensitivity of the image area of the film (e.g., alcohol half-esters of styrene-maleic anhydride copolymers such as those described in JP-A 527/1980, novolak resins such as p-t-butylphenol-formaldehyde resins, 50% fatty acid esters of p-hydroxystyrene); stabilizers {e.g., phosphoric acid, phosphorous acid, organic acids (citric acid, oxalic acid, dipicolinic acid, benzenesulfonic acid, naphthalenesulfonic acid, sulfosalicylic acid, 4-methoxy-2-hydroxybenzophenone-5-sulfonic acid, tartaric acid)}; and development promoters (e.g., higher alcohols, acid anhydrides).

For forming the photosensitive layer of the photosensitive composition on the support of this embodiment, for example, a predetermined amount of the diazo resin, the oleophilic polymer compound and optionally other various additives are dissolved in a suitable solvent (e.g., methyl cellosolve, ethyl cellosolve, dimethoxyethane, diethylene glycol monomethyl ether, diethylene glycol dimethyl ether, 1-methoxy-2-propanol, methyl cellosolve acetate, acetone, methyl ethyl ketone, methanol, dimethylformamide, dimethylacetamide, cyclohexanone, dioxane, tetrahydrofuran, methyl lactate, ethyl lactate, ethylene dichloride, dimethylsulfoxide, water or their mixture) to prepare a coating liquid for the photosensitive composition, and this is applied onto the support and dried thereon. The solvent to be used may be a single solvent, but preferred for it is a mixture of a high-boiling-point solvent such as methyl cellosolve, 1-methoxy-2-propanol or methyl lactate, and a low-boiling-point solvent such as methanol or methyl ethyl ketone.

The solid concentration of the photosensitive composition to be applied onto the support of this embodiment preferably falls between 1 and 50% by weight.

[Negative, IR-laser Recording Material]

In case where the planographic printing plate precursor of this embodiment is a type of negative, IR-laser recording material that is exposed to IR laser for forming an image thereon, its photosensitive layer is preferably made of a negative photosensitive material for exposure to IR laser. One preferred example of the negative photosensitive material comprises (A) a compound capable of decomposing in light or under heat to give an acid, (B) a crosslinking agent that acts in the presence of an acid, (C) an alkali-soluble resin, (D) an IR absorbent, and (E) a compound of a general formula, $(R_1—X)—Ar—(OH)_m$ in which R1 indicates an alkyl or alkenyl group having from 6 to 32 carbon atoms, X indicates a single bond, or O, S, COO or CONH, Ar indicates an aromatic hydrocarbon group, an aliphatic hydrocarbon group, or a heterocyclic group, n=1 to 3, and m=1 to 3.

The drawback of the negative, planographic printing plate precursor is that it easily receives fingerprints after developed and that the mechanical strength of its image area is low. However, the photosensitive layer made of the preferred composition as above overcomes the drawback. The constituent components of the photosensitive layer of the negative planographic printing plate precursor are described in detail hereinunder.

The compound (A) capable of decomposing in light or under heat to give an acid may be a compound that releases an acid when exposed to 200 to 500 nm rays or when heated at 100° C. or higher. It includes compounds capable of photo-decomposing to give sulfonic acid, for example, iminosulfonates such as those described in Japanese Patent Application No. 140109/1991. Preferred examples of the acid generator are optical cation-polymerization initiators, optical radical-polymerization initiators, and optical decoloring or color-changing agents for dyes. Preferably, the amount of the acid generator to be in the image-recording photosensitive composition falls between 0.01 and 50% by weight of the total solid content of the composition.

The crosslinking agent (B) that acts in the presence of an acid is preferably any of (i) an alkoxymethyl or hydroxyl-substituted aromatic compound (ii) an N-hydroxymethyl, N-alkoxymethyl or N-acyloxymethyl-having compound or (iii) an epoxy compound.

The alkali-soluble resin (C) includes novolak resins, and hydroxyaryl-branched polymers.

The IR absorbent (D) absorbs 760 to 1200 nm IR rays, and it includes azo dyes, anthraquinone dyes and phthalocyanine dyes that are available on the market, as well as black pigments, red pigments, metal powder pigments and phthalocyanine pigments listed in Color Index. For improving the image visibility of the processed plate, it is desirable to add an image colorant such as oil yellow or oil blue #603, to the photosensitive layer. For improving the flexibility of the layer, a plasticizer such as polyethylene glycol or phthalate may be added to the layer.

[Positive, IR Laser-recording Material]

In case where the planographic printing plate precursor of this embodiment is a type of positive, IR-laser recording material that is exposed to IR laser for forming an image thereon, its photosensitive layer is preferably made of a positive photosensitive material for exposure to IR laser. One preferred example of the positive photosensitive material comprises (A) an alkali-soluble polymer, (B) a compound that interacts with the alkali-soluble polymer to lower the solubility of the polymer in alkali, and (C) an IR-absorbing compound.

The advantage of the planographic printing plate precursor comprising a photosensitive layer of the preferred composition as above is that the solubility of the non-image area of the layer in an alkali developer is enhanced, that the layer is hardly scratched, and that the alkali resistance of the image area of the layer is good. Accordingly, the stability of the precursor in development is good.

For the alkali-soluble polymer (A), for example, preferred are (i) phenolic OH-having polymer compounds such as typically phenolic resins, cresol resins, novolak resins and pyrogallol resins, (ii) homopolymers prepared by homopolymerizing sulfonamido-having polymerizing monomers, or copolymers prepared by copolymerizing the monomers with any other comonomers, (iii) compounds having an active imido group in the molecule, such as N-(p-toluenesulfonyl) methacrylamide and N-(p-toluenesulfonyl)acrylamide.

The component (B) is a compound that interacts with the component (A), including, for example, sulfone compounds, ammonium salts, sulfonium salts and amide compounds. For example, when the component (A) is a novolak resin, the component (B) is preferably a cyanine dye.

The component (C) absorbs 750 to 1200 nm IR rays, and preferably has the function of photo-thermal conversion. Examples of the compound having the function are squalilium dyes, pyrylium salt dyes, carbon black, insoluble azo dyes, and anthraquinone dyes. The size of these pigments preferably falls between 0.01 $\mu$m and 10 $\mu$m. Dyes are added to these and dissolved in an organic solvent such as methanol or methyl ethyl ketone, and the resulting solution is applied onto the aluminum alloy plate to such a degree that the dry weight of the layer to be formed on the plate may fall between 1 and 3 g/m$^2$. The thus-coated support is dried.

[Photopolymerizing Photopolymer-containing, IR-laser Recording Material]

For the negative, planographic printing plate precursor to be processed through exposure to IR laser, more preferred is a photopolymerizing photopolymer-containing photosensitive material.

When the photosensitive layer is made of the photopolymerizing photopolymer-containing photosensitive material, it is desirable that the support of this embodiment is, before coated with the photosensitive layer, previously coated with an adhesive layer that contains a silicone compound having a reactive functional group, as in JP-A 56177/1991 and 320551/1996. The adhesive layer is for improving the adhesiveness between the support and the photosensitive layer. Concretely, a silane compound such as ethylenetetramethoxysilane or ethylenetetraethoxysilane is dissolved in a solvent such as methanol or ethanol, in a ratio of from 1 to 20% by weight, and this is hydrolyzed therein in the presence of an acid catalyst such as hydrochloric acid, nitric acid, phosphoric acid or sulfonic acid. With the formation of a bond of —Si—O—Si— in the resulting hydrolyzate therein, the solution is thus converted into a sol, and the sol is applied onto the support to form the intended adhesive layer thereon.

In this step, it is desirable that the viscosity of the solution of the silane compound in a suitable solvent such as methanol is controlled to fall between 0.2 mPa·s (0.2 centipoises) and 2000 mPa·s (20 poises) and the dry weight of the adhesive layer formed is controlled to fall between 1 and 100 mg/m$^2$.

On the adhesive layer, the photosensitive layer is formed. The photopolymerizing photopolymer-containing photosensitive material for the photosensitive layer contains an addition-polymerizable, unsaturated bond-having polymerizing compound (e.g., photopolymerizable ethylene-terminated compound). The photosensitive layer may contain any of photopolymerization initiator, organic polymer binder, colorant, plasticizer, and thermal polymerization inhibitor.

The ethylenic unsaturated bond-terminated compound includes, for example, esters of unsaturated carboxylic acids with aliphatic polyalcohols (e.g., acrylates, methacrylates, itaconates, maleates), and amides of unsaturated carboxylic acids with aliphatic polyamines (e.g., methylenebisacrylamide, xylylenebisacrylamide).

The photopolymerization initiator includes, for example, titanocene compounds, as well as triazine-type, benzophenone-type and benzimidazole-type sensitizers. Also usable are other sensitizers such as cyanine dyes, merocyanine dyes, xanthene dyes and coumarin dyes.

The photosensitive composition of that type is applied onto the support of this embodiment, and dried to form thereon a photosensitive layer having a dry weight of from 1 to 3 g/m$^2$. The negative, planographic printing plate precursor thus fabricated can be exposed to IR laser for forming an image thereon.

[Photocrosslinking Photopolymer-containing, Laser Recording Material]

In the photosensitive layer, also usable is a photocrosslinking photopolymer.

For the photocrosslinking photopolymer, for example, preferred are polyester compounds disclosed in JP-A96696/1977; and polyvinyl cinnamate resins described in GP 1,112,277. More preferred are maleimide-branched polymers described in JP-A 78544/1987.

[Sulfonate-containing IR-laser Recording Material]

In the photosensitive layer, also usable is a sulfonate compound sensitive to IR rays.

For the IR-sensitive sulfonate compound, for example, usable are those disclosed in JP 2,704,480 and 2,704,872. Also usable are photosensitive substances which, when exposed to IR laser, give sulfonic acid owing to the heat generated through exposure to IR laser and which become soluble in water; photosensitive substances which are prepared by solidifying styrenesulfonates through sol-gel conversion and of which the surface polarity changes through exposure to IR laser; and photosensitive substances of which the hydrophobic surface is made hydrophilic through exposure to IR laser, such as those described in Japanese Patent Application Nos. 89816/1997, 22406/1998 and 027655/1998.

For further improving the properties of the photosensitive layer that comprises the polymer compound capable of giving sulfonic acid under heat, preferred are the following methods: (1) Combining the polymer compound and an acid or base generator, as in Japanese Patent Application No. 7062/1998; (2) providing a specific interlayer, as in Japanese Patent Application No. 340358/1997; (3) combining the polymer compound and a specific crosslinking agent, as in Japanese Patent Application No. 248994/1997; (4) forming a specific layer constitution, as in Japanese Patent Application No. 43921/1998; (5) using a technique of solid grain surface modification, as in Japanese Patent Application No. 115354/1998.

Other examples of the composition having the ability to convert the hydrophilicity/hydrophobicity of the photosensitive layer by utilizing the heat generated through exposure to laser are a composition comprising a Werner complex and capable of becoming hydrophobic under heat, as in U.S. Pat. No. 2,764,085; a composition comprising a specific saccharide and a melamine-formaldehyde resin and capable of becoming hydrophilic through exposure to light, as in JP-B 27219/1971; a composition capable of becoming hydrophobic through heat-mode exposure, as in JP-A 63704/1976; a composition comprising a polymer capable of becoming hydrophobic through dehydration under heat, such as phthalylhydrazide polymer, as in U.S. Pat. No. 4,081,572; a composition having a tetrazolium salt structure and capable of becoming hydrophilic under heat, as in JP-B 58100/1991; a composition comprising a sulfonic acid-modified polymer and capable of becoming hydrophobic through exposure to light, as in JP-A 132760/1985; a composition comprising an imide precursor polymer and capable of becoming hydrophobic through exposure to light, as in JP-A 3543/1989; and a composition comprising a fluorocarbon polymer and capable of becoming hydrophilic through exposure to light, as in JP-A 74706/1976.

Further mentioned for these are a composition comprising a hydrophobic crystalline polymer and capable of becoming hydrophilic through exposure to light, as in JP-A 197190/1991; a composition comprising a polymer of which the insoluble branches are converted into hydrophilic ones when exposed to heat, and a photo-thermal converting agent, as in JP-A 186562/1995; a composition containing microcapsules and a three-dimensionally crosslinked hydrophilic binder and capable of becoming hydrophobic through exposure to light, as in JP-A 1849/1995; a composition that undergoes valence isomerization or proton transfer isomerization, as in JP-A 3463/1996; a composition that undergoes interlayer phase structure change (compatibilization) through exposure to heat to cause hydrophilicity/hydrophobicity change, as in JP-A 141819/1996; and a composition that undergoes surface morphology change and surface hydrophilicity/hydrophobicity change through exposure to heat, as in JP-B 228/1985.

Another preferred example of the composition for the photosensitive layer is a composition having the ability to convert the adhesiveness between the photosensitive layer/support through heat-mode exposure of utilizing the heat generated by high-power high-density laser rays applied to the layer. Concretely, it comprises a thermo-fusing or thermo-reactive substance, as in JP-B 22957/1969.

[Electrophotographic Resin-containing, Laser-recording Material]

The photosensitive layer of the planographic printing plate precursor of this embodiment may also be a ZnO-containing photosensitive layer as in U.S. Pat. No. 3,001,872; or an electrophotographic resin-containing photosensitive layer as in JP-A 161550/1981, 186847/1985, 238063/1986. The amount of the photosensitive layer to be formed on the support of this embodiment may fall between 0.1 and 7 $g/m^2$ or so, preferably between 0.5 and 4 $g/m^2$ or so, in terms of the dry weight thereof.

A basic invention of electrophotography is disclosed in JP-B 17162/1962, which is hereby incorporated for reference. In addition to it, the methods disclosed in JP-A 107246/1981 and JP-B 36259/1984 are also incorporated for reference. The electrophotographic resin consists essentially of a photoconductive compound and a binder, and may contain, if desired, any of known pigments, dyes, chemical sensitizers and other necessary additives for increasing the sensitivity of the resin layer and for controlling the intended wavelength range to which the layer is sensitive.

If desired, interlayers may be provided in the planographic printing plate precursor of this embodiment for increasing the adhesiveness between the support and the photosensitive layer, for preventing the photosensitive layer from remaining in the developed plate, and for preventing halation. For the interlayer for increasing the adhesiveness between the above two, in general, preferred are aluminum-adsorptive phosphate compounds, amino compounds and carboxylate compounds. For the interlayer for preventing the photosensitive layer from remaining in the developed plate, preferred are highly-soluble substances such as highly-soluble polymers or water-soluble polymers. For the interlayer for antihalation, preferred are dyes or UV absorbents.

The thickness of each interlayer may be any desired one, but must be such that the interlayer uniformly bonds to the overlying photosensitive layer when the precursor is exposed to light. In general, the dry thickness preferably falls between 1 and 100 $mg/m^2$ or so, more preferably between 5 and 40 $mg/m^2$ or so.

On the photosensitive layer, optionally provided is a mat layer having independent fine hillocks on its surface. The object of the mat layer is for enhancing the vacuum adhesiveness between the photosensitive, planographic printing plate precursor and the negative image film attached thereto for contact exposure of the precursor through the film, to thereby shorten the time for vacuum drawing and to prevent the fine dot failure to be caused by contact insufficiency in exposure.

For forming the mat layer, for example, employable is a method of thermo-fusing solid powder onto the photosensitive layer, as in JP-A 12974/1980, or a method of spraying a wet polymer thereonto followed by drying it, as in JP-A182636/1983. Preferably, the mat layer is soluble in an aqueous alkali developer not substantially containing an organic solvent, or is removable by the developer.

Except for the electrophotographic resin-containing laser recording material, the dry weight of the photosensitive layer formed on the support in the manner as above is, both for positive photosensitive materials and for negative ones, preferably from 1 to 3 g/m$^2$, more preferably from 1.5 to 2.5 g/m$^2$.

Preferably, a known mat layer is formed on the photosensitive layer in order. Its dry weight may fall between 0.001 and 1 g/m$^2$, preferably between 0.005 and 0.2 g/m$^2$.

Also preferably, the mean surface roughness (Ra—JIS B0601-1994) of the planographic printing plate precursor falls between 0.3 and 0.6 $\mu$m, more preferably between 0.35 and 0.55 $\mu$m. The value L* thereof preferably falls between 50 and 95, more preferably between 60 and 90. The delta Eab* thereof is preferably at most 2, more preferably falling between 0 and 1.

The value L* and the delta Eab* referred to herein are defined in JIS Z8729-1980.

The mean surface roughness (Ra), the value L* and the delta Eab* of the planographic printing plate precursor all indicate those of the support of the precursor not as yet having the photosensitive layer and other layers thereon.

<<Planographic Printing Plate>>

The planographic printing plate precursor of this embodiment fabricated by forming a photosensitive layer on the support as in the above is exposed to IR laser or the like and then developed with an alkali developer or the like to be a planographic printing plate. For the light source for exposure, employable is 700 to 1200 nm IR laser. In the recent art of plate-making and printing, widely used are automatic developing machines for printing plates for rationalizing and standardizing the plate-making operation. In the plate-making process of this embodiment, preferably used are such automatic developing machines.

For developing the exposed, planographic printing plate precursor of the invention, usable are a developer consisting essentially of an alkali silicate such as sodium silicate or potassium silicate, as in JP-A 62004/1979; and a developer consisting essentially of non-reducing sugar such as saccharose or trehalose not having a free aldehyde group and a ketone group and not having reducibility, as in JP-A 305039/1996.

To the developer, optionally added are any of an alkali agent such as potassium hydroxide; a development stabilizer such as glycoalcohol-polyethylene glycol adduct, as in JP-A 282079/1994; a reducing agent such as hydroquinone; a water softener such as ethylenediamine; a nonionic, anionic or ampholytic surfactant; and a polyoxyethylene-polyoxypropylene block copolymer surfactant as in JP-B 54339/1991.

In the developer containing an alkali silicate, the molar ratio of $SiO_2/M_2O$ (M is an alkali metal) preferably falls between 0.3 and 3.0. Developed with it, the plate may have Si adhered to its surface. The amount of Si existing on the surface of the plate may be measured through ESCA. The amount of C, Al, O, S, Si and Ca on the surface is measured individually, and represented in terms of atom.%.

The amount of Si preferably falls between 1 and 25 atom.%, more preferably between 5 and 20 atom.%. Falling within the range, Si is effective for antihalation in IR laser exposure.

On the other hand, when a developer consisting essentially of non-reducing sugar is used, the surface of the aluminum support must be made hydrophilic, for example, through silicate treatment. Also in this case, the amount of Si adhering to the surface of the developed plate preferably falls between 1 and 25 atom.%. In this embodiment, it is desirable that the precursor is processed in an automatic developing machine. A replenisher having a higher alkali strength than the developer running in the machine may be added to the developer to thereby stabilize the development for a long period of time. An anionic surfactant may be added to the replenisher for well dispersing the process sediment and for enhancing the ink-affinity of the image part of the developed printing plate. If desired, a defoaming agent an a water softener may also be added to the replenisher.

Preferably, the developed surface of the planographic printing plate is post-treated with a rinse solution containing a surfactant and with a lipo-desensitizer solution containing arabic gum and a starch derivative. In case where an aqueous solution containing from 5 to 15% by weight, in terms of the solid content, of arabic gum and a starch derivative is used for the lipo-desensitizer, the developed surface of the plate is so protected with it that the wet weight of the solution applied thereto may fall between 1 and 10 ml/m$^2$. Preferably, the dry weight of the lipo-desensitizer on the developed surface of the plate falls between 1 and 5 g/m$^2$.

In case where the printing plate finished in the manner as above is required to have a higher level of printing durability, it is preferably burned, for example, as in JP-B 2518/1986. For this, a leveling agent such as that disclosed in JP-B 28062/1980 may be applied to the surface of the printing plate with sponge or absorbent cotton, or by the use of an automatic coater. In general, the amount (dry weight) of the leveling agent to be applied to the printing plate may fall between 0.3 and 0.8 g/m$^2$.

As in the above, the planographic printing plate precursor of the invention is, after imagewise exposed, developed in an ordinary manner to be a planographic printing plate having a resin image formed thereon. For example, the planographic printing plate precursor having a photosensitive layer of the type [I] mentioned above is, after imagewise exposed, developed with an aqueous alkali solution as in U.S. Pat. No. 4,259,434, whereby the exposed part of the layer is removed and the intended planographic printing plate is finished. On the other hand, the planographic printing plate precursor having a photosensitive layer of the type [II] mentioned above is, after imagewise exposed, developed with a developer as in U.S. Pat. No. 4,186,006, whereby the non-exposed part of the layer is removed and the intended planographic printing plate is finished. Aqueous alkali developers for developing positive, planographic printing plate precursors, such as those described in JP-A 84241/1984, 192952/1982 and 24263/1987 may also be used herein.

EXAMPLES

This embodiment of the invention is described in detail with reference to the following Examples, which, however, are not intended to restrict the scope of the invention.

Example 1

An aluminum alloy plate having the composition shown in Table 6 was processed for <1> alkali-etching, <2> desmutting, <3> electrolytic surface-roughening, <4> alkali-etching, <5> desmutting and <6> anodic oxidation in that order to prepare a support for planographic printing plates.

TABLE 6

(unit: wt. %)

| Fe | Si | Cu | Ti | Mn | Mg | Zn | Cr | Total of other impurities | Al |
|---|---|---|---|---|---|---|---|---|---|
| 0.7 | 0.5 | 0.5 | 0.1 | 1.4 | 1.4 | 0.1 | 0.05 | 0.01 | 95.24 |

<1> Alkali-Etching:

Through spray nozzles, an aqueous alkali solution (NaOH: 27% by weight, aluminum ion: 6.5% by weight) at 70° C. was sprayed onto the aluminum alloy plate to etch it. The degree of dissolution of the surface of the aluminum alloy plate to be electrolytically roughened in the later step was 6 g/m$^2$, while the degree of dissolution of the opposite surface thereof was 1 g/m$^2$.

The data of the NaOH concentration, the aluminum ion concentration, the temperature, the specific gravity and the electroconductivity of the aqueous alkali solution used in this process were previously obtained. The concentration of the aqueous alkali solution running in the device was obtained from the temperature, the specific gravity and the electroconductivity thereof in the data table. Through the data feedback control, the concentration of the aqueous alkali solution was kept all the time constant during the process by adding water and 48 wt. % NaOH to the solution.

After thus etched, the aluminum alloy plate was washed by spraying water thereon. The water jet pressure was 2 kg/cm$^2$, the plate traveling speed was 30 m/min, and the amount of the sprayed water was 5 liters/m$^2$.

<2> Desmutting:

Next, the thus-etched aluminum alloy plate was desmutted with an aqueous hydrochloric acid solution. The solution used for the desmutting treatment is the waste of hydrochloric acid solution used in the next, electrolytic surface-roughening step. Its temperature (at which the plate was processed) was 45° C., and its hydrochloric acid concentration was 7.5 g/liter. Its aluminum concentration was 5 g/liter. The acid solution was sprayed on the plate for 2 seconds to desmut it. Next, the plate was washed in the same manner as in the previous step.

<3> Electrolytic Surface-Roughening:

The desmutted aluminum alloy plate was then electrolytically surface-roughened in a continuous AC-electrolytic process. A commercial alternating current of 60 Hz was regulated through a transformer and a inductance regulator into a sine waveform AC, and applied to the aluminum alloy plate. The ratio of the quantity of electricity QA to the aluminum alloy plate acting as an anode, to the quantity of electricity QC to the counter cathode, QC/QA is 1; and the AC duty is 1. The pulse rise up from 0 to the peak is 4.15 msec.

The electrolytic cell unit of FIG. 5 was used, in which the main electrode was a carbon electrode. The ratio QC/QA while the plate passes through the cell 10 in FIG. 5 was 0.95. The electrolytic solution used for the treatment was prepared by adding aluminum chloride to an aqueous solution having a hydrochloric acid concentration of 7.5 g/liter to have an aluminum ion concentration of 5 g/liter. Its temperature was 45° C.

The peak current density was 50 A/dm$^2$ both for the anodic reaction and the cathodic reaction of the aluminum alloy plate. The total quantity of electricity to the aluminum alloy plate acting as an anode was 400 C/dm$^2$. After thus electrolytically surface-roughened, the plate was washed with water in the same manner as in the previous steps.

The concentration of the aqueous hydrochloric acid solution used in this process was controlled as follows: Stock 35 wt. % HCl and water were added to the solution in proportion to the current applied to the system, while the same volume of the acidic electrolytic solution as the volume of the hydrochloric acid and water added to the running solution was kept overflowing out of the system. On the other hand, the data of the hydrochloric acid concentration, the aluminum ion concentration, the temperature and the electroconductivity of the aqueous hydrochloric acid solution used in this process and the speed of ultrasonic propagation through the solution were previously obtained. The concentration of the aqueous hydrochloric acid solution running in the AC-electrolytic cell unit was obtained from the temperature and the electroconductivity of the solution and the speed of ultrasonic propagation through the solution in the data table. Through the data feedback control, the concentration of the aqueous hydrochloric acid solution was kept all the time constant during the process by adding water and stock hydrochloric acid to the solution. The overflow from the unit was taken out of the system.

<4> Alkali-Etching:

Through spray nozzles, an aqueous alkali solution (NaOH: 5% by weight, aluminum ion: 0.5% by weight) at 45° C. was sprayed onto the thus-electrolyzed aluminum alloy plate to etch it. The degree of dissolution of the surface of the aluminum alloy plate that had been electrolytically roughened in the previous step was 0.1 g/m$^2$, and the degree of dissolution of the opposite surface thereof was 0.1 g/m$^2$.

The data of the NaOH concentration, the aluminum ion concentration, the temperature, the specific gravity and the electroconductivity of the aqueous alkali solution used in this process were previously obtained. The concentration of the aqueous alkali solution running in the device was obtained from the temperature, the specific gravity and the electroconductivity thereof in the data table. Through the data feedback control, the concentration of the aqueous alkali solution was kept all the time constant during the process by adding water and 48 wt. % NaOH to the solution. After thus etched, the aluminum alloy plate was washed in the same manner as in the previous steps.

<5> Desmutting:

Next, the thus-etched aluminum alloy plate was desmutted with an aqueous sulfuric acid solution. The sulfuric acid concentration of the solution was 300 g/liter, and the aluminum ion concentration thereof was 5 g/liter. The temperature of the solution was 70° C. The acid solution was sprayed on the plate for 2 seconds to desmut it. The concentration of the acid solution running in the device was controlled as follows: The data of the sulfuric acid concentration, the aluminum ion concentration, the temperature, the specific gravity and the electroconductivity of the sulfuric acid solution used in this process were previously obtained. The concentration of the acid solution running in the device was obtained from the temperature, the specific gravity and the electroconductivity thereof in the data table. Through the data feedback control, the concentration of the acid solution was kept all the time constant during the process by adding water and 50 wt. % sulfuric acid to the solution. After thus desmutted, the aluminum alloy plate was washed in the same manner as in the previous steps.

<6> Anodic Oxidation:

In an electrolytic, aqueous sulfuric acid solution containing 100 g/liter of sulfuric acid and 5 g/liter of aluminum ions and having a bath temperature of 50° C., the aluminum alloy plate having been processed in the previous steps was subjected to anodic oxidation, with a direct current applied thereto. The condition for the anodic oxidation was so controlled that the amount of the oxide film formed on the web could be 2.4 g/m$^2$. The voltage was 20 V; the current density was 10 A/dm$^2$; and the processing time for electrolysis was 30 seconds. The concentration of the electrolytic solution running in the device was controlled as follows: The data of the sulfuric acid concentration, the aluminum ion concentration, the temperature, the specific gravity and the electroconductivity of the sulfuric acid solution used in this process were previously obtained. The concentration of the acid solution running in the device was obtained from the temperature, the specific gravity and the electroconductivity thereof in the data table. Through the data feedback control, the concentration of the acid solution was kept all the time constant during the process by adding water and 50 wt. % sulfuric acid to the solution. After thus processed for anodic oxidation, the aluminum alloy plate was washed in the same manner as in the previous steps.

Through the process as above, produced was a support for planographic printing plates.

This was observed with a scanning electronic microscope (×750). It was confirmed that the surface of the support was uniformly roughened and favorable to planographic printing plates.

Example 2

A support for planographic printing plates was produced in the same manner as in Example 1, for which, however, a trapezoidal waveform AC was applied to the aluminum alloy plate in the step of electrolytically surface-roughening it. In the electrolytically surface-roughening step in this, the AC frequency was 60 Hz, and the pulse rise up time from zero to the peak, Tp was 2 msec. The peak current density was 50 A/dm$^2$ both for the anodic reaction and the cathodic reaction of the aluminum alloy plate. The total quantity of electricity to the aluminum alloy plate acting as an anode was 400 C/dm$^2$.

The support thus produced herein was observed with a scanning electronic microscope (×750). It was confirmed that the surface of the support was uniformly roughened and favorable to planographic printing plates.

Example 3

A support for planographic printing plates was produced in the same manner as in Example 1, for which, however, the aluminum alloy plate was mechanically surface-roughened prior to the alkali-etching treatment <1> and the total quantity of electricity to the aluminum alloy plate acting as an anode in the electrolytic surface-roughening treatment in the aqueous hydrochloric acid solution was 50 C/dm$^2$.

In this, the aluminum alloy plate was mechanically surface-roughened in the following manner. With an abrasive slurry suspension that had been prepared by suspending siliceous sand having a specific gravity of 1.12 in water being applied thereto, the surface of the plate was rubbed with rotating nylon brush rollers. Each nylon brush roller, No. 3 was made of 6,10-nylon, and the length of the nylon hairs was 50 mm. The nylon hairs were densely planted into the holes in the entire surface of a stainless roller having a diameter of 300 mm. Three such nylon brush rollers were used. Two support rollers (200 mmϕ) were disposed below the brush rollers, spaced from them by 300 mm. The load of the power motor to drive the brush rollers was controlled relative to the load of the aluminum alloy plate before pressed by the brush rollers. Concretely, the brush rollers were pressed against the aluminum alloy plate so that the mean surface roughness (Ra) of the roughened surface of the plate could fall between 0.3 and 0.4 μm (central value: 0.35 μm). The direction of the brush rotation was the same as the traveling direction of the aluminum alloy plate. After thus mechanically surface-roughened, the plate was washed with water. The concentration of the abrasive slurry used in the process was controlled as follows: The data of the abrasive concentration, the temperature and the specific gravity of the abrasive slurry used in this process were previously obtained. The concentration of the abrasive slurry running in the device was obtained from the temperature and the specific gravity thereof in the data table. Through the data feedback control, the concentration of the abrasive slurry was kept all the time constant during the process by adding water and siliceous sand abrasive to the slurry. While used, siliceous sand is ground and its grain size decreases. If such fine grains of siliceous sand are kept used in the process, the profile of the roughened surface of the aluminum alloy plate varies. To evade the problem, fine grains of the siliceous sand abrasive used in this process were successively removed from the system through a cyclone. During the process, the grain size of the siliceous sand in the abrasive slurry was kept falling between 1 and 15 μm. Measured with a Horiba's laser analyzer (LA910), the volume-average grain size of the abrasive slurry used in the process was 8 μm.

The support thus produced herein was observed with a scanning electronic microscope (×750). It was confirmed that the surface of the support was uniformly roughened and favorable to planographic printing plates.

Example 4

A support for planographic printing plates was produced in the same manner as in Example 1, for which, however, an aluminum material JIS 1050H was used for the aluminum alloy plate.

The support thus produced herein was observed with a scanning electronic microscope (×750) It was confirmed that the surface of the support was uniformly roughened and favorable to planographic printing plates.

Example 5

A support for planographic printing plates was produced in the same manner as in Example 3, for which, however, the current density in the electrolytic surface-roughening step was 5 A/dm$^2$, the quantity of electricity to the aluminum alloy plate acting as an anode was 100 C/dm$^2$, and the degree of aluminum dissolution in the alkali-etching step after the electrolytic surface-roughening step (on the electrolytically roughened surface of the plate) was 0.3 g/m$^2$.

The support thus produced herein was observed with a scanning electronic microscope (×750). It was confirmed that the surface of the support was uniformly roughened and favorable to planographic printing plates.

Example 6

A support for planographic printing plates was produced in the same manner as in Example 1, for which, however, the aluminum alloy plate was activated by spraying it with an aqueous solution containing 2.0 g/liter of dimethylaminoborane at 40° C. for 5 seconds before the electrolytic surface-roughening step, and then washed with water in the same manner as in Example 1.

The support thus produced herein was observed with a scanning electronic microscope (×750). It was confirmed that the surface of the support was uniformly roughened and favorable to planographic printing plates.

Example 7

A support for planographic printing plates was produced in the same manner as in Example 3, for which, however, the aluminum alloy plate was activated by spraying it with an aqueous solution containing 2.0 g/liter of dimethylaminoborane at 40° C. for 5 seconds before the electrolytic surface-roughening step, and then washed with water in the same manner as in Example 3.

The support thus produced herein was observed with a scanning electronic microscope (×750). It was confirmed that the surface of the support was uniformly roughened and favorable to planographic printing plates.

Example 8

The planographic printing plate supports produced in Examples 1 to 7 each were coated with an undercoat layer (dry weight: 0.01 g/m$^2$) and a positive photosensitive layer (dry weight: 1.0 g/m$^2$) as in Example 1 of JP-A 149491/1985 and dried to fabricate planographic printing plate precursors. As in Example 1 of JP-A 149491/1985, these were exposed to light and developed to be planographic printing plates. The thus-produced printing plates were tested for printability. It was confirmed that they are all good, causing neither blanket staining nor serious ink stains on the printed matters.

Their printability was evaluated as follows: After the printing test, the blanket was checked as to how and to what degree ink had adhered thereto. This indicates the blanket staining. The printed matters were checked as to how and to what degree ink spots were seen in the non-image area thereof. This indicates the presence or absence of serious ink stains on the printed matters. The printing plates having caused little blanket staining and few ink stains on the printed matters were evaluated good (the same shall apply hereinunder)

Example 9

The planographic printing plate supports produced in Examples 1 to 7 each were made hydrophilic by dipping them in an aqueous solution containing 2.5% by weight of No. 3 sodium silicate at 70° C. for 10 seconds, and thereafter coated with an undercoat layer (dry weight: 0.05 g/m$^2$) and a negative photosensitive layer (dry weight: 2.0 g/m$^2$) as in Example 1 of JP-A 101651/1984 and dried to fabricate planographic printing plate precursors. As in Example 1 of JP-A 101651/1984, these were exposed to light and developed to be planographic printing plates. The thus-produced printing plates were tested for printability. It was confirmed that they are all good, causing neither blanket staining nor serious ink stains on the printed matters.

Example 10

The planographic printing plate supports produced in Examples 1 to 7 each were made hydrophilic by dipping them in an aqueous solution containing 1% by weight of No. 3 sodium silicate at 30° C. for 10 seconds, and thereafter coated with an undercoat layer (dry weight: 0.01 g/m$^2$) and a positive, IR laser-exposable photosensitive layer (dry weight: 1.8 g/m$^2$) as in Example 1 of JP-A 62333/2000 and dried to fabricate planographic printing plate precursors. As in Example 1 of JP-A 62333/2000, these were exposed to light and developed to be planographic printing plates. The thus-produced printing plates were tested for printability. It was confirmed that they are all good, causing neither blanket staining nor serious ink stains on the printed matters.

Example 11

The planographic printing plate supports produced in Examples 1 to 7 each were coated with an undercoat layer (dry weight: 0.11 g/m$^2$) and a negative, IR laser-exposable photosensitive layer (dry weight: 1.5 g/m$^2$) as in Example 2 of JP-A 62333/2000, and dried to fabricate planographic printing plate precursors. As in Example 2 of JP-A 62333/2000, these were exposed to light and developed to be planographic printing plates. The thus-produced printing plates were tested for printability. It was confirmed that they are all good, causing no serious ink stains on the printed matters.

Example 12

The planographic printing plate supports produced in Examples 1 to 7 each were coated with an undercoat layer (dry weight: 0.02 g/m$^2$), a photopolymer-containing, laser-exposable photosensitive layer (dry weight: 1.5 g/m$^2$) and a protective layer (dry weight: 2 g/m$^2$) as in Example 3 of JP-A 62333/2000, and dried to fabricate planographic printing plate precursors. As in Example 3 of JP-A 62333/2000, these were exposed to light and developed to be planographic printing plates. The thus-produced printing plates were tested for printability. It was confirmed that they are all good, causing neither blanket staining nor serious ink stains on the printed matters.

Example 13

Before coated with a photosensitive layer, the planographic printing plate supports produced in Examples 1 to 3 were analyzed for their physical properties. The mean surface roughness Ra was 0.5, 0.55 and 0.35 $\mu$m; the value L* was 80, 85, 75; and the delta Eab* was 0.5, 0.8 and 0.5, respectively. The surface profiles of the supports were all good and favorable for printing plates. Having such a good and uniform appearance, the plates all passed the plate inspection test.

For the mean surface roughness (Ra), the supports were analyzed with Tokyo Precision Instruments' Surfcom 575A (probe diameter; 2 $\mu$mR) according to JIS B 0601-1982; and for the value L* and the delta Eab*, they were analyzed with Suga Test Instruments' SM-3-SCH according to JIS Z 8729-1980 and JIS Z 8730-1980, respectively.

Example 14

A support for planographic printing plates was produced in the same manner as in Example 1, for which, however, the processed aluminum alloy plate was washed with dry ice powder and not with water.

Concretely, the washing condition with dry ice powder was as follows: The dry ice powder used had a volume-average grain size of 100 $\mu$m. The $CO_2$ supply (in terms of the solid weight) per one spray nozzle was 0.24 kg/min, and the supply pressure was 6 MPa.

The support thus produced herein was observed with a scanning electronic microscope (×750). It was confirmed that the surface of the support was uniformly roughened and favorable to planographic printing plates. Another advantage of this process is that the waste was significantly reduced as compared with the washing treatment with water, and the cost for waste treatment was reduced.

Example 15

A support for planographic printing plates was produced in the same manner as in Example 2, for which, however, the processed aluminum alloy plate was washed with dry ice powder and not with water.

Concretely, the washing condition with dry ice powder was as follows: The dry ice powder used had a volume-average grain size of 50 $\mu$m. The $CO_2$ supply (in terms of the solid weight) per one spray nozzle was 0.12 kg/min, and the supply pressure was 3 MPa.

The support thus produced herein was observed with a scanning electronic microscope (×750). It was confirmed that the surface of the support was uniformly roughened and favorable to planographic printing plates. Another advantage of this process is that the waste was significantly reduced as compared with the washing treatment with water, and the cost for waste treatment was reduced.

Example 16

A support for planographic printing plates was produced in the same manner as in Example 2, for which, however, the processed aluminum alloy plate was washed with dry ice powder and not with water.

Concretely, the washing condition with dry ice powder was as follows: The dry ice powder used had a volume-average grain size of 80 $\mu$m. The $CO_2$ supply (in terms of the solid weight) per one spray nozzle was 0.18 g/min, and the supply pressure was 7 MPa.

The support thus produced herein was observed with a scanning electronic microscope (×750) It was confirmed that the surface of the support was uniformly roughened and favorable to planographic printing plates. Another advantage of this process is that the waste was significantly reduced as compared with the washing treatment with water, and the cost for waste treatment was reduced.

Comparative Example 1

A support for planographic printing plates was produced in the same manner as in Example 1, for which, however, a trapezoidal waveform AC was applied to the aluminum alloy plate in the step of electrolytically surface-roughening it. In the electrolytically surface-roughening step in this, the ratio of the quantity of electricity QA to the aluminum alloy plate acting as an anode to the quantity of electricity QC thereto acting as a cathode, QC/QA was 0.85; the AC duty was 0.25; and the pulse rise up time from zero to the peak was 0.05 msec.

The support thus produced herein was observed with a scanning electronic microscope (×750). The support had deep and large recesses unevenly in its processed surface, and this was not favorable to planographic printing plates.

As described in detail hereinabove, this embodiment of the invention makes it possible to use any rough aluminum alloy plates for planographic printing plate supports even though the alloying components of the plates are not specifically controlled, and it provides a method of stably and inexpensively producing planographic printing plate precursors from rough aluminum alloy plates; the planographic printing plate supports produced in the method; and planographic printing plate precursors comprising the support. The printing plates from the precursors are good, not causing serious ink stains in printed matters.

Fourth Embodiment:

The fourth embodiment of the invention is to provide a method for inspecting aluminum plates for planographic printing plate supports. One example of the method is shown in FIGS. 6A to 6C.

Figure 6A:
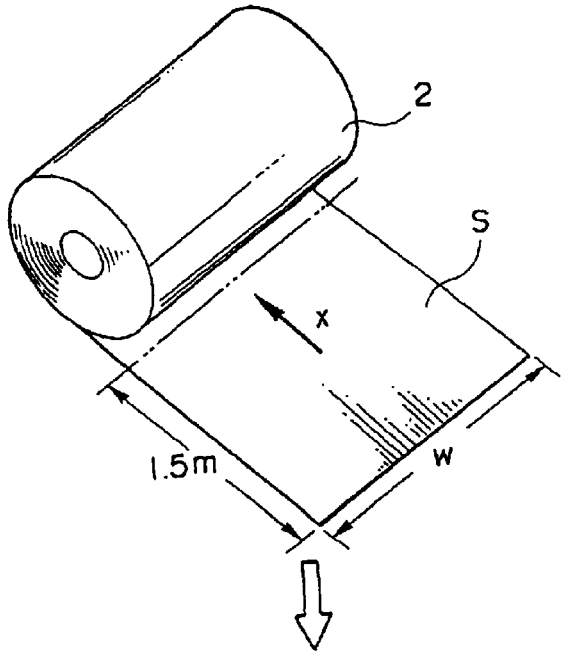
FIGS. 6A to 6C are views showing one example of the method of the fourth embodiment of the invention for measuring the edge strains of an aluminum plate for planographic printing plate supports, illustrating the outline of the process for the measurement.
Figure 6B:
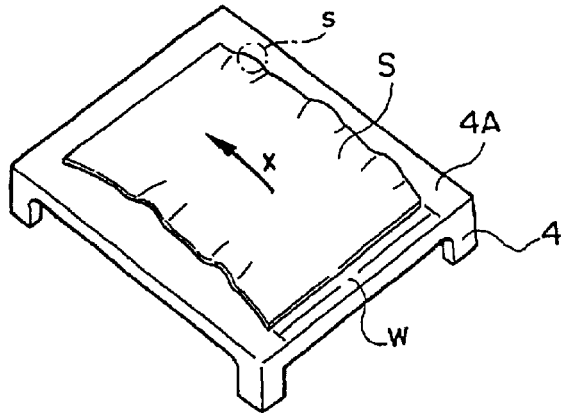

As in FIG. 6A, the aluminum coil 2 is uncoiled at one end, and cut along the two-dot line drawn in the cross direction of the uncoiled plate, or that is, in the direction perpendicular to the winding direction of the coil 2 to prepare a sample S for inspection. The length of the sample S in the coiling direction of the coil 2, or that is, in the machine direction, x, of the aluminum plate is 1.5 m. However, the length of the sample S is not limited to 1.5 m as in the illustrated case, but may be suitably determined in accordance with the size of the level table 4 to be used in the inspection method. The width of the aluminum plate is 1 m, and therefore the width of the sample S is also 1 m. However, the width of the aluminum plate to be inspected is not limited to 1 m as in the illustrated case. In general, the width of the aluminum plate may fall between 0.65 and 1.6 m.

The sample S is generally curved inward in the direction perpendicular to the machine direction of the coil 2. Therefore, as in FIG. 6B, the sample S is so set on the inspection face 4A of the level table 4 that its outward curved face is upside. The level table 4 is one example of the sample stand in this embodiment, and its inspection face 4A corresponds to the sample-receiving face of the sample stand.

Figure 6C:
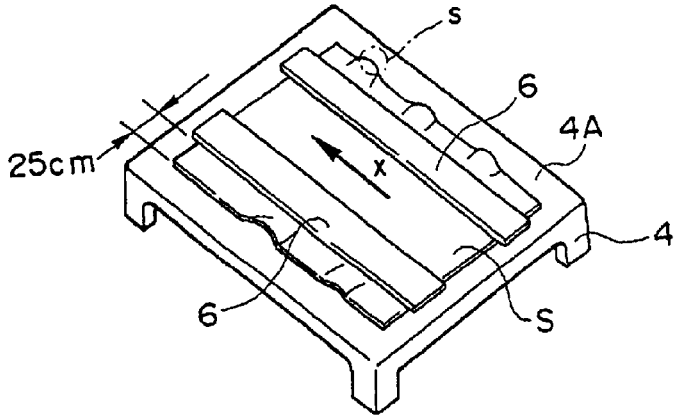

Next, as in FIG. 6C, long rectangular weights 6 are put on the sample S, parallel to the machine direction x to cover the overall length of the sample S in that direction x.

In this embodiment, two such weights 6 are put on the sample S in such a manner that they are parallel to each other and the outer side edge of each weight is 25 cm inside the adjacent side edge of the sample S, but the position of the outer side edge of each weight 6 is not limited to the illustrated configuration. Preferably, however, the weights 6 are so positioned that the outer side edge of each weight is inside the adjacent side edge of the sample S by 0.1 w to 0.3 w, w indicating the width of the sample S.

In the illustrated example of this embodiment, each weight 6 weighs 200 g. However, so far as the center part of the sample S can be tightly kept on the inspection face 4A of the level table 4 by the weights 6, the load of each weight 6 is not specifically defined.

Figure 7:
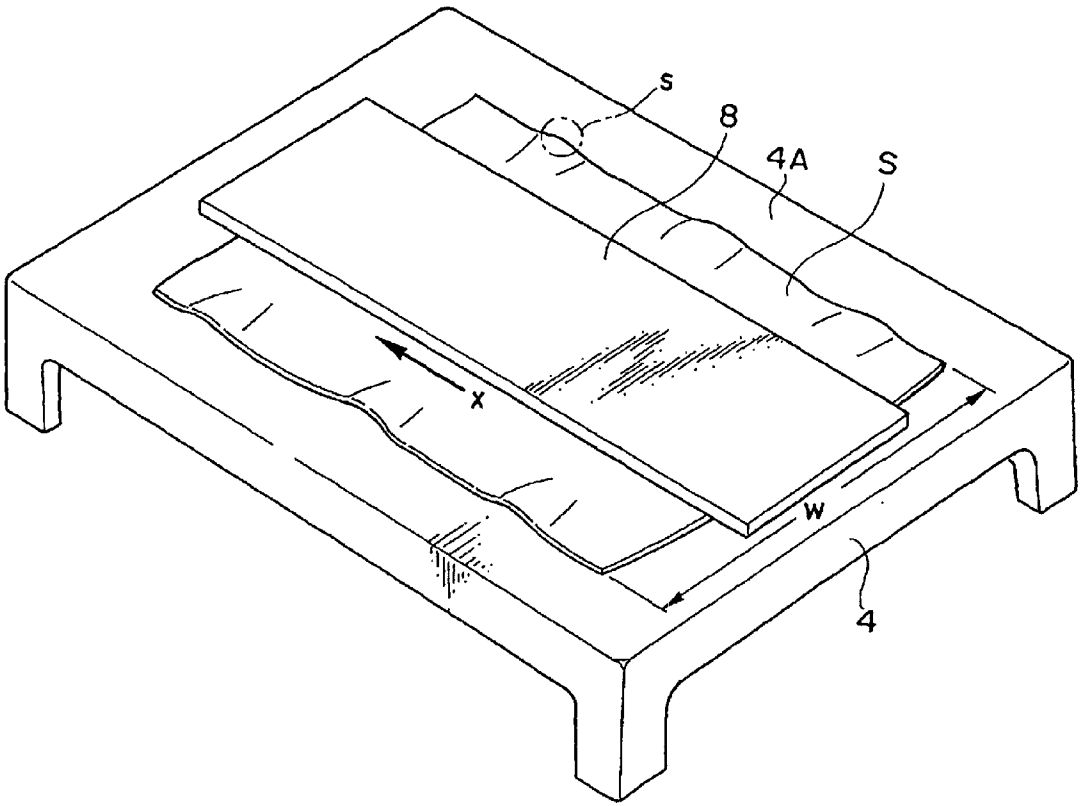
FIG. 7 is a perspective view showing another example of the method of FIG. 6 for measuring the edge strains of an aluminum plate, in which one wide tabular weight is put on the top surface of the sample set on the sample-receiving surface of a level table.

In place of putting two, relatively narrow weights 6 on the sample S, only one, relatively wide weight 8 may be put on the center part of the sample S to cover the overall length of the sample S in the machine direction x thereof, as in FIG. 7. In this case, the width of the weight 8 preferably falls between 0.4 w and 0.8 w, and the length of the weight 8 is preferably larger than the machine-direction length of the sample S. Also preferably, the side edges of the weight 8 are inside the side edges of the sample S by 0.1 w to 0.3 w.

Figure 8:
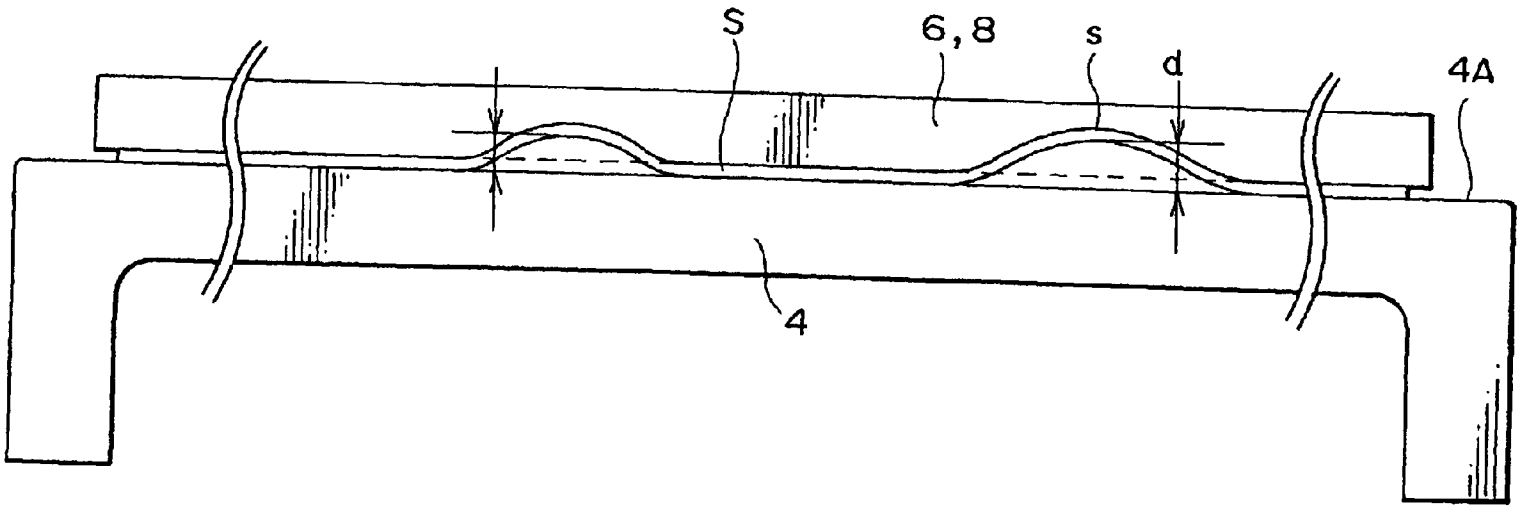
FIG. 8 is a side view showing the condition of the sample on the level table in the method of FIG. 6 for measuring the edge strains of an aluminum plate, in which the sample is firmly put on the sample-receiving surface of the level table.

FIG. 8 is a side view of the sample S with the weights 6 or the weight 8 being put thereon. In case where the edge of sample S is deformed to have a waved deformation, edge strain s, as in FIG. 8, the edge strain s rises up from the inspection face 4A like a wave or a sine curve. The height of the edge strain s is indicated by the distance d between the inspection face 4A and the top of the rising part, or that is, the top of the edge strain s. For obtaining the distance d, for example, a taper gauge is inserted into the gap between the edge strain s and the inspection face 4A, and, at the position at which the taper gauge is contacted with the back face of the edge strain s of the sample S, the scale of the taper gauge is read. This indicates the distance d. It is considered that the scale not larger than 0.2 mm read on the paper gauge in that manner, or that is, the deformation of the sample S not larger than 0.2 mm in terms of the height from the inspection face 4A will not almost lead to any plate feed disorder or printing failure, and the plate deformation to such a degree may be disregarded in considering the edge strain s.

In case where an aluminum plate or web such as that mentioned hereinabove is roughened on its surface and processed for anodic oxidation thereon to prepare a support for planographic printing plates, it is desirable that its sample S satisfies the following conditions in point of the number of edge stains in the direction perpendicular to the direction in which the sample S is cut out of the processed web, the total height of all the edge strains and the maximum height of the edge strains. Specifically, on one side edge of the sample in the machine direction, the number of the edge strains/1.5 m is preferably at most 5; the total height of all the edge strains is preferably at most 4 mm; and the maximum height of the edge strains is preferably at most 2 mm. In terms of the unit length, 1 m of the sample S, the preferred number of the edge strains s is 3.334, and the preferred total height of all the edge strains is 2.666 mm. The total height of all the edge strains s is obtained by measuring the height of each edge strain in the manner indicated hereinabove followed by totaling the data of the thus-measured height of all the edge strains in the predetermined length of the sample S in the machine direction thereof.

Satisfying the above-mentioned conditions in point of the number of the edge strains s on one side edge of its sample cut in its machine direction x to have a length of 1.5 m, the total height of all the edge strains and the maximum height of the edge strains, the aluminum plate or web is especially favorable for planographic printing plate supports, as it does not meander and does not involve any other feed disorder when processed into planographic printing plate supports and into planographic printing plate precursors.

Figure 9:
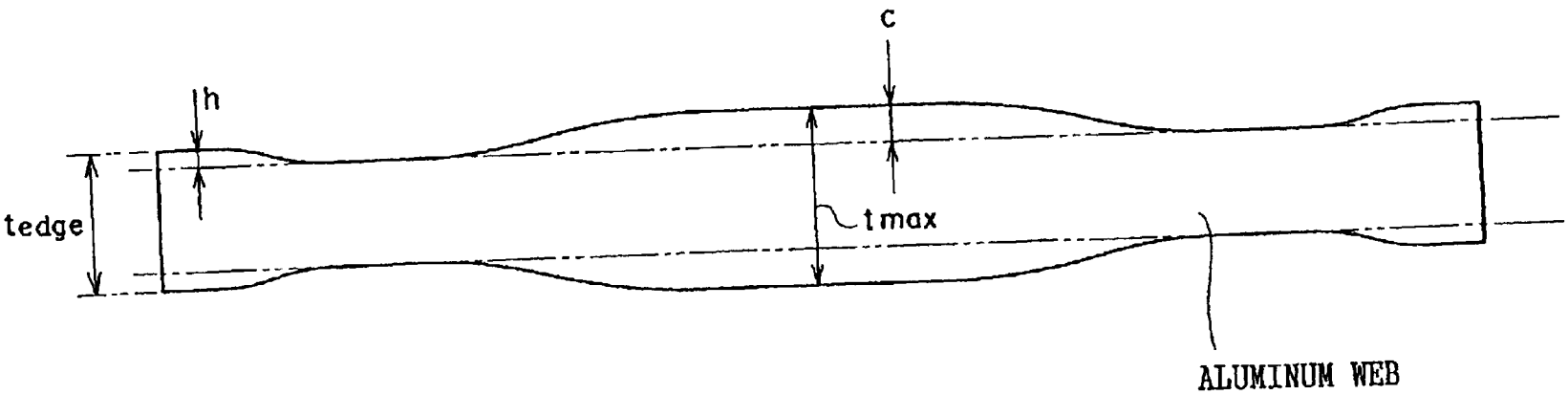
FIG. 9 is a cross-sectional view showing one example of the cross section of an aluminum web for planographic printing plate supports of the fourth embodiment of the invention.

Preferably, the cross-sectional profile of the aluminum plate or web is so controlled that its center part is thick and the area around its edges is thin, as in FIG. 9. This is in order that the aluminum plate or web is, when wound up in coils, prevented from being deformed at the edges tightly coiled up.

In this connection, the value a and the value pc defined by the following equations are preferably at most 1% and at most 2%, respectively. Not overstepping the defined limits, the thickness of the center part of the aluminum plate or web is not too large and the thickness of the area around the edges thereof is not too small as compared with the mean thickness of the overall width of the aluminum plate or web. The value a and the value pc are defined as follows:

$$a=h/c,$$

$$pc=c/t_{max},$$

wherein $h=t_{min}-t_{edge}$; $c=t_{max}-t_{min}$; $t_{max}$=the maximum thickness of the center part of the aluminum plate or web; $t_{min}$=the minimum thickness of the aluminum plate or web; $t_{edge}$=the thickness of the edges of the aluminum plate or web.

Fifth Embodiment:

The fifth embodiment of the invention is to provide another method for inspecting aluminum plates for planographic printing plate supports. One example of the method is shown in FIGS. 10A to 10C, in which the same reference numerals as those in FIGS. 6 to 8 have the same meanings as in FIGS. 6 to 8.

Figure 10A:
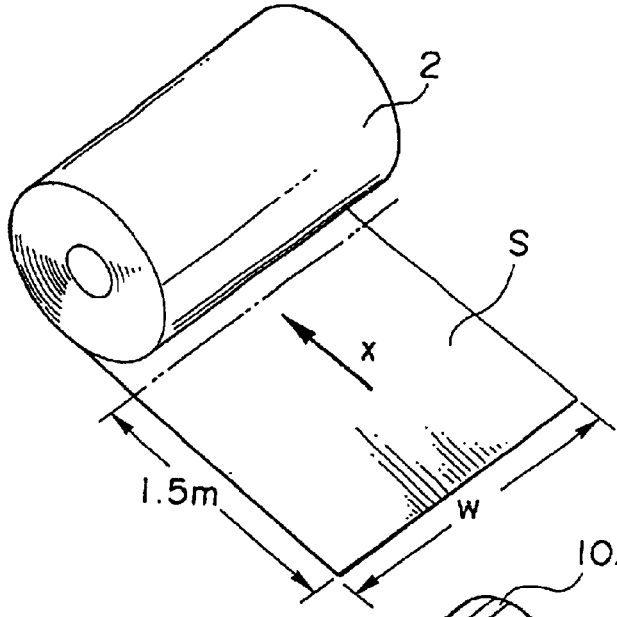
FIGS. 10A to 10C are views showing another example of the method of the fifth embodiment of the invention for measuring the edge strains of an aluminum plate for planographic printing plate supports, illustrating the outline of the process for the measurement.

Also in the inspection method of the fifth embodiment, the aluminum coil 2 is uncoiled at one end, and cut along the two-dot line drawn in the cross direction of the uncoiled plate, or that is, in the direction perpendicular to the winding direction of the coil 2 to prepare a sample S for inspection, as in FIG. 10A. The length of the sample S in the machine direction, x, of the aluminum plate is 1.5 m. This step is the same as in the inspection method of the fourth embodiment mentioned hereinabove.

Figure 10B:
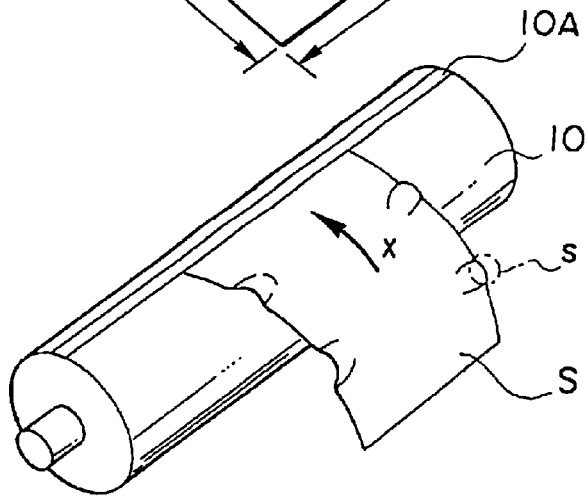

Next, one end of the sample S is fixed on the surface of the blanket 10 of an offset printer by means of a fixing device 10A, with its curved face inside as in FIG. 10B.

Figure 10C:
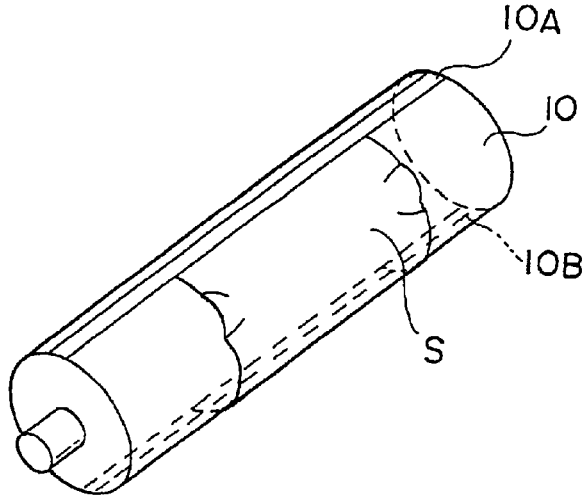

With that, the sample S is wound around the blanket 10 under tension so that its curved face is tightly fitted to the surface of the blanket 10, and the other free end of the sample S is fixed to the surface of the blanket 10 by means of a fixing device 10B similar to the fixing device 10A, as in FIG. 10C.

Figure 11:
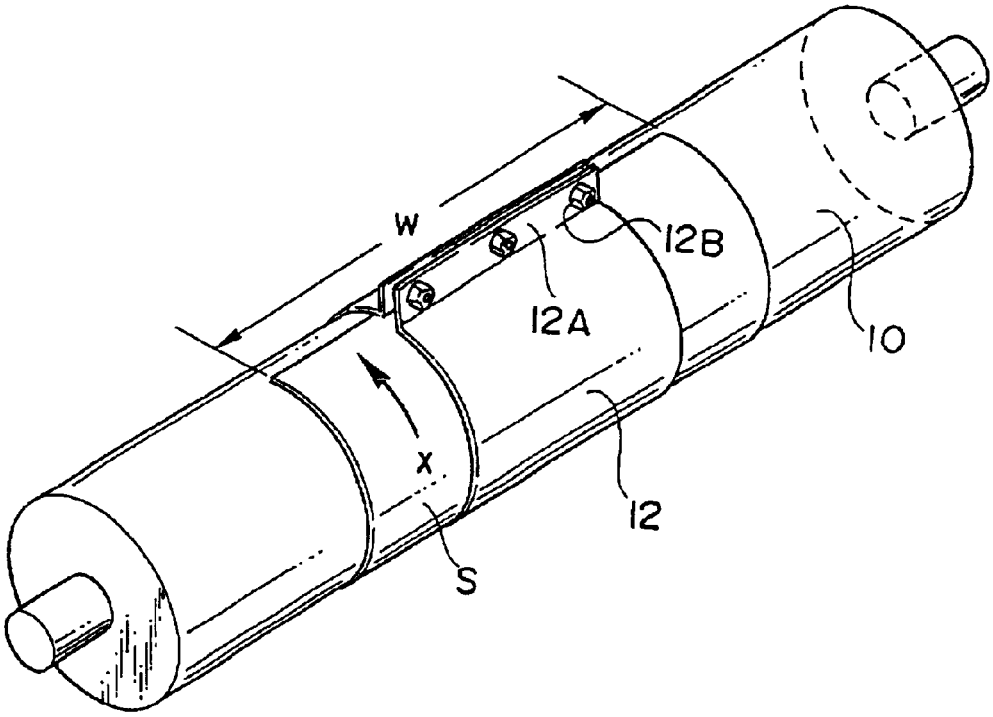
FIG. 11 is a perspective view of one example of the method for measuring the edge strains of an aluminum plate for planographic printing plate supports illustrated in FIGS. 10A to 10C, in which is used a press cylinder for contacting the sample to the blanket.

In the inspection method of the fifth embodiment, the sample S may be tightly fitted to the surface of the blanket 10 by covering it with a pressure cylinder 12 in the machine direction x of the sample S at its center part and buckling up the pressure cylinder 12, as in FIG. 11, in place of winding the sample S around the blanket 10 under tension as in FIG. 10. For example, the structure of the pressure cylinder 12 is as follows: The outer diameter of the pressure cylinder 12 is smaller in some degree than that of the blanket 10, the pressure cylinder 12 is cut along its length, and the cut edges have a pair of flanges 12A by which the pressure cylinder 12 is fitted to the sample S. After the sample S is covered with the pressure cylinder 12, the pressure cylinder 12 is buckled up by screwing the bolts 12B fitted to the flanges 12A, whereby the center part of the sample S is tightly fitted to the blanket 10 below the inner peripheral surface of the pressure cylinder 12, as in FIG. 11.

Preferably, the length of the pressure cylinder 12 falls between 0.4 w and 0.8 w, with w indicating the width of the sample S. The pressure cylinder 12 may be made of a thin and tough metal plate such as a thin stainless steel plate, or a rigid synthetic resin plate. Preferably, the pressure cylinder 12 is so set around the sample S that it does not reach the edges of the sample S, as in FIG. 11.

Figure 12:
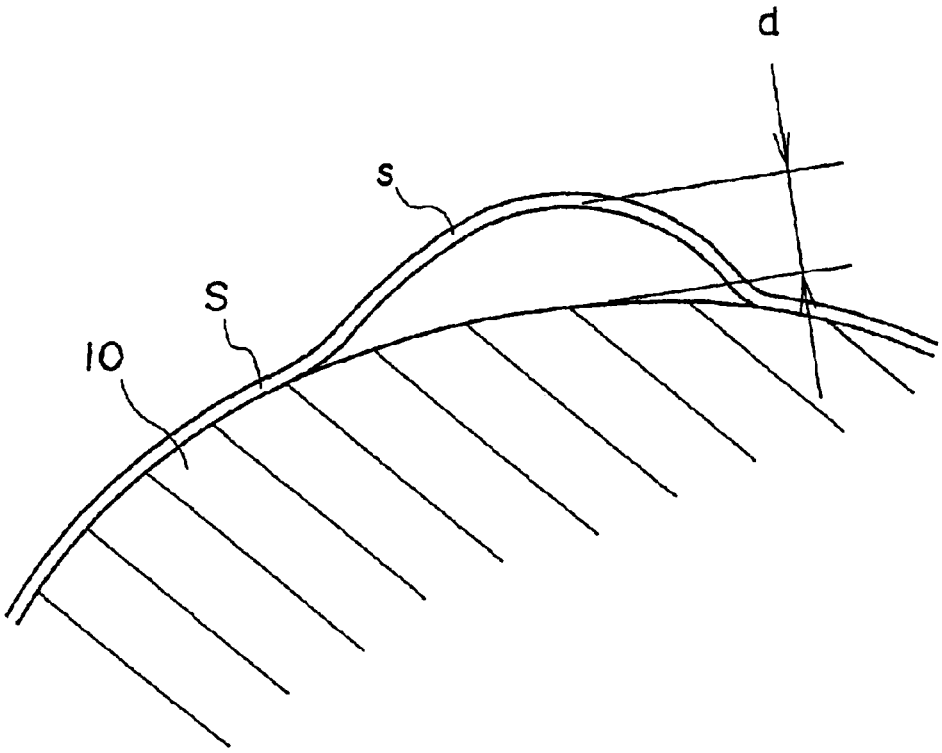
FIG. 12 is a view showing the side edge of the aluminum plate for planographic printing plate supports inspected in the inspection method illustrated in FIG. 11, in which the sample S is wound around the blanket 10 to be in contact with it.

FIG. 12 shows the sample S tightly fitted around the blanket 10. As in FIG. 12, the center part of the sample S is airtightly fitted to the surface of the blanket 10. However, if the edges of the sample S are deformed to have wavelike edge strains s, the edge strains s rise up from the surface of the blanket 10 like a wave or a sine curve. The height of the edge strain s is indicated by the distance d between the surface of the blanket 10 and the top of the rising part, or that is, the top of the edge strain s. For obtaining the distance d, for example, a taper gauge is inserted into the gap between the edge strain s and the blanket 10, and, at the position at which the taper gauge is contacted with the back face of the edge strain s of the sample S, the scale of the taper gauge is read. This indicates the distance d. The scale not larger than 0.2 mm read on the paper gauge in that manner, or that is, the deformation of the sample S not larger than 0.2 mm in terms of the height from the surface of the blanket 10 may be disregarded in considering the edge strain s, for the same reasons as in the fourth embodiment mentioned above. For the preferred ranges of the number of the edge strains s in a predetermined length in the machine direction x of one edge of the sample S, for example, in 1.5 m thereof, the total height of all the edge strains therein and the maximum height of the edge strains therein, referred to are the same as those in the fourth embodiment.

EXAMPLES

This embodiment of the invention is described in detail with reference to the following Examples, which, however, are not intended to restrict the scope of the invention.

Examples 1 and 2, Comparative Examples 1 to 3

Two materials of different compositions as in Table 7 below were worked into aluminum web samples of Examples and Comparative Examples.

TABLE 7

| | Fe | Si | Cu | Ti | Mn | Mg | Zn | Cr | Total of other impurities | Al |
|---|---|---|---|---|---|---|---|---|---|---|
| | (unit: wt. %) | | | | | | | | | |
| Composition 1 | 0.7 | 0.50 | 0.5 | 0.10 | 1.4 | 1.4 | 0.1 | 0.05 | 0.01 | 95.24 |
| Composition 2 | 0.3 | 0.15 | 0.1 | 0.03 | 0.1 | 0.1 | 0.1 | 0.01 | 0.01 | 99.10 |

Precisely, the materials were separately DC-cast into slabs, which were chamfered and then soaked at 550° C. for 5 hours. After their temperature was lowered to 400° C., the slabs were hot-rolled, then cold-rolled to have a reduced thickness of 2 mm, and thereafter continuously annealed at 500° C. These were further cold-rolled to have a final thickness of 0.24 mm, then leveled with a tension leveler, and slit through a slitter into long aluminum webs having a width of 1030 mm. While slit, each web was wound up in coils. The cold-rolling condition was varied by varying the roll bending condition and the tension leveler condition, and different coils of Example 1, Example 2 and Comparative Examples 1 to 3 were thus prepared.

Each coil was uncoiled at its end, and a tabular sample having a length of 1500 mm was cut out of it. This was tested according to the process described in the section of the fourth embodiment as above, for the number of edge strains s, the total height of all the edge strains, and the maximum height of the edge strains. In addition, a sample plate having a length of 4 m was cut out of each coil, put on a flat-faced stand, and checked for curvature. The data are shown in Table 8.

In the etching steps (1) and (2), the etchant used was an alkali solution of NaOH having an NaOH concentration of 26% by weight and an aluminum ion concentration of 6.5% by weight. Its temperature was 65° C.

In the AC-electrolytic surface-roughening step, used was an acidic electrolytic solution of nitric acid having a nitric acid concentration of 1% by weight and an aluminum ion concentration of 0.5% by weight.

In the anodic oxidation step, the electrolytic solution used was a 15 wt. % sulfuric acid solution. A direct current was applied to the aluminum plate to form an oxide film thereon through anodic oxidation. Next, the aluminum plate was processed with an aqueous 3 wt. % sodium silicate solution at 20° C. for 10 seconds to thereby make the surface thereof hydrophilic, as in EP-A 904,954, paragraph [0153].

In the next undercoating step, a solution in methanol and water of a polymer having styrene units with the benzene ring of the unit substituted with any of carboxyl group, quaternary ammonium group, phosphonium group and phosphonic acid group was applied onto the surface of the aluminum plate which had been made hydrophilic, at 80° C. for 15 seconds to thereby form an undercoat layer thereon, as in the same paragraph of the above-mentioned EP-A. The dry thickness of the undercoat layer was 15 mg/m$^2$.

TABLE 8

| | Aluminum Composition | Edge Strains (per 1.5 m) Number | Maximum Height (mm) | Total Height (mm) | Profile of Cross Section value a | value pc | Curvature (mm) |
|---|---|---|---|---|---|---|---|
| Example 1 | composition 1 | 2 | 1.5 | 2.9 | 0.5 | 1.5 | 0.2 |
| Example 2 | composition 2 | 2 | 1.8 | 3.5 | 0.8 | 1.8 | 0.2 |
| Comp. Ex. 1 | composition 1 | 3 | 2.2 | 5.1 | 1.1 | 1.2 | 0.3 |
| Comp. Ex. 2 | composition 2 | 7 | 0.8 | 3.9 | 0.8 | 1.5 | 0.5 |
| Comp. Ex. 3 | composition 1 | 6 | 1.5 | 4.3 | 1.2 | 1.0 | 0.3 |

<Fabrication of Planographic Printing Plate Precursors>

Next, each aluminum web coil was, while uncoiled, continuously processed for surface-roughening, anodic oxidation and post-treatment according to the process shown in Table 9 below to be a support for planographic printing plates.

The roughened surface of the long, web-like support for planographic printing plates that had been produced according to the process as above was coated with a coating liquid for a photosensitive layer mentioned below, and the resulting planographic printing plate precursor was wound up in coils, and stored for 2 weeks.

TABLE 9

| | | | | Surface-Roughening | | | Anodic Oxidation | |
|---|---|---|---|---|---|---|---|---|
| Processing Step | Etching (1) | Desmutting (1) | AC-electrolytic surface-roughening | Etching (2) | Desmutting (2) | Formation of oxide film | Hydrophilication | Undercoating |
| Condition | Al dissolution 5.5 g/m$^2$ | nitric acid spraying | total quantity of electricity 270 C/dm$^2$ | Al dissolution 0.2 g/m$^2$ | sulfuric acid spraying | amount of oxide film formed 2.6 g/m$^2$ | processed with sodium silicate | coated with onium/acid-containing polymer |

| <Composition of Coating Liquid for Photosensitive Layer> | |
|---|---|
| Carbon black dispersion | 10.0 g |
| 4-Diazodiphenylamine-formaldehyde condensate hexafluorophosphate | 0.5 g |
| Methacrylic acid/2-hydroxyethyl acrylate/benzyl methacrylate/acrylonitrile radical copolymer (monomer molar ratio, 15:30:40:15; weight-average molecular weight, 100,000) | 5.0 g |
| Malic acid | 0.05 g |
| Fluorine-containing surfactant (3M's FC-430 ™) | 0.05 g |
| 1-Methoxy-2-propanol | 80.0 g |
| Ethyl lactate | 15.0 g |
| Water | 5.0 g |

The aluminum plate of Comparative Example 2 was greatly waved. Therefore, while it was processed into a support and while the support was processed into a planographic printing plate precursor, it meandered and could not stably travel in the processing line.

After stored for 2 weeks, each precursor coil was, while uncoiled, slit through a slitter to cut off the edges, and the resulting precursor plate having a width of 1,000 mm was cut with a cutter into pieces each having a length of 800 mm. These are planographic printing plate precursor sheets.

Each precursor sheet was tested to measure the number of the MD edge strains of one edge thereof (per 1000 mm), the maximum height of the edge strains, and the total height of all the edge strains. The test of measuring the number of the edge strains, the maximum height thereof and the total height thereof was carried out according to the process described in the fourth embodiment hereinabove, in which, however, a glass level table having an inspection face of glass was used in place of the level table 4 illustrated in FIGS. 6 to 8. In addition, the height of the burrs formed at the cut edges of each precursor sheet was measured with a surface roughness gauge (Tokyo Precision Instruments' Surfcom™). The data are given in Table 10 below.

Further, each precursor sheet was passed through a plate travel tester mentioned below to check as to whether or not it can smoothly travel through the tester. This test is for checking the precursor sheets as to whether or not they can smoothly pass through a plate-making device containing an exposure unit and through a developing device, not entangling or meandering in them. The constitution of the plate travel tester is shown in FIG. 13.

Figure 13:
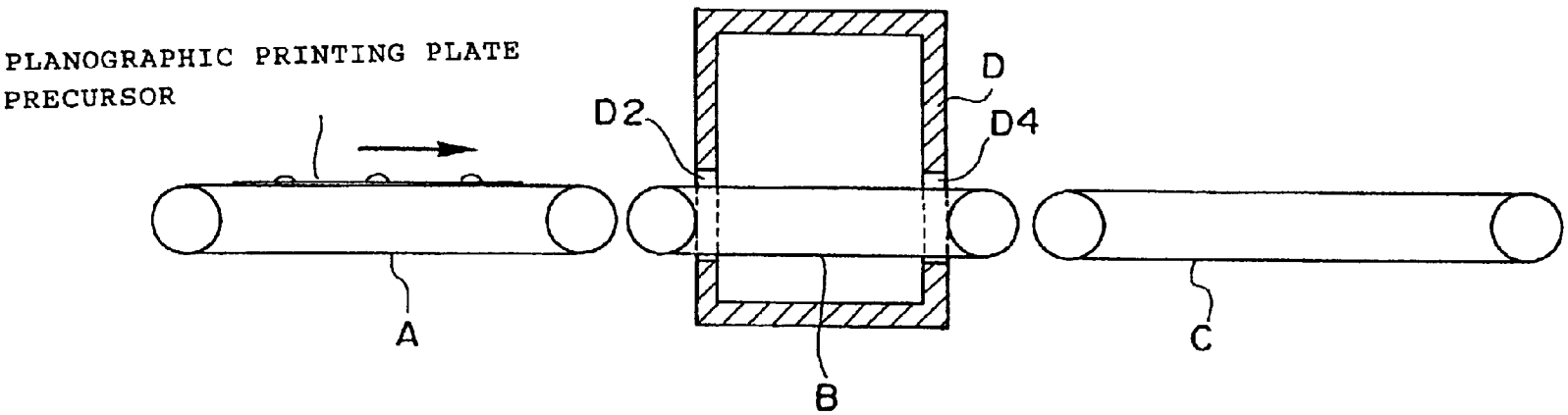
FIG. 13 is a schematic view showing the outline of the constitution of a plate travel tester used in the examples of the fourth and fifth embodiments of the invention, in which the tester is for monitoring planographic printing plate precursors for their ability to travel through processing devices.

As in FIG. 13, the plate travel tester comprises belt conveyors A, B and C for conveying the precursor sheet to be tested, and a housing D. In this, the housing D is co constructed that the center belt conveyor B runs through the lower half part thereof, and the precursor sheet conveyed by the belt conveyor B runs into the housing D via its inlet D2 and goes out of it via its outlet D4.

Precisely, the inlet D2 and the outlet D4 are both flat rectangular openings; the inlet D2 is so dimensioned that the distance between the top face of the belt conveyor B and the ceiling of the inlet D2 is, for example 1 mm; and the outlet D4 is so dimensioned that the distance between the top face of the belt conveyor B and the ceiling of the outlet D4 is, for example 2 mm.

Using the plate travel tester as in FIG. 13, each precursor sheet was tested for its traveling ability, according to the process mentioned below.

First the belt conveyors A, B and C are driven, and when their driving speed has become constant, a precursor sheet to be tested is put on the belt conveyor A.

The precursor sheet on the belt conveyor A is conveyed toward the belt conveyor B, on which it is let into the housing D, travels therethrough, and goes out of the housing D.

In this stage, if the precursor sheet does not have any large edge strains, it is not caught by the ceiling of the inlet D2 and that of the outlet D4 and does not collide against the side walls of the inlet D2 the outlet D4, and therefore it can smoothly travel through the housing D not meandering therethrough.

However, if the precursor sheet has some large edge strains, its edge strains will be caught by the ceilings of the inlet D2 and/or the outlet D4 and will collide against the side walls of the inlet D2 and/or the outlet D4, and therefore the precursor sheet will meander through the housing D. It is believed that the precursor sheet will meander and entangle when it is passed through a plate-making device and a developing device.

The precursor sheets of Examples and Comparative Examples were tested and evaluated for their traveling ability in five ranks A to E, according to the criteria mentioned below. The test result is given in Table 10.

A: Tested in the tester of FIG. 8, the sheets neither meandered nor entangled therein.
B: Tested in the tester, the sheets meandered in some degree but did not entangle therein, and they are acceptable.
C: Tested in the tester, the sheets obviously meandered but did not entangle therein, and they are acceptable.
D: Tested in the tester, the sheets much meandered but did not entangle therein. They are unacceptable.
E: Tested in the tester, the sheets much meandered and entangled therein, and they are unacceptable.

In addition, each precursor sheet was fitted to the blanket of an offset printer, and checked how and to what degree it rose up from the blanket. Thus tested, the precursor sheets were evaluated in five ranks, A to E. The test result is given in Table 10.

TABLE 10

| | | | Planographic Printing Plate Precursor | | | | | |
|---|---|---|---|---|---|---|---|---|
| | | | Edge Strains (/1000 mm) | | | | | |
| | Composition | Stability in Production Line | Number of Edge Strains | Maximum Height | Total Height | Burrs (μm) | Traveling Stability | Fitness to Blanket |
| Example 1 | Composition 1 | not meandered | 2 | 1.2 | 1.5 | 5 | A | A |
| Example 2 | Composition 2 | not meandered | 2 | 1.4 | 2.0 | 8 | B | A |
| Comp. Ex. 1 | Composition 1 | not meandered | 3 | 2.3 | 5.0 | 8 | E | E |
| Comp. Ex. 2 | Composition 1 | meandered | 7 | 0.5 | 3.0 | 12 | E | D |
| Comp. Ex. 3 | Composition 2 | not meandered | 6 | 1.5 | 6.1 | 8 | D | E |

In the inspection method of the fourth embodiment, the acceptable level of the edge strains of coiled aluminum webs is as follows: The number of the edge strains/1.5 m is at most 5, the maximum height of the edge strains is at most 2 mm, and the total height of all the edge strains is at most 4 mm. In Examples 1 and 2, the aluminum webs which, when tested according to the inspection method, fell within the acceptable ranges in point of all the number of the edge strains, the maximum height thereof and the total height thereof, were processed into planographic printing plate precursors. The precursors of Examples 1 and 2 have a few small burrs, and their traveling stability and fitness to blanket are both good. In Comparative Examples 1 to 3, however, the aluminum webs which, when tested according to the inspection method, fell outside the acceptable ranges in point of any one of the number of the edge strains, the maximum height thereof and the total height thereof, were processed into planographic printing plate precursors. The precursors of Comparative Examples 1 to 3 are all not good, as their traveling stability and fitness to blanket are poor. In particular, the precursor of Comparative Example 2 has many large burrs though its edge strains are not so large, and its traveling stability is poor. This is because its burrs are caught by the conveyor belts and the precursor sheet meanders while it moves to the next conveyor belt.

From the above, it is understood that the aluminum plate for planographic printing plate supports of the fourth and fifth embodiments of the invention meanders little when processed for surface roughening and for anodic oxidation, that the planographic printing plate precursors comprising the aluminum plate support can stably travel in plate-making devices while processed therein, and that the planographic printing plates from the precursors well fit to blankets in printers.

Specifically, in the fourth and fifth embodiments of the invention, inexpensive materials such as scrapped aluminum can be used for producing aluminum plates for planographic printing plate supports, and the aluminum plates are well processed into supports and precursors of planographic printing plate supports with no trouble of feed disorder or meandering in the line of processing them for surface-roughening, anodic oxidation and plate making. The traveling stability of the planographic printing plate precursors produced in these embodiments in the line of processing them into planographic printing plates is extremely good.

While the invention has been described in detail and with reference to specific embodiments thereof, it will be apparent to one skilled in the art that various changes and modifications can be made therein without departing from the spirit and scope thereof.

What is claimed is:

1. A method for producing a support for planographic printing plates, which comprises a step of roughening at least one surface of an aluminum plate and in which the surface-roughening step includes:

(a) a pro-electrolytic surface-roughening step of electrolytically pre-roughening the surface of the aluminum plate in an aqueous hydrochloric acid solution that contains hydrochloric acid as the essential acid ingredient, (b) an alkali-etching step of contacting the aluminum plate of which the surface has been electrolytically pre-roughened in the previous pro-electrolytic surface-roughening step, with an alkali solution to etch the aluminum plate, (c) a desmutting step of desmutting the aluminum plate having been etched in the previous alkali-etching step, with sulfuric acid by contacting the aluminum plate with an aqueous sulfuric acid solution having a sulfuric acid concentration of from 250 to 500 g/liter and an aluminum ion concentration of from 1 to 15 g/liter and having a liquid temperature failing between 60 and 90° C., for a contact period of time falling between 1 and 180 seconds, and (d) an electrolytic surface-roughening step of processing the aluminum plate having been desmutted in the previous desmutting step, in an aqueous nitric acid solution with an alternating current being applied thereto.

2. The method for producing a support for planographic printing plates as claimed in claim 1, wherein the surface-roughening step includes a mechanical surface-roughening step of mechanically roughening at least one surface of the aluminum plate, prior to the pro-electrolytic surface-roughening step.

3. The method for producing a support for planographic printing plates as claimed in claim 1, wherein the surface roughening step includes:

a second etching step of etching the aluminum plate, of which the surface has been roughened in the electrolytic surface-roughening step, with an alkali solution, and a final desmutting step of desmutting the aluminum plate which has been etched in the second etching step, by contacting the aluminum plate with an aqueous sulfuric acid solution.

4. The method for producing a support for planographic printing plates as claimed in claim 3, wherein the aluminum plate is so etched after being processed in the electrolytic surface-roughening step that from 0.01 to 5 $g/m^2$ of its surface is dissolved.

5. The method for producing a support for planographic printing plates as claimed in claim 1, wherein:

an AC electrolytic cell having therein a counter electrode to impart an alternating current to the aluminum plate is used in the electrolytic surface-roughening step, and the alternating current to be applied to the aluminum plate is so controlled that the quiescent time for which no current flows between the aluminum plate and the counter electrode falls between 0.001 and 0.6 second and that the pulse rise time, Tp, within which the current waveform rises up falls between 0.01 and 0.3 millisecond.

6. The method for producing a support for planographic printing plates as claimed in claim 1, which includes a step of anodic oxidation to form an oxide film on the surface of the aluminum plate of which the surface has been roughened in the surface-roughening step.

7. The method for producing a support for planographic printing plates as claimed in claim 6, wherein the anodic oxidation step includes a step of making the oxide film formed on the surface of the aluminum plate hydrophilic.

8. The method for producing a support for planographic printing plates as claimed in claim 6, wherein the anodic oxidation step includes a step of sealing micropores that exist in the oxide film formed on the surface of the aluminum plate.

9. The method for producing a support for planographic printing plates as claimed in claim 1, wherein the aluminum plate has an aluminum content falling between 95 and 99.4% by weight and a silicon content falling between 0.15 and 1% by weight.

10. The method for producing a support for planographic printing plates as claimed in claim 1, wherein the aluminum plate has an aluminum content falling between 95 and 99.4% by weight and a manganese content falling between 0.1 and 1.5% by weight.

11. A support for planographic printing plates, which is produced according to claim 1.

12. A planographic printing plate precursor, which comprises the support of claim 11 and a photosensitive or thermosensitive plate layer formed on the roughened surface of the support.

13. A method for producing a support for planographic printing plates, which comprises a step of roughening at least one surface of an aluminium plate and in which the surface-roughening step includes:

(a) a pre-electrolytic surface-roughening step of electrolytically pre-roughening the surface of the aluminum plate in an aqueous hydrochloric acid solution that contains hydrochloric acid as the essential acid ingredient, (b) an alkali-etching step of contacting the aluminum plate of which the surface has been electrolytically pre-roughened in the previous pre-electrolytic surface-roughening step, with an alkali solution to etch the aluminum plate, (c) a desmutting step of desmutting the aluminum plate having been etched in the previous alkali-etching step, with sulfuric acid by contacting the aluminum plate with an aqueous sulfuric acid solution having a sulfuric acid concentration of from 250 to 500 g/liter and an aluminum ion concentration of from 1 to 15 g/liter and having a liquid temperature falling between 60 and 90° C. for a contact period of time falling between 1 and 180 seconds, and (d) an electrolytic surface roughening step of processor the aluminum plate having been desmutted in the previous desmutting step, in an aqueous nitric acid solution with alternating current being applied thereto, wherein the surface-roughening step includes an etching step of contacting the aluminum plate with an alkali solution to etch the plate, prior to the pro-electrolytic surface-roughening step.

14. The method for producing a support for planographic printing plates as claimed in claim 2, wherein the aluminum plate is so etched before being processed in the pre-electrolytic surface-roughening step that from 1 to 15 g/m$^2$ of its surface is dissolved.

15. A method for producing a support for planographic printing plates, which comprises a step of roughening at least one surface of an aluminum plate, the surface-roughening step includes an AC-electrolytic surface-roughening step of processing the aluminum plate in an aqueous nitric acid solution having a nitrate ion concentration and an aluminum ion concentration of from 5 to 15 g/liter each, and an ammonium ion concentration of from 10 to 300 ppm, and having a bath temperature falling between 50 and 80° C.

16. The method for producing a support for planographic printing plates as claimed in claim 15, wherein the AC-electrolytic surface-roughening step is so controlled that the ratio of the quantity of electricity QA of the alternating current applied to the aluminum plate acting as an anode, to the quantity of electricity QC thereof applied to the aluminum plate acting as a cathode, QA/QC falls between 0.9 and 1, the current duty is 0.5, and the current frequency falls between 40 and 120 Hz.

17. The method for producing a support for planographic printing places as claimed in claim 15, wherein the alternating current to be applied to the aluminum plate in the AC-electrolytic surface-roughening step is so controlled that the pulse rise time, Tp, within which the current waveform rises up falls between 0.01 and 0.3 millisecond and the quiescent time for which no current flows through the aluminum plate falls between 0.001 and 0.6 second.

18. The method for producing a support for planographic printing plates as claimed in claim 15, wherein:

an AC electrolytic cell unit which comprises an electrolytic cell containing therein the aqueous nitric acid solution and enabling the aluminum plate to pass through it, a power source for applying an alternating current to the aluminum plate, and a counter electrode disposed inside the cell so as to face the aluminum plate while the plate is electrolytically processed therein, and in which an alternating current is applied between the aluminum plate and the counter electrode to thereby electrolytically roughen the surface of the aluminum plate, is used in the AC-electrolytic suface-roughening step, and the AC mode is so controlled that it includes at least once the quiescent time for which no alternating current flows between the aluminum plate and the counter electrode and char the quiescent time falls between 0.001 and 0.6 second/once.

19. The method for producing a support for planographic printing plates as claimed in claim 15, wherein the surface-roughening step comprises:

a first etching step of contacting the aluminum plate with an aqueous alkali solution to etch the aluminum plate, the AC-electrolytic surface-roughening step of roughening the thus-etched surface of the aluminum plate, and a second etching step of further contacting the thus-roughened aluminum plate with an aqueous alkali solution to etch the aluminum plate, in that order.

20. The method for producing a support for planographic printing plates as claimed in claim 19, wherein the aluminum plate is dissolved to a degree of from 1 to 15 g/m$^2$ in the first etching step, and is dissolved to a degree of from 0.01 to 5 g/m$^2$ in the second etching step.

21. The method for producing a support for planographic printing plates as claimed in claim 19, wherein the surface-roughening step includes a first desmutting step of contacting the aluminum plate with an aqueous acid solution between the first etching step and the AC-electrolytic surface-roughening step, and includes a second desmutting step of further contacting the aluminum plate with an aqueous acid solution after the second-etching step.

22. The method for producing a support for planographic printing plates as claimed in claim 19, wherein the surface-roughening step includes a step of mechanically roughening at least one surface of the aluminum plate, prior to the first etching step.

23. The method for producing a support for planographic printing plates an claimed in claim 15, wherein the aluminum plate of which at leant one surface has been roughened in the surface-roughening step is subjected to anodic oxidation to thereby form an oxide film on its roughened surface.

24. The method for producing a support for planographic printing plates as claimed in claim 23, wherein the surface of the aluminum plate having the oxide film formed thereon is made hydrophilic.

25. The method for producing a support for planographic printing plates as claimed in claim 23, wherein the anodic oxidation step includes a step of sealing micropores that exist in the oxide film fanned on the surface of the aluminum plate.

26. The method for producing a support for planographic printing plates as claimed in claim 15, wherein the aluminum plate has an aluminum content falling between 95 and 99.4% by weight and a silicon content falling between 0.15 and 1% by weight.

27. The method for producing a support for planographic printing plates as claimed in claim 15, wherein the aluminum plate has an aluminum content falling between 95 and 99.4% by weight and a manganese content falling between 0.1 and 1.5% by weight.

28. A support for planographic printing plates, which is produced according to claim 15.

29. A planographic printing plate precursor, which comprises the support of claim 28 and a photosensitive or thermosensitive plate layer formed on the roughened surface of the support.

* * * * *